US010233612B2

(12) United States Patent
Perry

(10) Patent No.: US 10,233,612 B2
(45) Date of Patent: Mar. 19, 2019

(54) TRACTOR ATTACHMENT AND TRACTOR ATTACHMENT KIT

(71) Applicant: Curtis Industries, LLC, Worcester, MA (US)

(72) Inventor: Christopher Scott Perry, Douglas, MA (US)

(73) Assignee: Curtis Industries, LLC, West Boylston, MA (US)

( * ) Notice: Subject to any disclaimer, the term of this patent is extended or adjusted under 35 U.S.C. 154(b) by 258 days.

(21) Appl. No.: 15/078,412

(22) Filed: Mar. 23, 2016

(65) Prior Publication Data

US 2016/0281318 A1 Sep. 29, 2016

Related U.S. Application Data

(60) Provisional application No. 62/136,661, filed on Mar. 23, 2015.

(51) Int. Cl.

| | |
|---|---|
| ***E02F 3/96*** | (2006.01) |
| ***E02F 3/36*** | (2006.01) |
| ***E02F 3/413*** | (2006.01) |
| ***B66F 9/065*** | (2006.01) |
| ***B66F 9/14*** | (2006.01) |
| ***B66F 9/18*** | (2006.01) |

(52) U.S. Cl.

CPC ..... *E02F 3/962* (2013.01); *B66F 9/065* (2013.01); *B66F 9/142* (2013.01); *B66F 9/18* (2013.01); *E02F 3/3618* (2013.01); *E02F 3/3622* (2013.01); *E02F 3/3668* (2013.01); *E02F 3/3672* (2013.01); *E02F 3/4133* (2013.01); *E02F 3/96* (2013.01)

(58) Field of Classification Search

CPC ..... E02F 3/3609; E02F 3/3618; E02F 3/3622; E02F 3/3668; E02F 3/3672; E02F 3/413; E02F 3/4133; E02F 3/4135; E02F 3/96; E02F 3/962

USPC ..... 414/723, 729, 732, 733, 739

See application file for complete search history.

(56) References Cited

U.S. PATENT DOCUMENTS

| | | | | |
|---|---|---|---|---|
| 2,799,412 A * | 7/1957 | Pilch | ..... | B60P 3/41 414/704 |
| 6,470,660 B1 | 10/2002 | Buss et al. | | |
| 6,523,284 B1 | 2/2003 | Clugston | | |

(Continued)

*Primary Examiner* — Saul Rodriguez
*Assistant Examiner* — Brendan P Tighe
(74) *Attorney, Agent, or Firm* — Fish & Richardson P.C.

(57) ABSTRACT

A tractor attachment mountable on a loader boom of a tractor and a tractor attachment kit. In one embodiment, the tractor attachment is a grapple assembly, and the grapple assembly kit includes a mounting assembly, a plurality of clamping units, and a plurality of support units. The clamping units and the support units are removably mountable on the mounting assembly and may be arranged in different combinations on the mounting assembly. Such combinations may range from a single clamping unit mounted on the mounting assembly to a mixture of clamping units and support units mounted on the mounting assembly to several clamping units mounted on the mounting assembly. The clamping units may have alternative pivot points to permit jaws of the clamping unit to close at different speeds and with different forces. One or more fangs may be removably mounted on a clamping unit to enhance its grip.

26 Claims, 53 Drawing Sheets

(56) References Cited

U.S. PATENT DOCUMENTS

| | | | | |
|---|---|---|---|---|
| 6,589,007 | B2 | 7/2003 | Burton | |
| 6,601,891 | B1 | 8/2003 | Gregory | |
| 7,000,339 | B1 * | 2/2006 | Ramun | B66C 3/04 294/86.29 |
| 7,226,268 | B2 | 6/2007 | Gustafson et al. | |
| 7,648,326 | B2 | 1/2010 | Santele et al. | |
| 7,785,057 | B2 | 8/2010 | Noonan et al. | |
| 7,913,431 | B1 | 3/2011 | Beam et al. | |
| 8,449,241 | B2 | 5/2013 | Fritsch | |
| 8,689,898 | B2 | 4/2014 | Benesch | |
| 9,080,319 | B2 | 7/2015 | Oates, Jr. et al. | |
| 9,169,614 | B2 | 10/2015 | Miller | |
| 9,457,999 | B2 | 10/2016 | Belotti et al. | |
| 2013/0028696 | A1 * | 1/2013 | Peschel | B66F 9/142 414/705 |

* cited by examiner

TRACTOR ATTACHMENT AND TRACTOR ATTACHMENT KIT

CROSS-REFERENCE TO RELATED APPLICATIONS

The present application claims the benefit under 35 U.S.C. 119(e) of U.S. Provisional Patent Application No. 62/136,661, filed Mar. 23, 2015, the disclosure of which is incorporated herein by reference.

BACKGROUND OF THE INVENTION

The present invention relates generally to tractor attachments and relates more particularly to a novel tractor attachment and to a tractor attachment kit.

Tractors are powerful motor vehicles commonly used in, for example, agriculture, landscaping, and construction to perform a variety of moving, lifting and other tasks. To perform such tasks, various types of specialized attachments are typically coupled to the tractor. One such specialized tractor attachment is a bucket, the bucket being coupled to the front end of the tractor using an assembly commonly referred to as a loader boom. One common type of loader boom comprises a pair of arms and a pair of mounts. The rear end of each arm is pivotally mounted on the tractor, and a mount is pivotally mounted on the front end of each arm. The bucket, in turn, is typically mechanically coupled to the pair of mounts. Pivotal movement of the arms relative to the tractor is typically provided by a first hydraulic mechanism, and pivotal movement of the mounts relative to the arms is typically provided by a second hydraulic mechanism. In this manner, the bucket may be raised or lowered by operation of the first hydraulic mechanism, and the bucket may be angularly adjusted by operation of the second hydraulic mechanism.

Referring now to FIGS. 1 and 2, there are shown a front, perspective view and an enlarged, fragmentary, rear, perspective view of an exemplary conventional tractor assembly, the exemplary conventional tractor assembly being represented generally by reference numeral 11.

Tractor assembly 11, which is commercially available from Deere & Company (Moline, Ill.), comprises a tractor 13. Although tractor 13 is depicted in FIG. 1 as a four-wheeled motor vehicle, it is to be understood that tractor 13 need not be a four-wheeled motor vehicle and may, instead, comprise other types of vehicles.

Tractor assembly 11 additionally comprises a bucket 15.

Tractor assembly 11 further comprises a loader boom 17. Loader boom 17, which is also shown separately in FIG. 3(*a*), comprises a pair of arms 19-1 and 19-2 and a pair of mounts 21-1 and 21-2. Arms 19-1 and 19-2 are pivotally mounted at their respective rear ends on tractor 13. Pivotal movement of arms 19-1 and 19-2 relative to tractor 13 may be provided by a first hydraulic mechanism comprising one or more hydraulic cylinders 23. Mounts 21-1 and 21-2 are pivotally mounted on the front ends of arms 19-1 and 19-2, respectively. Pivotal movement of mounts 21-1 and 21-2 relative to arms 19-1 and 19-2 may be provided by a second hydraulic mechanism comprising one or more hydraulic cylinders 25. Bucket 15 is mechanically coupled to mounts 21-1 and 21-2. Such coupling is typically achieved by hooks on the rear of bucket 15 that matingly fit over the top ends 23-1 and 23-2 of mounts 21-1 and 21-2, respectively, and by pins extending from the rear of bucket 15 that are received in pin holes 27-1 and 27-2 in mounts 21-1 and 21-2, respectively (one such hook 29 and one such pin 31 being shown in FIG. 2).

The particulars of the loader boom, as well as the complementary structure on the bucket for attaching to the front end of the loader boom, tend to vary from one manufacturer to another. An example of an alternative conventional loader boom is shown in FIG. 3(*b*) and is represented generally by reference numeral 35. Loader boom 35 is similar in certain respects to loader boom 17 and comprises a pair of arms 37-1 and 37-2 that are adapted to be pivotally mounted at their respective rear ends on tractor 13. Pivotal movement of arms 37-1 and 37-2 relative to tractor 13 may be effected by a mechanism similar to that used to move arms 19-1 and 19-2 of loader boom 17. Loader boom 35 differs principally from loader boom 17 in that loader boom 35 does not include mounts 21-1 and 21-2 and, instead, includes a plurality of pins 39-1 through 39-4. Pins 39-1 and 39-2 are adapted to couple arms 37-1 and 37-2, respectively, to a bucket (not shown) by being inserted through plates 41-1 and 41-2 on arm 37-1 and through plates 41-3 and 41-4 on arm 37-2, respectively, as well as through corresponding plates (not shown) that are fixedly mounted on the bucket. Pins 39-3 and 39-4 are adapted to couple the movable ends 45-1 and 45-2 of hydraulic cylinders 43-1 and 43-2, respectively, to the bucket by being inserted through ends 45-1 and 45-2, as well as through the aforementioned plates that are fixedly mounted on the bucket. Fasteners 47-1 through 47-4 may be used to retain pins 39-1 through 39-4, respectively, in place.

As can be appreciated, there are situations in which it would be desirable to replace the functionality afforded by a bucket with the functionality afforded by another type of tractor attachment. As can also be appreciated, it would also be desirable to enable such a replacement to be made without requiring that changes be made to the loader boom. In other words, it would be desirable for the replacement attachment to be attachable to a conventional loader boom. Although some such replacement attachments exist, some of these replacement attachments suffer from certain shortcomings in terms of cost, weight, size, and/or variability in use.

SUMMARY OF THE INVENTION

It is an object of the present invention to provide a novel tractor attachment.

According to a preferred feature of the invention, the tractor attachment as described above is a grapple assembly.

According to a preferred feature of the invention, the grapple assembly as described above is capable of being used with, but is not limited to being used with, a conventional loader boom mounted on a tractor.

According to another preferred feature of the invention, the grapple assembly as described above is a capable of being used in a plurality of different speed/force modes, such as a slower closing mode with a higher clamping force or a faster closing mode with a lower clamping force, and/or is capable of being used in a plurality of different size modes, such as a compact mode with individual grapple components disposed adjacent to or in contact with one another or an expanded mode with individual grapple components spaced apart from one another.

According to yet another preferred feature of the invention, the grapple assembly as described above overcomes at least some of the shortcomings of existing grapple attachments, such existing grapple attachments tending to be expensive, heavy, bulky, and lacking variability in use.

It is another object of the present invention to provide a novel tractor attachment kit.

According to a preferred feature of the invention, the kit as described above is a grapple assembly kit.

According to another preferred feature of the invention, the grapple assembly kit is capable of being assembled in a plurality of different ways, such as with different combinations of clamping and support components and/or with the same combination of clamping and/or support components arranged in different ways and/or with certain grapple components being operated in different speed/force modes.

According to one aspect of the invention, there is provided a tractor attachment mountable on a tractor loader boom, the tractor attachment comprising (a) a mounting assembly, the mounting assembly being removably mountable on the tractor loader boom; and (b) a clamping unit, the clamping unit being removably mounted on the mounting assembly, the clamping unit comprising an upper jaw and a lower jaw, the upper jaw being pivotally mounted on the lower jaw, the clamping unit further comprising means for moving the upper jaw relative to the lower jaw.

In another, more detailed feature of the invention, the upper jaw may be pivotally mounted on the lower jaw at one of a plurality of alternative pivot points.

In another, more detailed feature of the invention, the plurality of alternative pivot points may comprise a first pivot point and a second pivot point, the first pivot point producing a faster closing speed, the second pivot point producing a greater clamping force.

In another, more detailed feature of the invention, the clamping unit may further comprise at last one fang, the at least one fang being removably mounted on the upper jaw.

In another, more detailed feature of the invention, the mounting assembly may comprise a frame, the frame may comprise first and second rails and first and second brackets, the first and second brackets may interconnect the first and second rails and may have structure complementary to the tractor loader boom, and the clamping unit may be removably mounted on the first and second rails.

In another, more detailed feature of the invention, the tractor attachment may further comprise a lock for removably securing the clamping unit on the mounting assembly.

In another, more detailed feature of the invention, the mounting assembly may comprise a rail, the rail may have a notch, the clamping unit may comprise an opening, the opening may be aligned with the notch, and the lock may comprise a first member and a second member, the first member and the second member being generally perpendicular to one another, the first member extending through the notch and through the opening, the second member extending downwardly between the rail and the clamping unit.

According to another aspect of the invention, there is provided a tractor attachment kit for use in assembling a tractor attachment mountable on a tractor loader boom, the tractor attachment kit comprising (a) a mounting assembly, the mounting assembly being removably mountable on the tractor loader boom; and (b) a first clamping unit, the first clamping unit being removably mountable on the mounting assembly, the first clamping unit comprising an upper jaw and a lower jaw, the upper jaw being pivotally mounted on the lower jaw, the first clamping unit further comprising means for moving the upper jaw relative to the lower jaw.

In another, more detailed feature of the invention, the tractor attachment kit may further comprise a second clamping unit, the second clamping unit may be removably mountable on the mounting assembly, the second clamping unit may comprise an upper jaw and a lower jaw, the upper jaw may be pivotally mounted on the lower jaw, and the second clamping unit may further comprise means for moving the upper jaw relative to the lower jaw.

In another, more detailed feature of the invention, the mounting assembly may be sized to permit the first clamping unit and the second clamping unit to be concurrently mounted thereon.

In another, more detailed feature of the invention, the tractor attachment kit may further comprise a first support unit, and the first support unit may be removably mountable on the mounting assembly.

In another, more detailed feature of the invention, the mounting assembly may be sized to permit the first clamping unit and the support unit to be concurrently mounted thereon.

In another, more detailed feature of the invention, the tractor attachment kit may further comprise a second clamping unit and a third clamping unit, the second and third clamping units may be identical to the first clamping unit, the tractor attachment kit may further comprise a first support unit and a second support unit, the first and second support units may be identical to one another, each of the first and second support units may be removably mountable on the mounting assembly, and the mounting assembly may be sized to permit up to a threesome of clamping units and/or support units to be concurrently mounted thereon.

In another, more detailed feature of the invention, the tractor attachment kit may further comprise a pair of forklift tines removably mountable on the mounting assembly.

According to yet another aspect of the invention, there is provided a tractor attachment mountable on a tractor loader boom, the tractor attachment comprising (a) a mounting assembly, the mounting assembly being removably mountable on the tractor loader boom; (b) a first clamping unit, the first clamping unit being removably mounted on the mounting assembly, the first clamping unit comprising an upper jaw and a lower jaw, the upper jaw being pivotally mounted on the lower jaw, the first clamping unit further comprising means for moving the upper jaw relative to the lower jaw; and (c) one of a second clamping unit and a first support unit removably mounted on the mounting assembly, the second clamping unit comprising an upper jaw and a lower jaw, the upper jaw being pivotally mounted on the lower jaw, the second clamping unit further comprising means for moving the upper jaw relative to the lower jaw.

In another, more detailed feature of the invention, the second clamping unit may be removably mounted on the mounting assembly.

In another, more detailed feature of the invention, a third clamping unit may be removably mounted on the mounting assembly, the third clamping unit may comprise an upper jaw and a lower jaw, the upper jaw may be pivotally mounted on the lower jaw, and the third clamping unit may further comprise means for moving the upper jaw relative to the lower jaw.

In another, more detailed feature of the invention, the first support unit may be removably mounted on the mounting assembly.

In another, more detailed feature of the invention, a second support may be removably mounted on the mounting assembly.

In another, more detailed feature of the invention, the tractor attachment may further comprise the second clamping unit removably mounted on the mounting assembly.

The present invention is also directed to a method of assembling and disassembling a tractor attachment and to a method of using the tractor attachment kit described herein to reversibly assemble a tractor attachment.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 3(*b*) is an alternative conventional loader boom to the conventional loader boom shown in FIGS. 1, 2, and 3(*a*);

FIGS. 10(*c*) and 10(*d*) are fragmentary right perspective and fragmentary left perspective views, respectively, of an alternative clamping unit to the clamping unit shown in FIGS. 6(*a*) through 6(*c*);

FIG. 13(*e*) is a section view taken along line 1-1 of FIG. 13(*d*);

FIG. 13(*f*) is a section view taken along line 2-2 of FIG. 13(*d*);

DETAILED DESCRIPTION OF THE INVENTION

Figure 4:
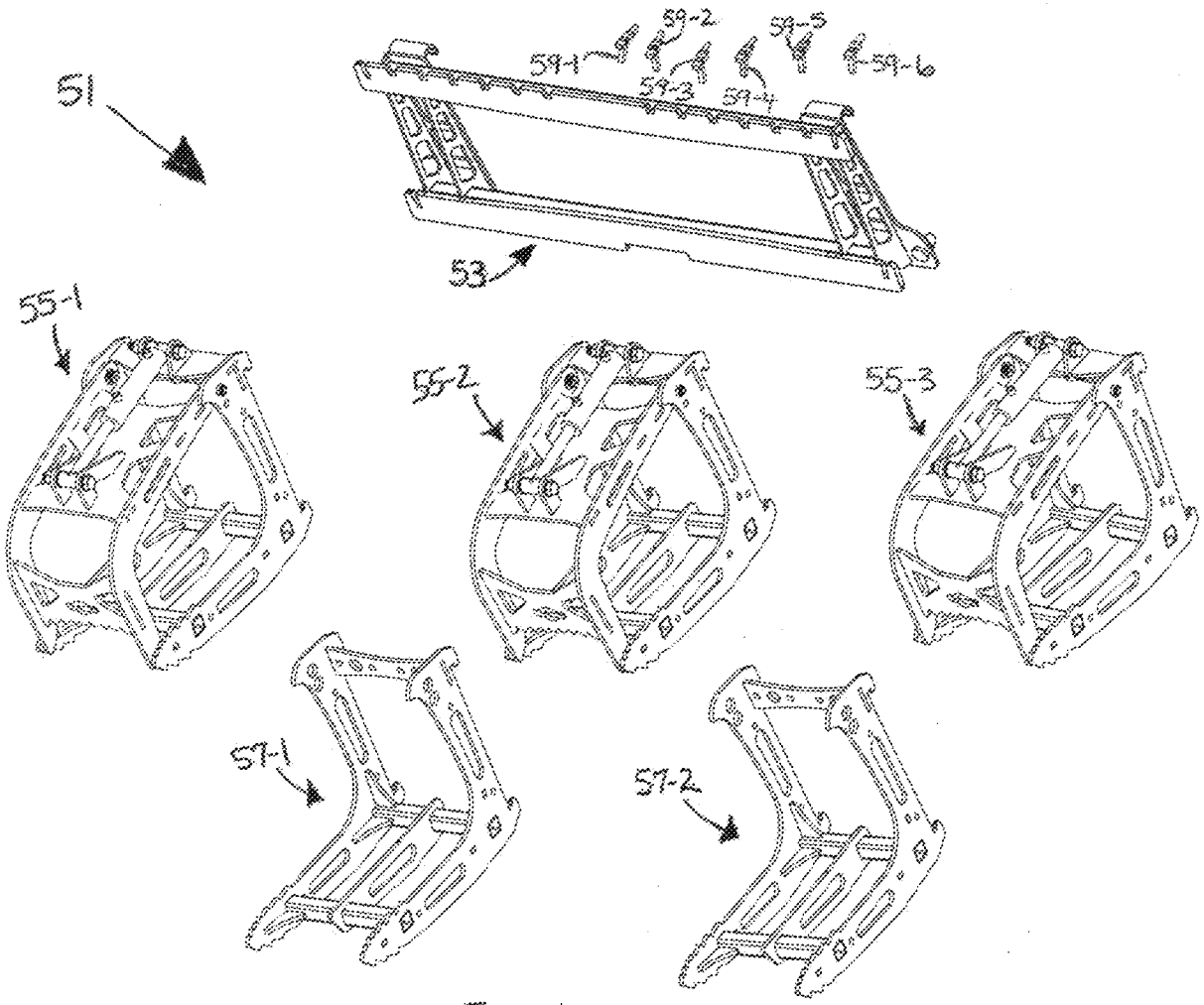
FIG. 4 is a perspective view of a first embodiment of a grapple assembly kit constructed according to the present invention.

Referring now to FIG. 4, there is shown a perspective view of a first embodiment of a grapple assembly kit constructed according to the present invention, the grapple assembly kit being represented generally by reference numeral 51.

Grapple assembly kit 51, which may be used with a loader boom, such as, for example, loader boom 17, may comprise a mounting assembly 53, a plurality of clamping units 55-1 through 55-3, a plurality of support units 57-1 through 57-2, and a plurality of locking members 59-1 through 59-6. As will be discussed below in greater detail, clamping units 55-1 through 55-3, support units 57-1 and 57-2, and locking member 59-1 through 59-6 are preferably modular in construction. As a result, a great number of different combinations of clamping units 55 and/or support units 57 and/or locking members 59 may be mounted on mounting assembly 53, all such combinations coming within the scope of the present invention. In addition, it is to be understood that, although grapple assembly kit 51 is shown in the present embodiment as having three clamping units 55-1 through 55-3, two support units 55-1 and 55-2, and six locking members 59-1 through 59-6, grapple assembly kit 51 may be modified so that the number of clamping units 55-1 through 55-3 may be greater than or less than three and/or so that the number of support units 55-1 and 55-2 may be greater than or less than two and/or so that the number of locking members 59-1 through 59-6 may be greater than or less than six. Additionally, although grapple assembly kit 51 is shown in the present application as being capable of mounting as few as a single clamping unit 55 (or a single support unit 57) on mounting assembly 53 or as many as up to three clamping units 55 and/or support units 57 on mounting assembly 53, it is to be understood that the dimensions of mounting assembly 53, clamping units 55, and/or support units 57 may be modified to accommodate more than a total of three clamping units 55 and/or support units 57.

Figure 5A:
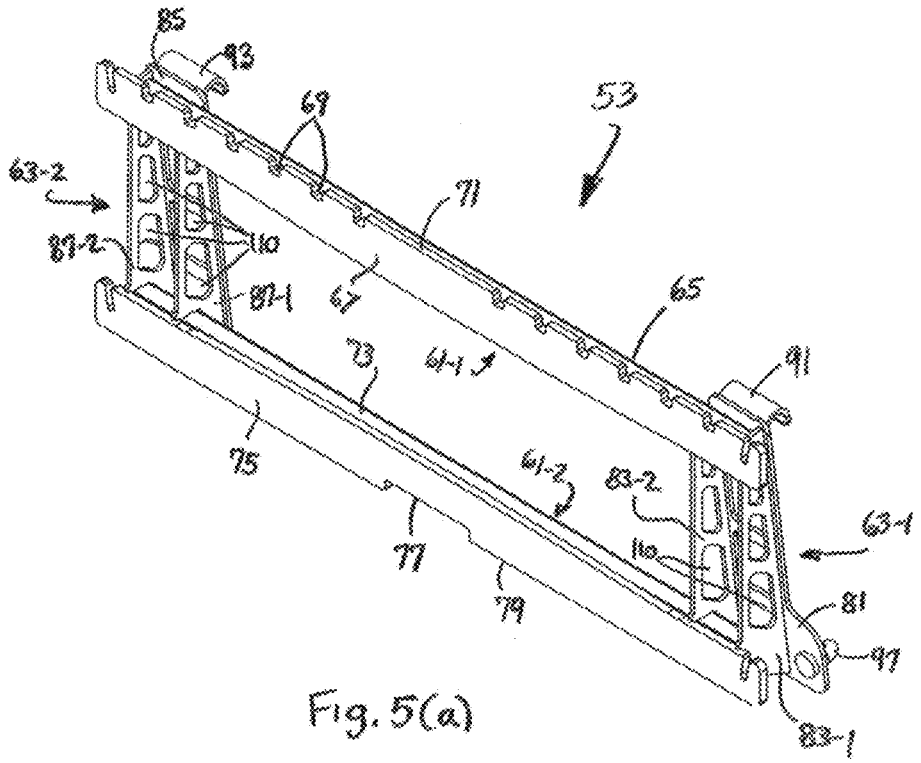
FIGS. 5(*a*) through 5(*g*) are front perspective, rear perspective, front, rear, top, right side, and exploded perspective views, respectively, of the mounting assembly shown in FIG. 4.
Figure 5B:
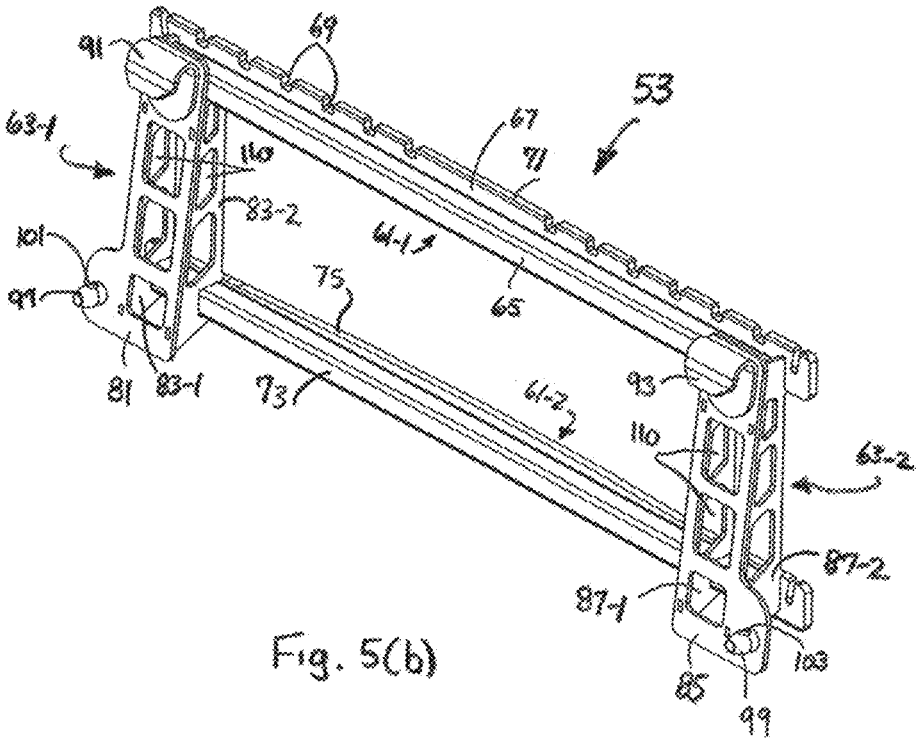
Figure 5C:
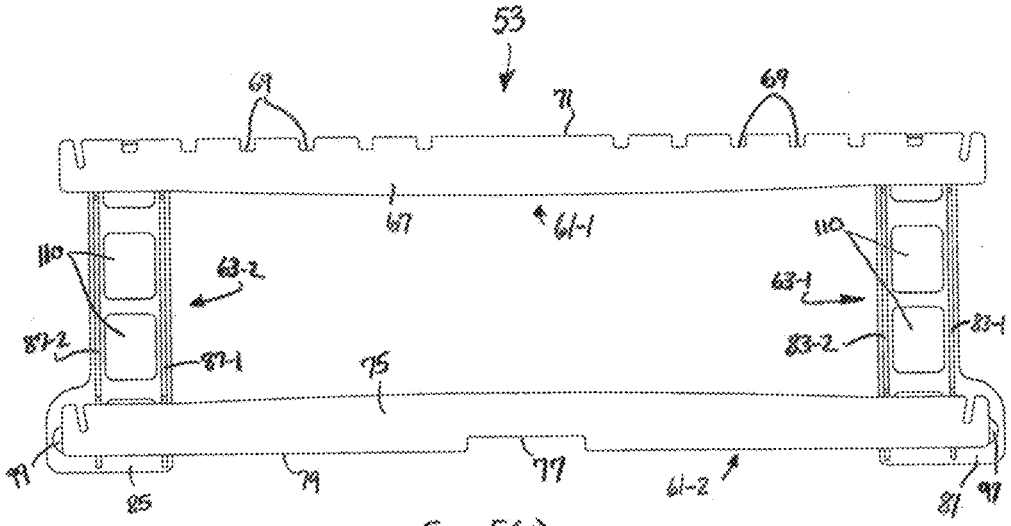
Figure 5D:
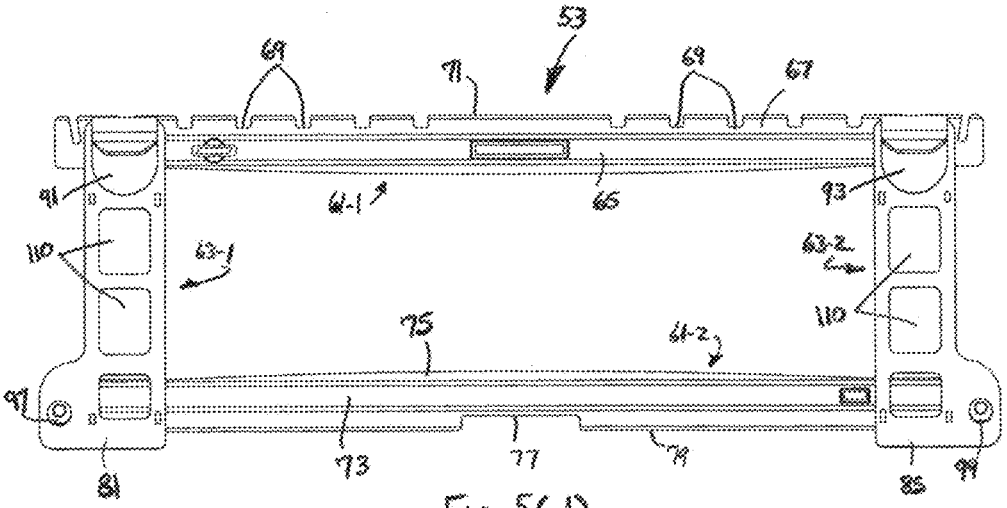
Figure 5A:
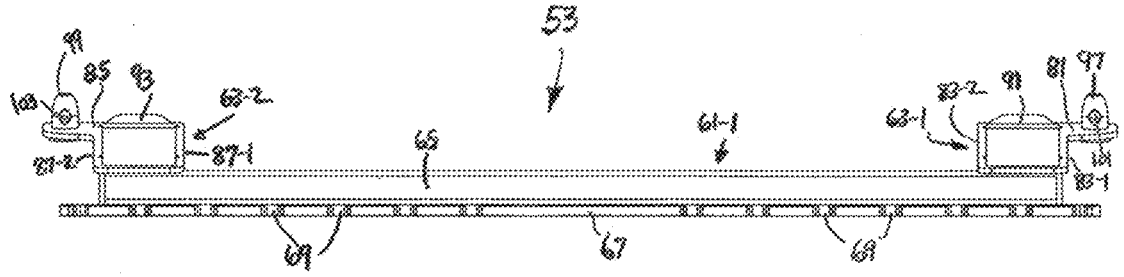
Figure 5C:
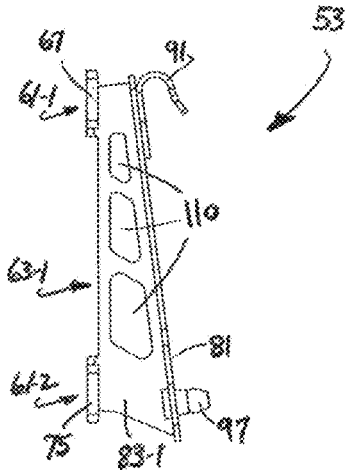
Figure 5:
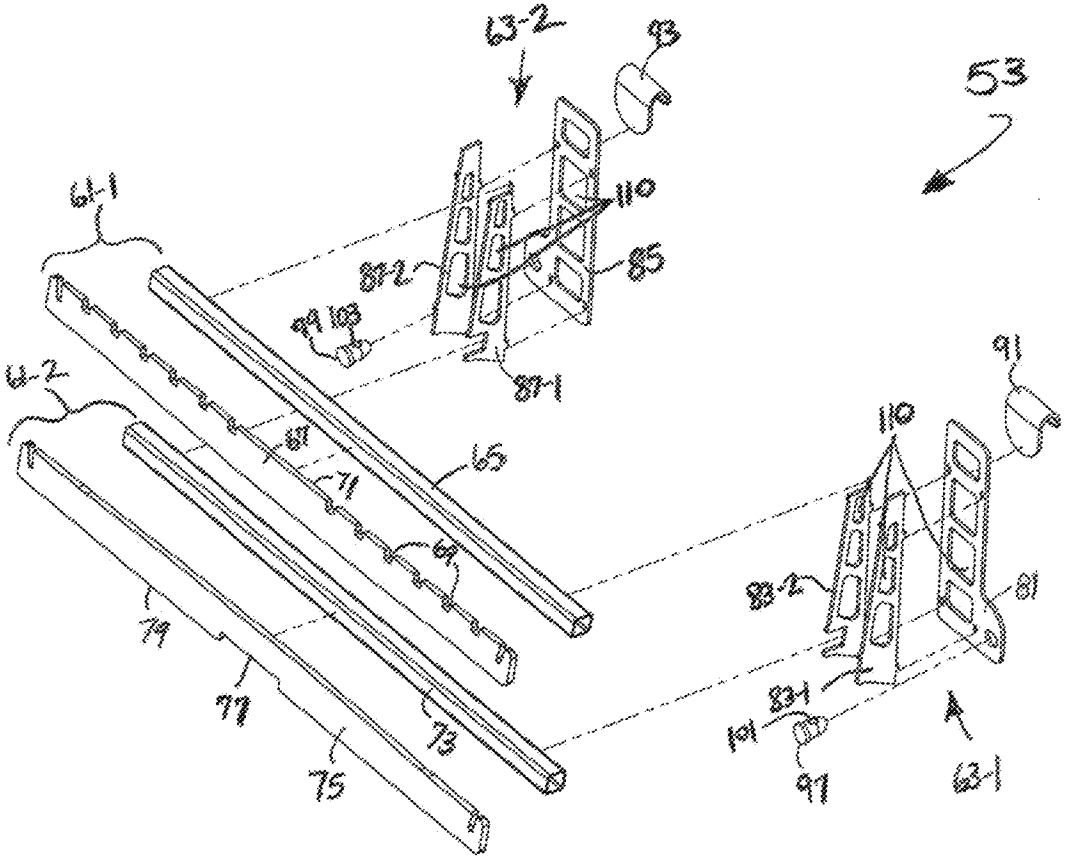

Mounting assembly 53, which is also shown separately in FIGS. 5(*a*) through 5(*g*), may comprise a pair of mounting rails 61-1 and 61-2 and a pair of mounting brackets 63-1 and 63-2. Mounting rails 61-1 and 61-2 and mounting brackets 63-1 and 63-2 may collectively form a generally rectangular frame. Rails 61-1 and 61-2, which are preferably made of a high strength steel or other similarly suitable material, may be arranged generally parallel to one another. Rail 61-1 may be shaped to include a rear portion 65 and a front portion 67. Rear portion 65 and front portion 67 of rail 61-1 may be separately fabricated and then fixedly joined to one another by suitable means, such as by welding; alternatively, rear portion 65 and front portion 67 of rail 61-1 may be fabricated as a unitary structure. As will be discussed further below, rear portion 65 of rail 61-1 may be fixed by welding or other suitable means to each of mounting brackets 63-1 and 63-2. Front portion 65 of rail 61-1 may be shaped to include a plurality of notches 69 spaced along a top surface 71 thereof.

Rail 61-2 may be shaped to include a rear portion 73 and a front portion 75. Rear portion 73 and front portion 75 of rail 61-2 may be separately fabricated and then fixedly joined to one another by suitable means, such as by welding; alternatively, rear portion 73 and front portion 75 of rail 61-2 may be fabricated as a unitary structure. As will be discussed further below, rear portion 73 of rail 61-2 may be fixed by welding or other suitable means to each of mounting brackets 63-1 and 63-2. Front portion 75 of rail 61-2 may be shaped to include a notch 77 disposed along a bottom surface 79 thereof.

Brackets 63-1 and 63-2, which are preferably made of a high strength steel or other similarly suitable material, may be arranged generally parallel to one another and generally perpendicularly relative to each of rails 61-1 and 61-2. Bracket 63-1 may be shaped to include a rear portion 81 and a pair of side portions 83-1 and 83-2. In a similar fashion, bracket 63-2 may be shaped to include a rear portion 85 and a pair of side portions 87-1 and 87-2. Each of brackets 63-1 and 63-2 may be fabricated by separately forming the respective rear and side portions thereof and then by joining the rear and side portions together by suitable means, such as by welding. Alternatively, the respective rear and side portions of each of brackets 63-1 and 63-2 may be fabricated as a unitary structure. A first hook 91 may be fixed to the rear surface of rear portion 81 of bracket 63-1, and a second hook 93 may be fixed to the rear surface of rear portion 85 of bracket 63-2. Hooks 91 and 93 may be appropriately shaped to matingly fit over the top ends of the mounts of a suitably constructed loader boom (such as, for example, mounts 21-1 and 21-2, respectively, of loader boom 17, mounts 21-1 and 21-2 being seen best in FIG. 3(*a*)) for use in mechanically coupling brackets 63-1 and 63-2 to the mounts of the loader boom. It is to be understood that, although hooks 91 and 93 are shown in the present embodiment as being separately constructed from rear portions 81 and 85, respectively, hooks 91 and 93 may be integrally formed with rear portions 81 and 85, respectively. A first pin 97 may be provided on rear portion 81 of bracket 63-1 and may project rearwardly therefrom, and a second pin 99 may be provided on rear portion 85 of bracket 63-2 and may project rearwardly therefrom. Pins 97 and 99 may be appropriately dimensioned for insertion through the pin holes in the mounts of a suitably constructed loader boom (such as, for example, pin holes 27-1 and 27-2, respectively, of loader boom 17, pin holes 27-1 and 27-2 being seen best in FIG. 3(*a*)) for use in mechanically coupling brackets 63-1 and 63-2 to the mounts of the loader boom. Pin 97 may be shaped to include a transverse through hole 101, and pin 99 may be similarly shaped to include a transverse through hole 103. Each of through holes 101 and 103 may be used to receive a cotter pin (not shown) or the like for retaining pins 97 and 99 in the mounts of the loader boom. Pins 97 and 99 may be integrally formed with rear portions 81 and 85, respectively, or, as shown in the present embodiment, pins 97 and 99 may be fabricated separately from rear portions 81 and 85, respectively, and then may be joined thereto by suitable means, such as by welding.

Each of side portions 83-1 and 83-2 of bracket 63-1 and each of side portions 87-1 and 87-2 of bracket 63-2 may be fixedly mounted on each of mounting rails 61-1 and 61-2. In this manner, when mounting assembly 53 is mounted on the loader boom of a tractor, rails 61-1 and 61-2 may be disposed generally horizontally relative to the ground, and brackets 83-1 and 83-2 may be disposed generally perpendicularly relative to the ground.

One or more voids 110 of various shapes and sizes may be provided in brackets 63-1 and 63-2 to reduce the weight thereof.

As will become apparent from the description to follow, mounting assembly 53 is preferably provided in a fully assembled state, as is shown in FIGS. 4 and 5(*a*) through 5(*f*), and is not intended to be disassembled thereafter into its component parts. Mounting assembly 53 may, however, be removably mounted on the loader boom of a tractor. The mounting of mounting assembly 53 on the loader boom of a tractor may be accomplished by matingly positioning hooks 91 and 93 over and around the respective top ends of the mounts of the loader boom (such as, for example, mounts 21-1 and 21-2 of loader boom 17, mounts 21-1 and 21-2 being seen best in FIG. 3(*a*)) and then by inserting pins 97 and 99 through the pin holes of the loader boom (such as, for example, pin holes 27-1 and 27-2 of loader boom 17, pin holes 27-1 and 27-2 being seen best in FIG. 3(*a*)). Cotter pins or the like then may be used to retain pins 97 and 99 in place in the mounts. To remove mounting assembly 53 from the loader boom, one may reverse the sequence of steps described above.

Referring back now to FIG. 4, clamping units 55-1 through 55-3 may be identical in size, shape and construction to one another. Therefore, it is to be understood that the discussion below of the construction of clamping unit 55-1 may be equally applicable to clamping units 55-2 and 55-3.

Figure 6A:
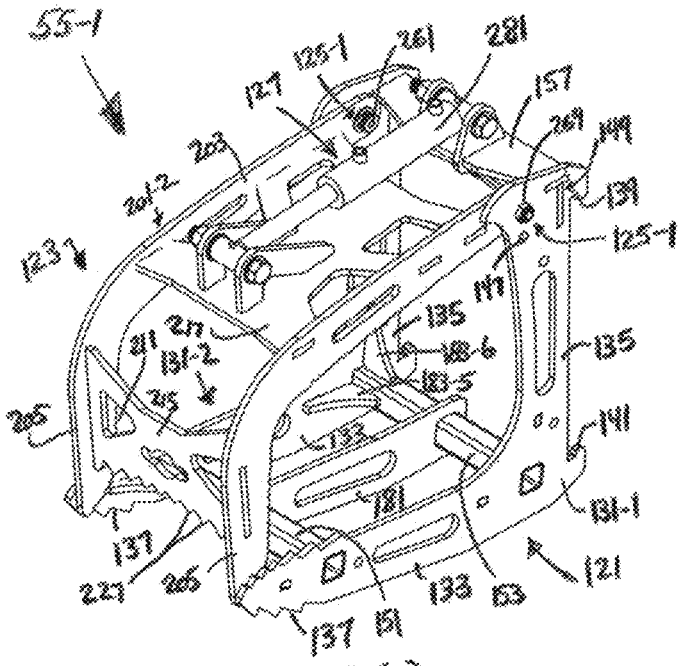
FIGS. 6(*a*) and through 6(*c*) are front perspective, right side, and partly exploded perspective views, respectively, of one of the clamping units shown in FIG. 4, the clamping unit being shown in FIGS. 6(*a*) and 6(*b*) in a closed state and with the upper and lower jaws of the clamping unit being coupled together in a first manner that results in a comparatively faster closing of the jaws with a comparatively lower clamping force.
Figure 6B:
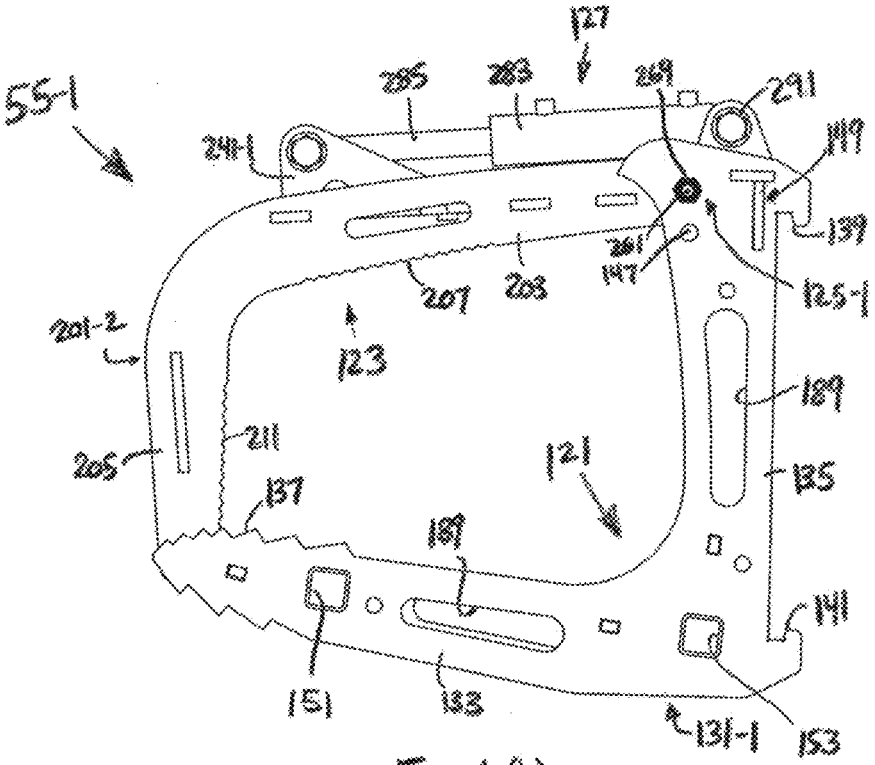
Figure 6C:
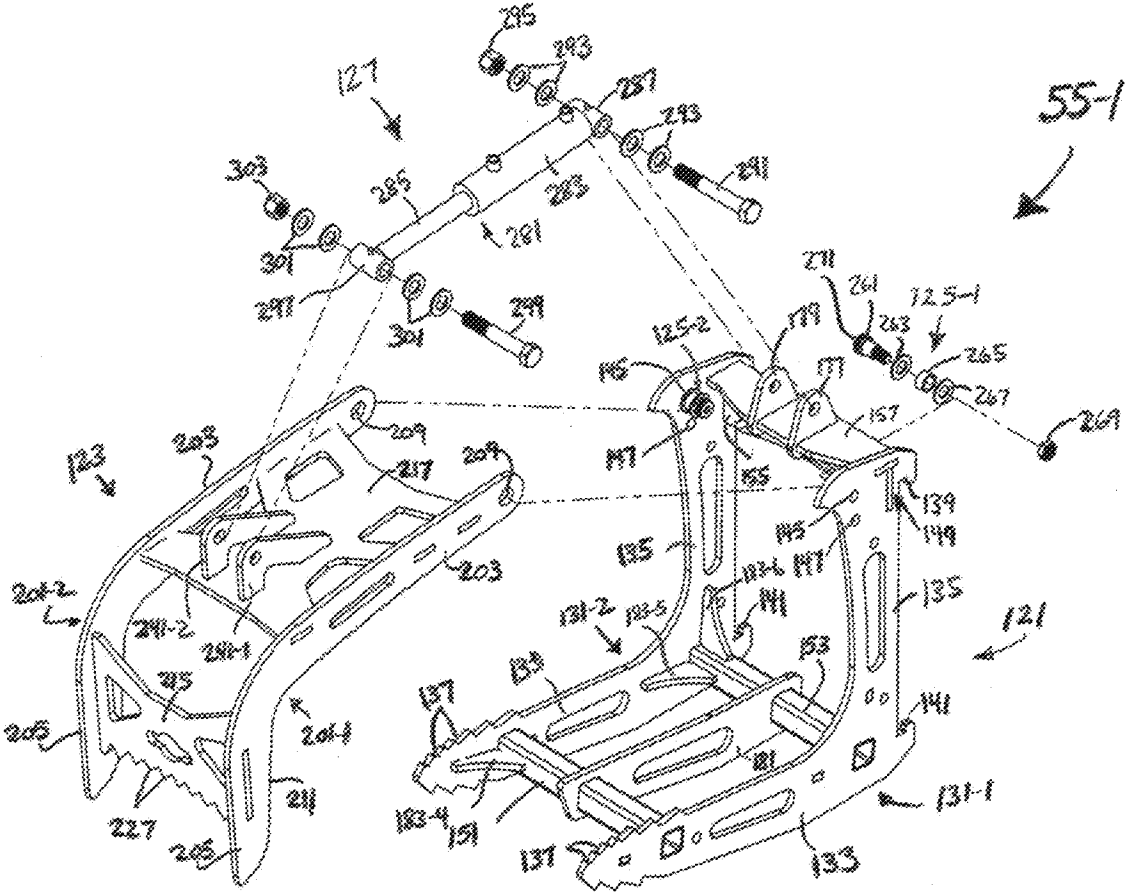
Figure 7A:
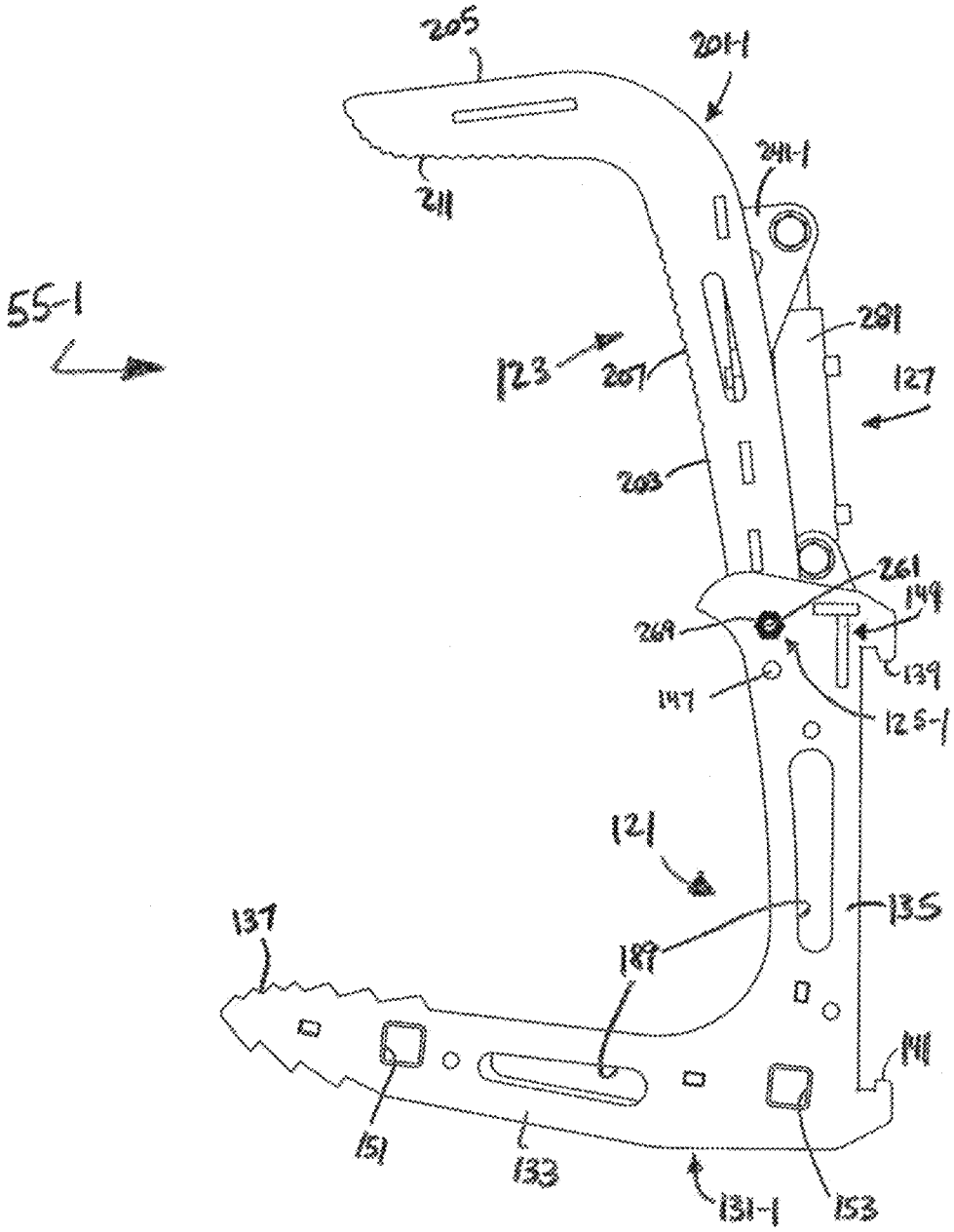
FIGS. 7(*a*) and 7(*b*) are side and rear perspective views, respectively, of the clamping unit shown in FIGS. 6(*a*) through 6(*c*), the clamping unit being shown in completely open and partially open states, respectively.
Figure 7B:
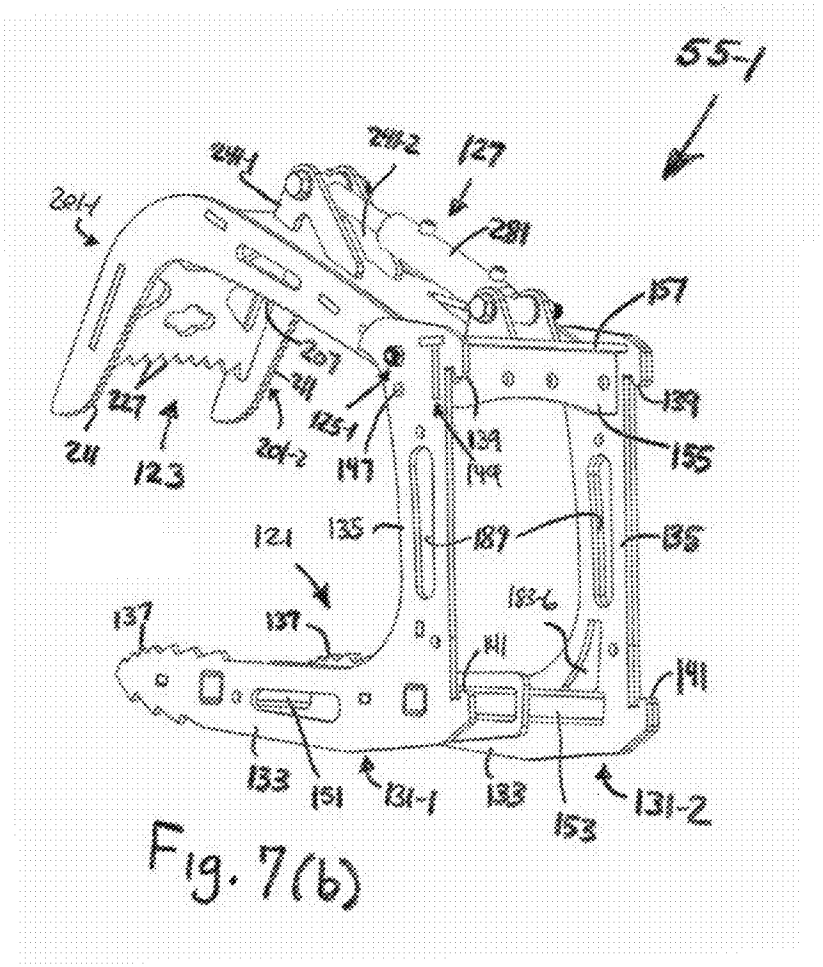

Clamping unit 55-1, which is also shown separately in FIGS. 6(*a*), 6(*b*), 6(*c*), 7(*a*) and 7(*b*), may comprise a lower jaw 121, an upper jaw 123, a pair of pivot assemblies 125-1 and 125-2, and a hydraulic cylinder assembly 127. (It should be understood that hydraulic cylinder assembly 127 could be replaced with other mechanisms for moving upper jaw 123 relative to lower jaw 121, such mechanisms including, but not being limited to, conventional mechanical, electrical, and electromechanical mechanisms, etc.)

Figure 8A:
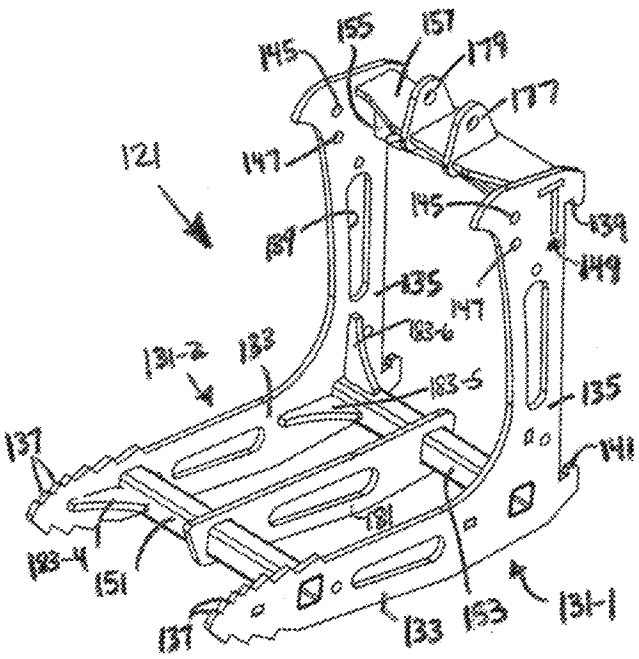
FIGS. 8(*a*) and 8(*b*) are front perspective and exploded perspective views, respectively, of the lower jaw of the clamping unit shown in FIGS. 6(*a*) through 6(*c*)
Figure 8B:
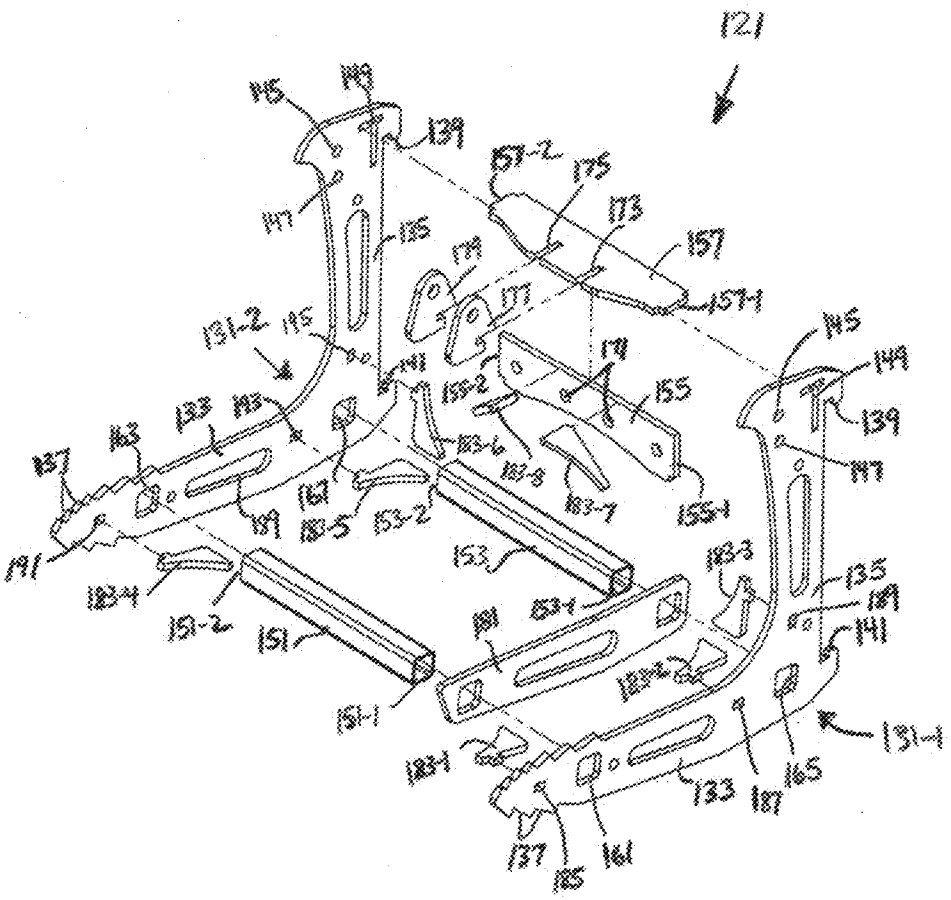

Lower jaw 121, which is also shown separately in FIGS. 8(*a*) and 8(*b*), may comprise a pair of side members 131-1 and 131-2. Side members 131-1 and 131-2, which may be substantially identical to one another, may be generally L-shaped structures, each of which may include a generally horizontal portion 133 and a generally vertical portion 135. Generally horizontal portion 133 may be shaped to include a plurality of jagged gripping elements 137 at its free end. Generally vertical portion 135 may be shaped to include along its rear an upper hook 139 and a lower hook 141. Upper hook 139 may be sized and shaped to permit its mounting around the top of front portion 67 of rail 61-1. Lower hook 141 may be sized and shaped to permit its mounting around the bottom of front portion 75 of rail 61-2. Generally vertical portion 135 may also be shaped to include an upper hole 145 and a lower hole 147. As will be discussed further below, holes 145 and 147 may be alternatively used to receive pivot assemblies 125. Generally vertical portion 135 may additionally be shaped to include a T-shaped opening 149, the purpose of which will become apparent below.

Lower jaw 121 may additionally comprise a plurality of members that may be used to join together side members 131-1 and 131-2. Such joining members may include a pair of tubes 151 and 153, a plate 155, and a plate 157. Tube 151 may have a first end 151-1 inserted into an opening 161 of side member 131-1 and fixed therewithin, for example, by welding, and a second end 151-2 inserted into an opening 163 of side member 131-2 and fixed therewithin, for example, by welding. In a similar fashion, tube 153 may have a first end 153-1 inserted into an opening 165 of side member 131-1 and fixed therewithin, for example, by welding, and a second end 153-2 inserted into an opening 167 of side member 131-2 and fixed therewithin, for example, by welding. Plate 155 may have a first end 155-1 inserted into the vertical portion of T-shaped opening 149 of side member 131-1 and fixed therewithin, for example, by welding, and a second end 155-2 inserted into the vertical portion of T-shaped opening 149 of side member 131-2 and fixed therewithin, for example, by welding. In addition, plate 155 may be shaped to include a plurality of transverse openings 171, one or more of which may be used to receive an end of a locking member 59 for use in securing clamping unit 55-1 to mounting assembly 53. Plate 157 may have a first end 157-1 inserted into the horizontal portion of T-shaped opening 149 of side member 131-1 and fixed therewithin, for example, by welding, and a second end 157-2 inserted into the horizontal portion of T-shaped opening 149 of side member 131-2 and fixed therewithin, for example, by welding. In addition, plate 157 may be shaped to include a pair of slots 173 and 175. Slot 173 may be used to receive a mounting member 177, which may be fixed to plate 157, for example, by welding, and slot 175 may be used to receive a mounting member 179, which may be fixed to plate 157, for example, by welding. Mounting members 177 and 179 may be used in mounting the fixed end of a hydraulic cylinder.

Lower jaw 121 may further comprise a plurality of support members that may be used to support and/or strengthen lower jaw 121. Such support members may include a plate 181 and a plurality of gussets 183-1 through 183-8. Plate 181 may be inserted around tubes 151 and 153 and fixed thereto, for example, by welding. Gusset 183-1 may be inserted into an opening 185 in side member 131-1 and may be fixed to side member 131-1 and to tube 151 by welding or other suitable means. Gussets 183-2 and 183-3 may be inserted into openings 187 and 189, respectively, in side member 131-1 and may be fixed to side member 131-1 and to tube 153 by welding or other suitable means. Gusset 183-4 may be inserted into an opening 191 in side member 131-2 and may be fixed to side member 131-2 and to tube 151 by welding or other suitable means. Gussets 183-5 and 183-6 may be inserted into openings 193 and 195, respectively, in side member 131-2 and may be fixed to side member 131-2 and to tube 153 by welding or other suitable means. Gusset 183-7 may be fixed to plates 155, 157, and 177 by welding or other suitable means, and gusset 183-8 may be fixed to plates 155, 157, and 179 by welding or other suitable means.

The components making up lower jaw 121 may be made of a high strength steel or other similarly suitable material. Voids 189 of various shapes and sizes may be provided in one or more of the components of lower jaw 121 to lessen the overall weight of lower jaw 121.

Figure 9A:
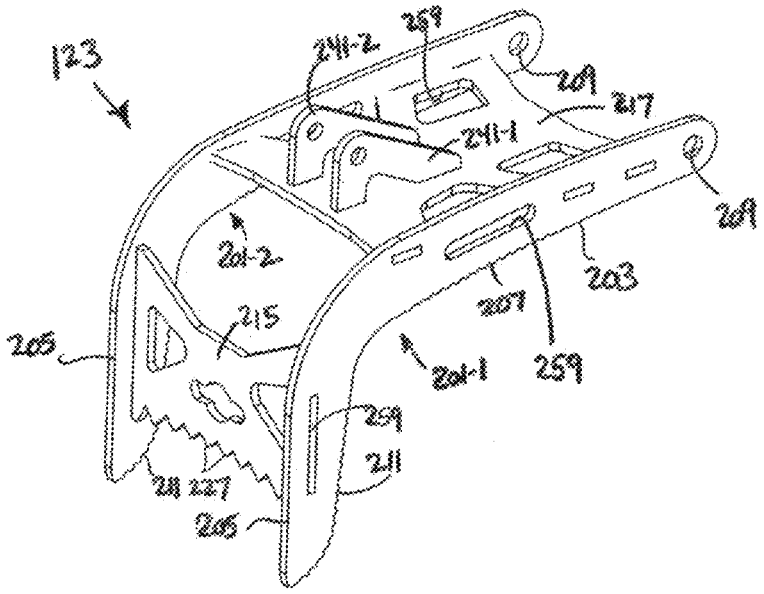
FIGS. 9(*a*) and 9(*b*) are front perspective and exploded perspective views, respectively, of the upper jaw of the clamping unit shown in FIGS. 6(*a*) through 6(*c*)
Figure 9B:
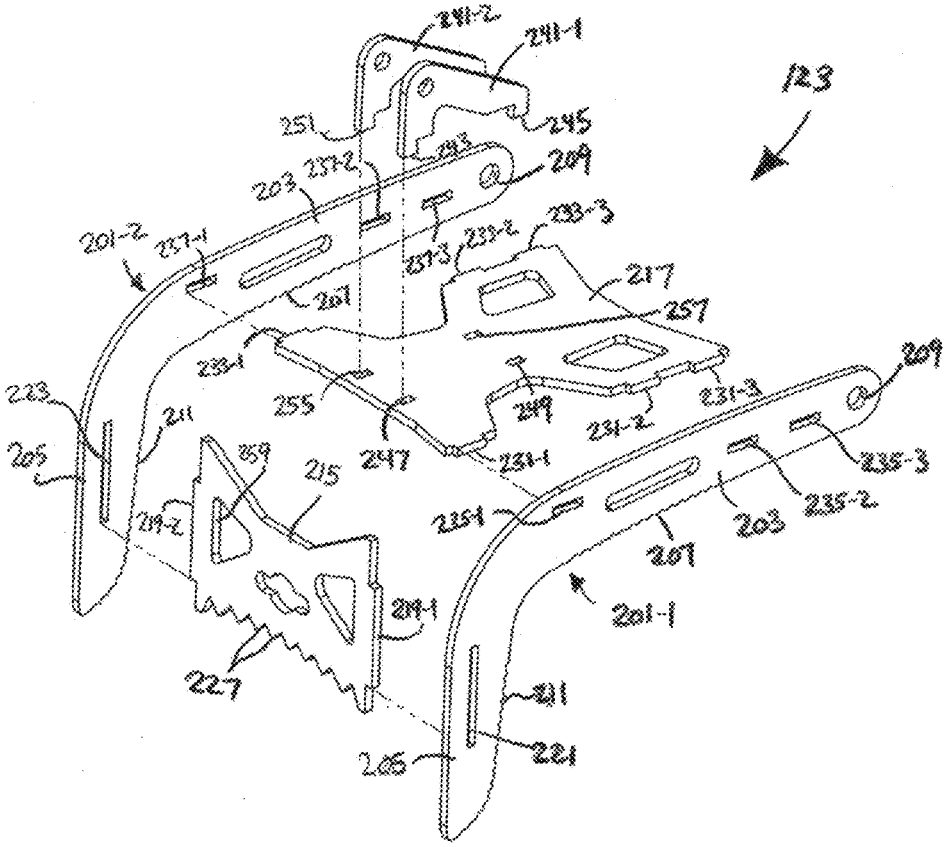

Upper jaw 123, which is also shown separately in FIGS. 9(*a*) and 9(*b*), may comprise a pair of side members 201-1 and 201-2. Side members 201-1 and 201-2, which may be substantially identical to one another, may be generally L-shaped structures, each of which may include a first portion 203 and a second portion 205. First portion 203 may be shaped to include a plurality of jagged gripping elements 207 on its bottom surface. In addition, first portion 203 may be shaped to include a hole 209, which may be used to receive pivot assemblies 125. First portion 205 may be shaped to include a plurality of jagged gripping elements 211 on its rear surface.

Upper jaw 123 may additionally comprise a plurality of members that may be used to join together side members 201-1 and 201-2. Such joining members may include a plate 215 and a plate 217. Plate 215 may have a first end 219-1 inserted into an opening 221 of side member 201-1 and fixed therewithin, for example, by welding, and a second end 219-2 inserted into an opening 223 of side member 201-2 and fixed therewithin, for example, by welding. The bottom surface of plate 215 may be shaped to include a plurality of jagged gripping elements 227. Plate 217 may be shaped to include a plurality of tabs 231-1 through 231-3 provided along one side thereof and a plurality of tabs 233-1 through 233-3 provided along an opposite side thereof. Tabs 231-1 through 231-3 may be inserted into openings 235-1 through 235-3, respectively, of first portion 203 of side member 201-1 and may be fixed thereto by welding or other suitable means, and tabs 233-1 through 233-3 may be inserted into openings 237-1 through 237-3, respectively, of first portion 203 of side member 201-2 and may be fixed thereto by welding or other suitable means.

Upper jaw 123 may further comprise a pair of mounting members 241-1 and 241-2, which may be used in the mounting of the movable end of a hydraulic cylinder. Mounting member 241-1 may be shaped to include a first tab 243 and a second tab 245. First tab 243 and second tab 245 may be inserted into openings 247 and 249, respectively, of plate 217 and may be fixed thereto by welding or other suitable means. Mounting member 241-2 may be shaped to include a first tab 251 and a second tab (not shown). First tab 251 and the second tab of mounting member 241-2 may be inserted into openings 255 and 257, respectively, of plate 217 and may be fixed thereto by welding or other suitable means.

The components making up upper jaw 123 may be made of a high strength steel or other similarly suitable material. Voids 259 of various shapes and sizes may be provided in one or more of the components of upper jaw 123 to lessen the overall weight of upper jaw 123. For reasons to become apparent below, upper jaw 123 may be dimensioned relative to lower jaw 121 so that holes 209 of upper jaw 123 may be positioned just interior to holes 145 or 147 of lower jaw 121.

Pivot assemblies 125-1 and 125-2 (seen best in FIG. 6(*c*)), which may be used to pivotally mount upper jaw 123 on lower jaw 121, may be identical to one another, and each may include a threaded bolt 261, a first washer 263, a sleeve 265, a second washer 267, and a nut 269. Bolt 261 may be appropriately dimensioned to pass through either hole 145 or hole 147 of lower jaw 121 and through hole 209 of upper jaw 123, with the head 271 of bolt 261 being positioned on the interior side of upper jaw 123. First washer 263 may also be positioned on the interior side of upper jaw 123. Sleeve 265 may be positioned within hole 209 of upper jaw 123, second washer 267 may be positioned between upper jaw 123 and lower jaw 121, and nut 269 may be positioned on the exterior side of lower jaw 121.

Figure 10B:
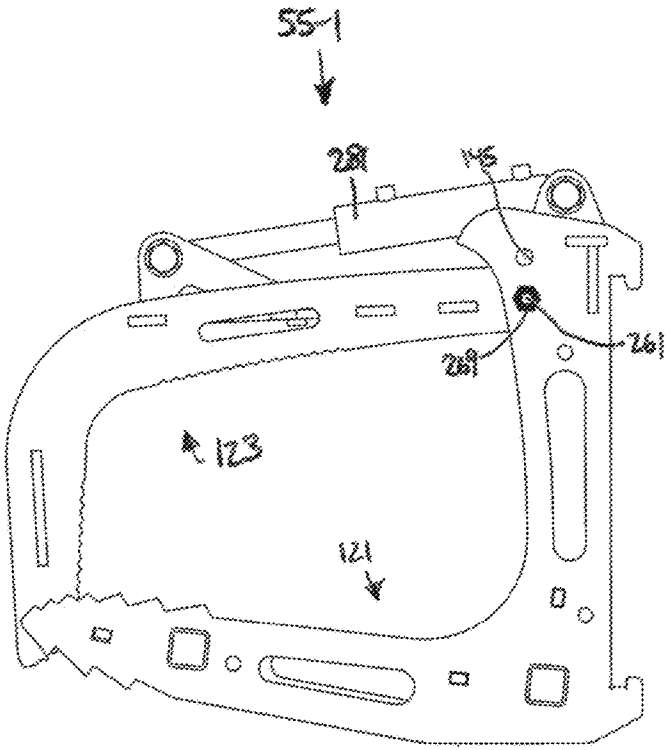
FIGS. 10(*a*) and 10(*b*) are right side views, showing the clamping unit of FIGS. 6(*a*) through 6(*c*) after it has been configured so that the upper and lower jaws of the clamping unit are coupled together at an alternative pivot point to cause a comparatively slower closing of the jaws with a comparatively higher clamping force than that of FIGS. 6(*a*) through 6(*c*), the clamping unit shown in an open state in FIG. 10(*a*) and in a closed state in FIG. 10(*b*)
Figure 10A:
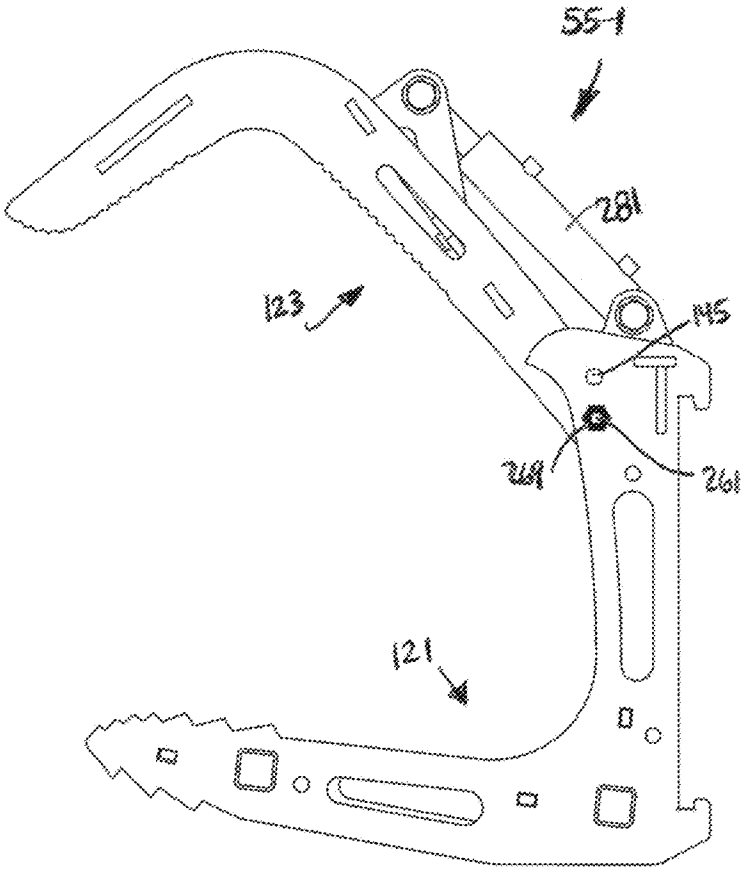
Figure 10:
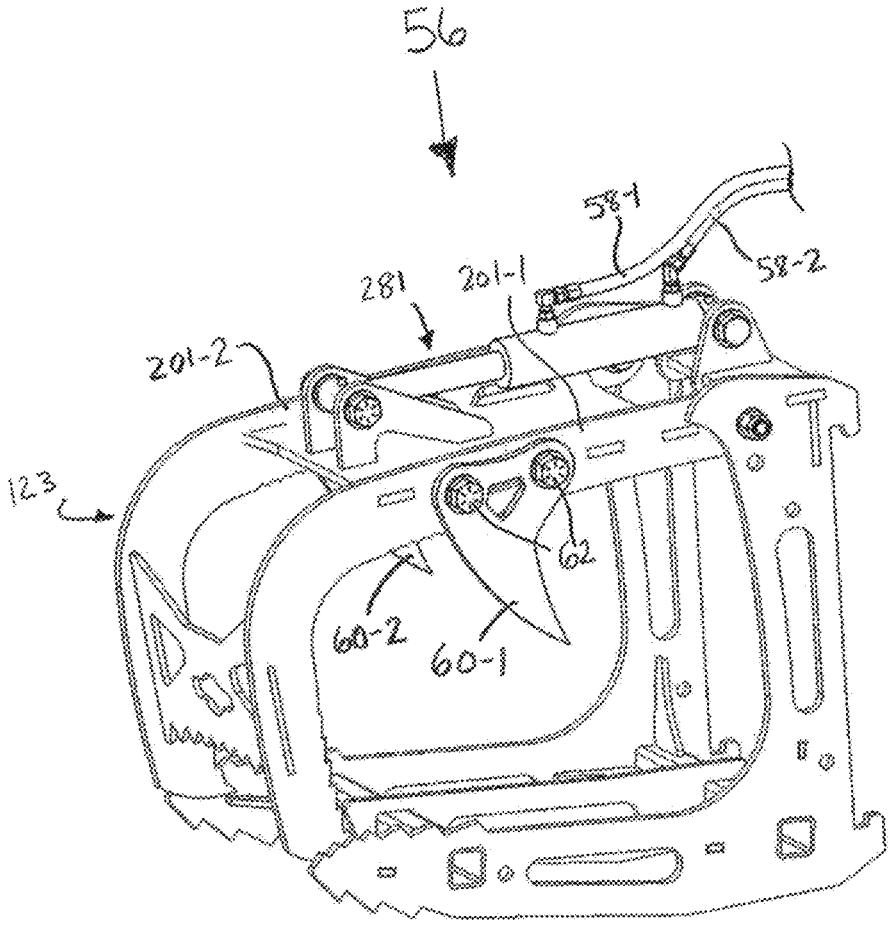
Figure 10D:
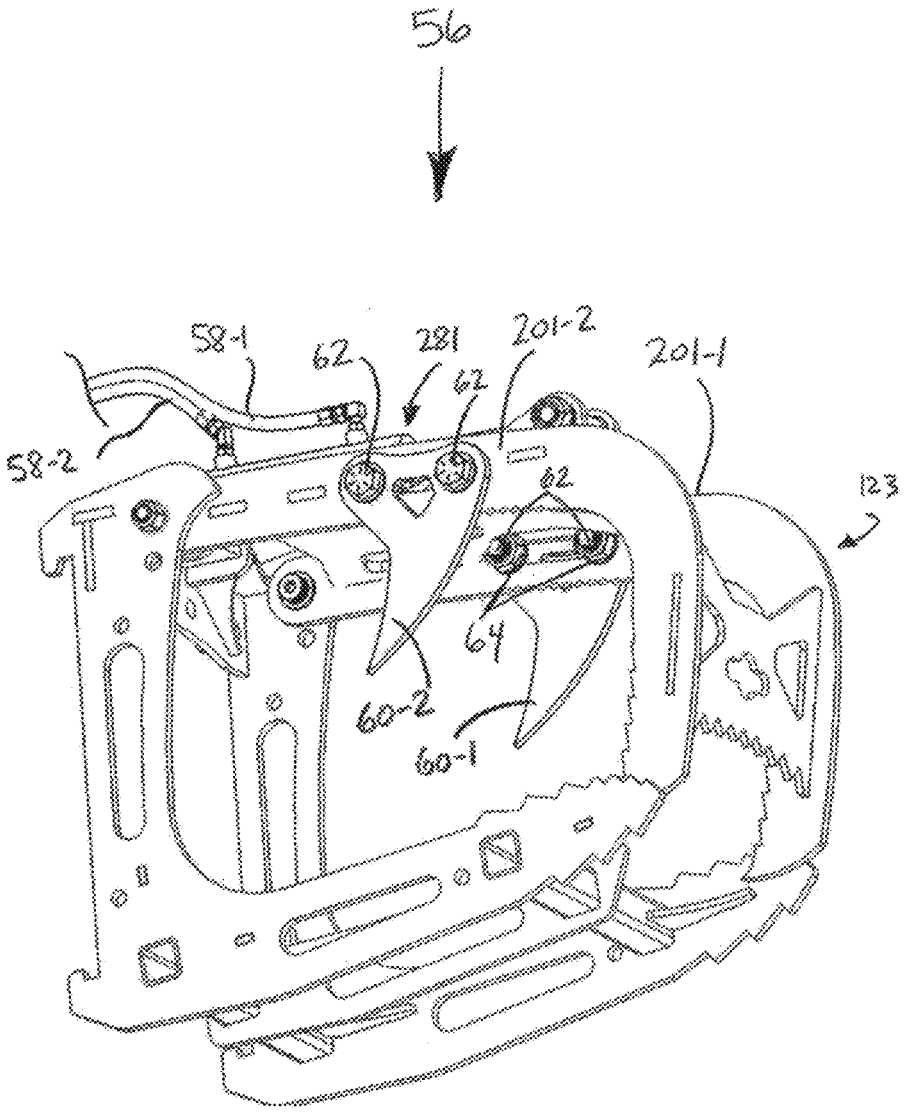

By inserting bolts 261 of pivot assemblies 125-1 and 125-2 through either upper hole 145 of lower jaw 121 (see, for example, FIGS. 6(*b*) and 7(*a*)) or through lower hole 147 of lower jaw 121 (see, for example, FIGS. 10(*a*) and 10(*b*)), one can adjust the speed with which upper jaw 123 closes on lower jaw 121 and the clamping force between jaws 121 and 123. More specifically, when bolt 261 is inserted through upper hole 145, the closing speed of upper jaw 123 is faster than the closing speed of upper jaw 123 when bolt 261 is inserted through lower hole 147. On the other hand, when bolt 261 is inserted through lower hole 147, the clamping force between jaws 121 and 123 is greater than the clamping force that is produced when bolt 261 is inserted through upper hole 145. For example, when the spacing between the respective centers of upper hole 145 and hole 209 is approximately 2.69 inches, when the spacing between the respective centers of lower hole 147 and hole 209 is approximately 4.30 inches, and when using a hydraulic cylinder with a 4240 lb cylinder force at 2400 psi, the increase in clamping force using lower hole 147, instead of upper hole 145, may be greater by, for example, approximately 114% when upper jaw 123 is at its most open position, may be greater by, for example, approximately 45% when upper jaw 123 is at its midpoint, and may be greater by, for example, approximately 72% when upper jaw 123 is in its closed position.

As seen best in FIG. 6(*c*), hydraulic cylinder assembly 127 may comprise a hydraulic cylinder 281 and hardware for mounting hydraulic cylinder 281 to jaws 121 and 123. Hydraulic cylinder 281, the operation of which may be controlled by conventional means (not shown), may comprise a fixed portion 283 and a movable portion 285. Fixed portion 283 may include a tubular member 287. Tubular member 287 may be appropriately dimensioned to be coupled to mounting members 177 and 179 of lower jaw 121 using hardware that may include a threaded bolt 291, a plurality of washers 293, and a nut 295. Movable portion 285 of hydraulic cylinder 281 may include a tubular member 297. Tubular member 297 may be appropriately dimensioned to be coupled to mounting members 241-1 and 241-2 of upper jaw 123 using hardware that may include a threaded bolt 299, a plurality of washers 301, and a nut 303.

Referring now to FIGS. 10(*c*) and 10(*d*), there are shown fragmentary right perspective and fragmentary left perspective views, respectively, of an alternative type of clamping unit to the type of clamping unit shown in FIGS. 6(*a*) through 6(*c*), the alternative type of clamping unit being represented generally by reference numeral 56. (Clamping unit 56 is shown in the present embodiment equipped with hydraulic hoses 58-1 and 58-2 used in the operation of hydraulic cylinder 281.)

Clamping unit 56 may be similar in most respects to clamping units 55-1 through 55-3, the principal difference between the two types of clamping units being that clamping unit 56 may further comprise a pair of fangs 60-1 and 60-2, which may be provided to endow clamping unit 56 with an enhanced gripping power. Fang 60-1 may be securely mounted to side member 201-1 of upper jaw 123, and fang 60-2 may be securely mounted to side member 201-2 of upper jaw 123. Fangs 60-1 and 60-2 may be secured to upper jaw 123 using suitable hardware. For example, in the present embodiment, a washer (not shown) may be inserted over each of a pair of bolts 62, and bolts 62 may then be inserted through openings in fang 60-1 and then through an opening in side member 201-1. An additional washer (not shown) may then be inserted over each of bolts 62 from the inside of side member 201-1, and a nut 64 may then be secured to each of bolts 62. Fang 60-2 may be secured to side member 201-2 in a corresponding manner. If desired, fangs 60-1 and 60-2 may be removably mounted on upper jaw 123 to permit their attachment and removal when desired. In another embodiment (not shown), fangs 60-1 and 60-2 may be replaced with a single fang that is centrally disposed on upper jaw 123.

As can be appreciated, any one or more of clamping units 55-1 through 55-3 may be replaced with a corresponding number of clamping units 56. Alternatively, clamping units 55-1 through 55-3 may be reversibly converted to clamping unit 56 and vice versa by the attachment and removal of fangs 60-1 and 60-2.

Referring back now to FIG. 4, support units 57-1 and 57-2 may be identical in size, shape and construction to one another. Therefore, it is to be understood that the discussion below of the construction of support unit 57-1 may be equally applicable to support unit 57-2.

Figure 11:
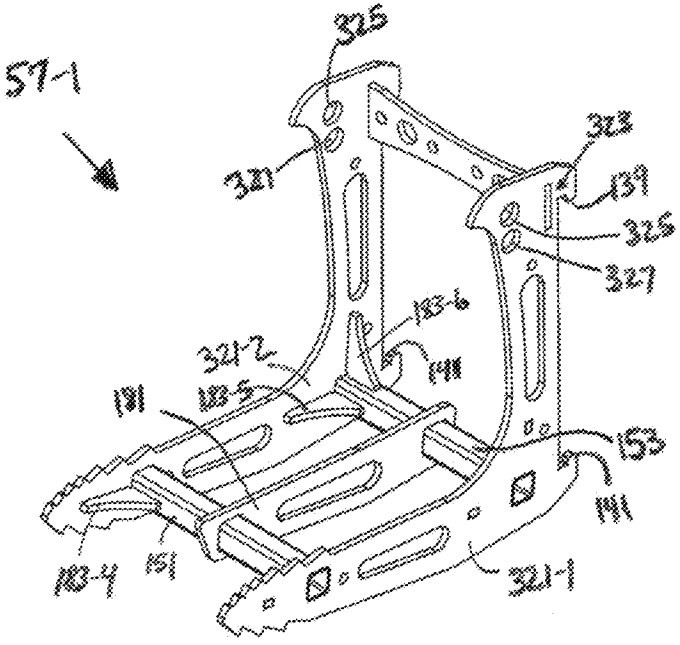
FIGS. 11(*a*) and 11(*b*) are front perspective and exploded perspective views, respectively, of one of the support units shown in FIG. 4.
Figure 11B:
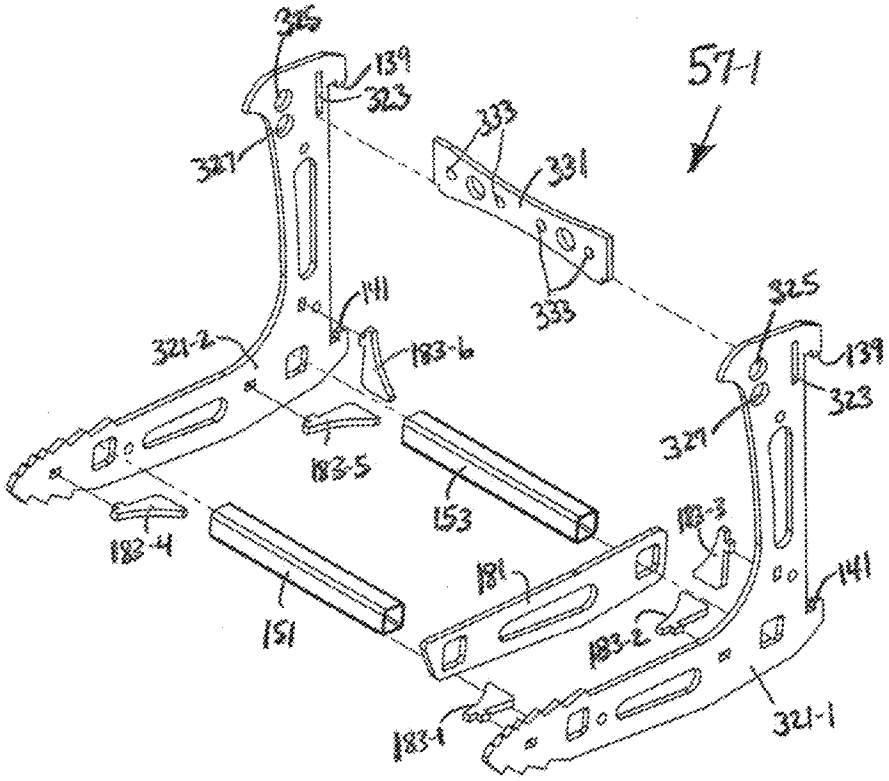
Figure 12B:
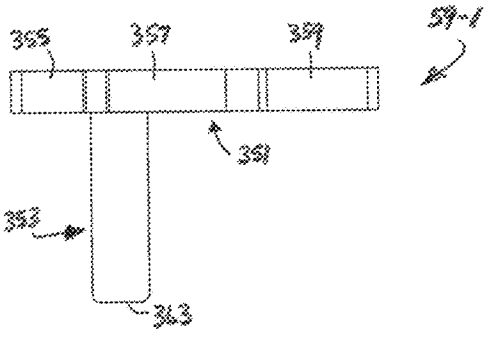
FIGS. 12(*a*) through 12(*d*) are perspective, side, top, and exploded perspective views, respectively, of one of the locking members shown in FIG. 4.
Figure 12D:
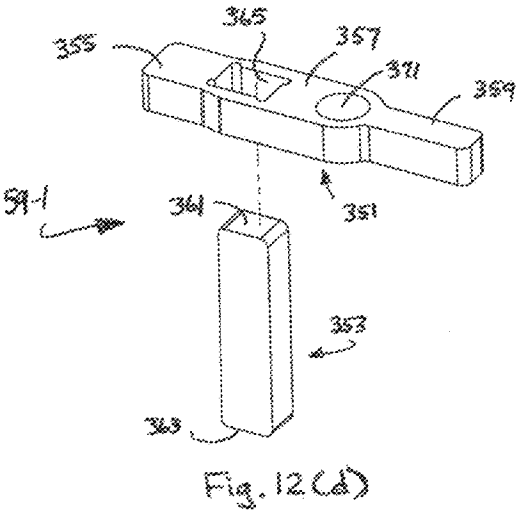
Figure 12A:
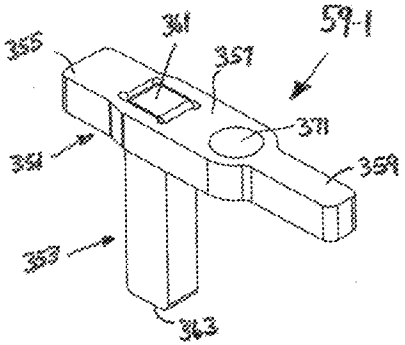
Figure 12C:
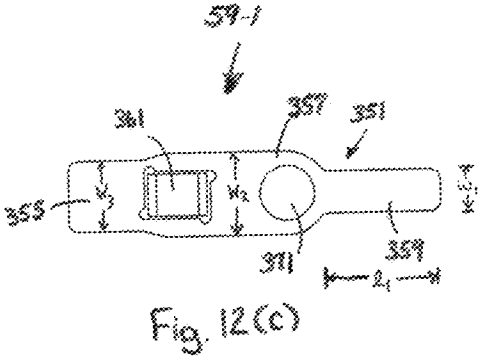
Figure 13A:
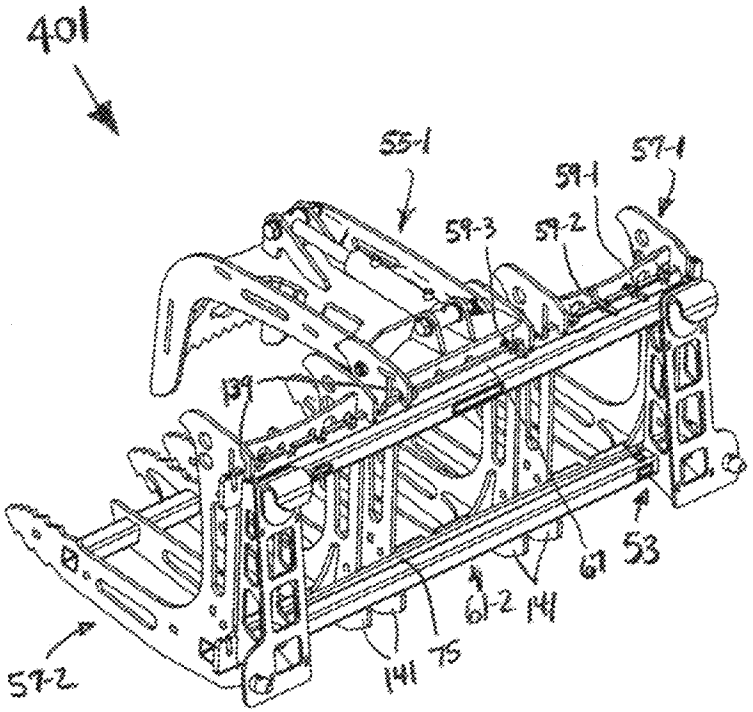
FIGS. 13(*a*) through 13(*d*) are rear perspective, enlarged fragmentary rear perspective, enlarged fragmentary top, and enlarged fragmentary rear views, respectively, of one example of a tractor attachment that may be assembled using the kit of FIG. 4.
Figure 13B:
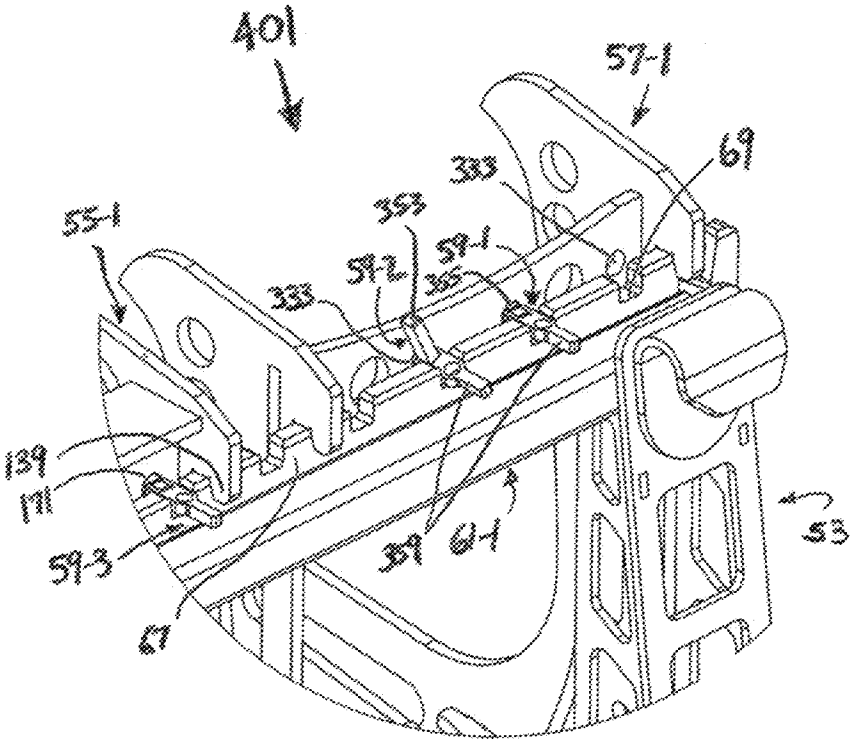
Figure 13C:
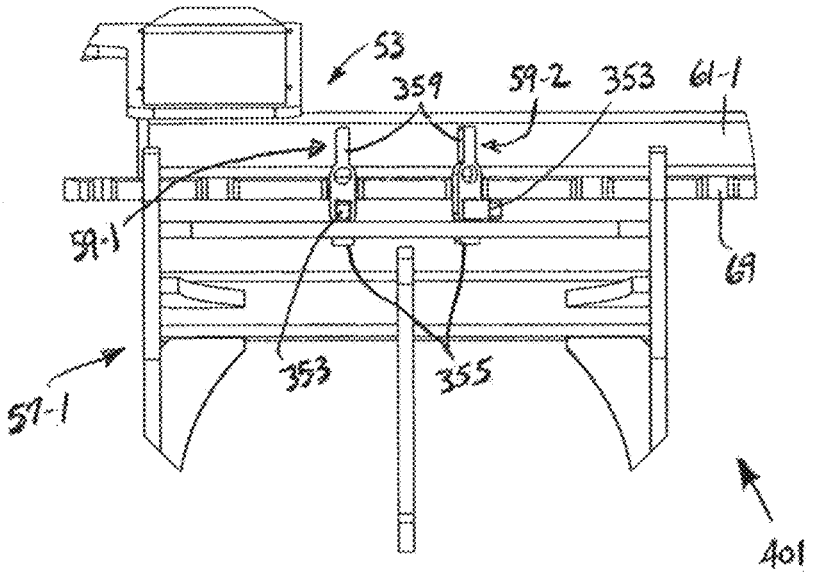
Figure 13D:
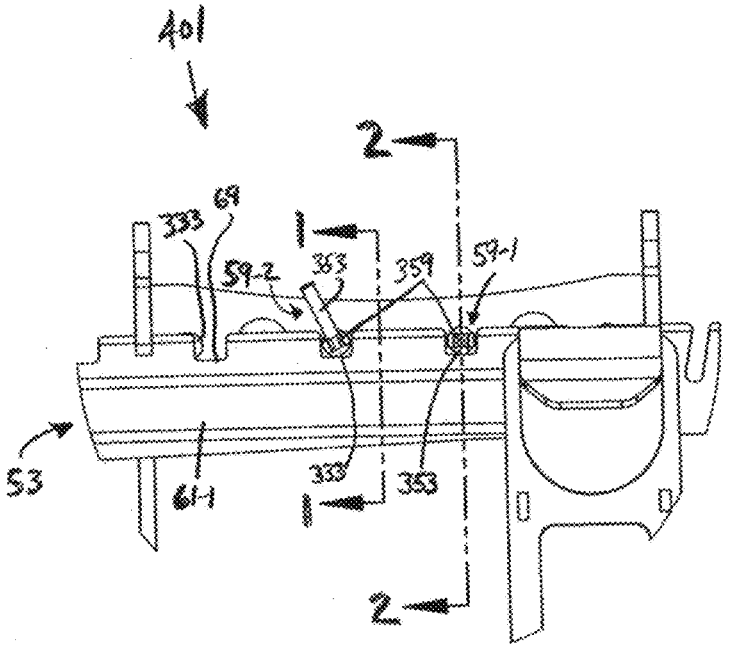
Figure 13F:
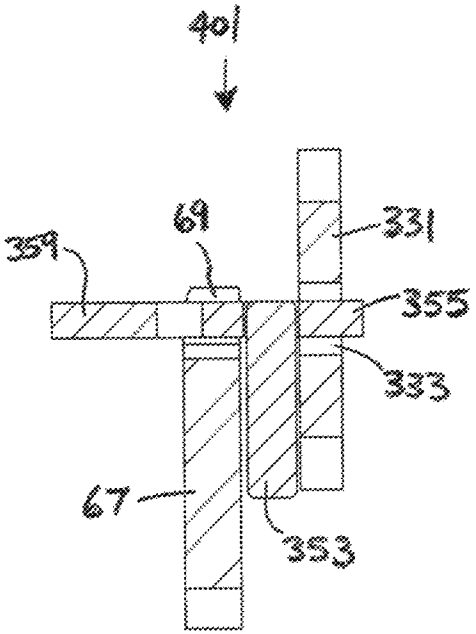
Figure 13E:
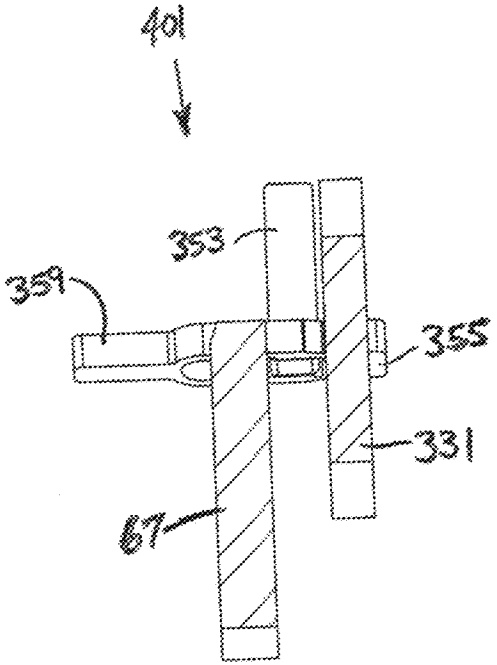
Figure 14A:
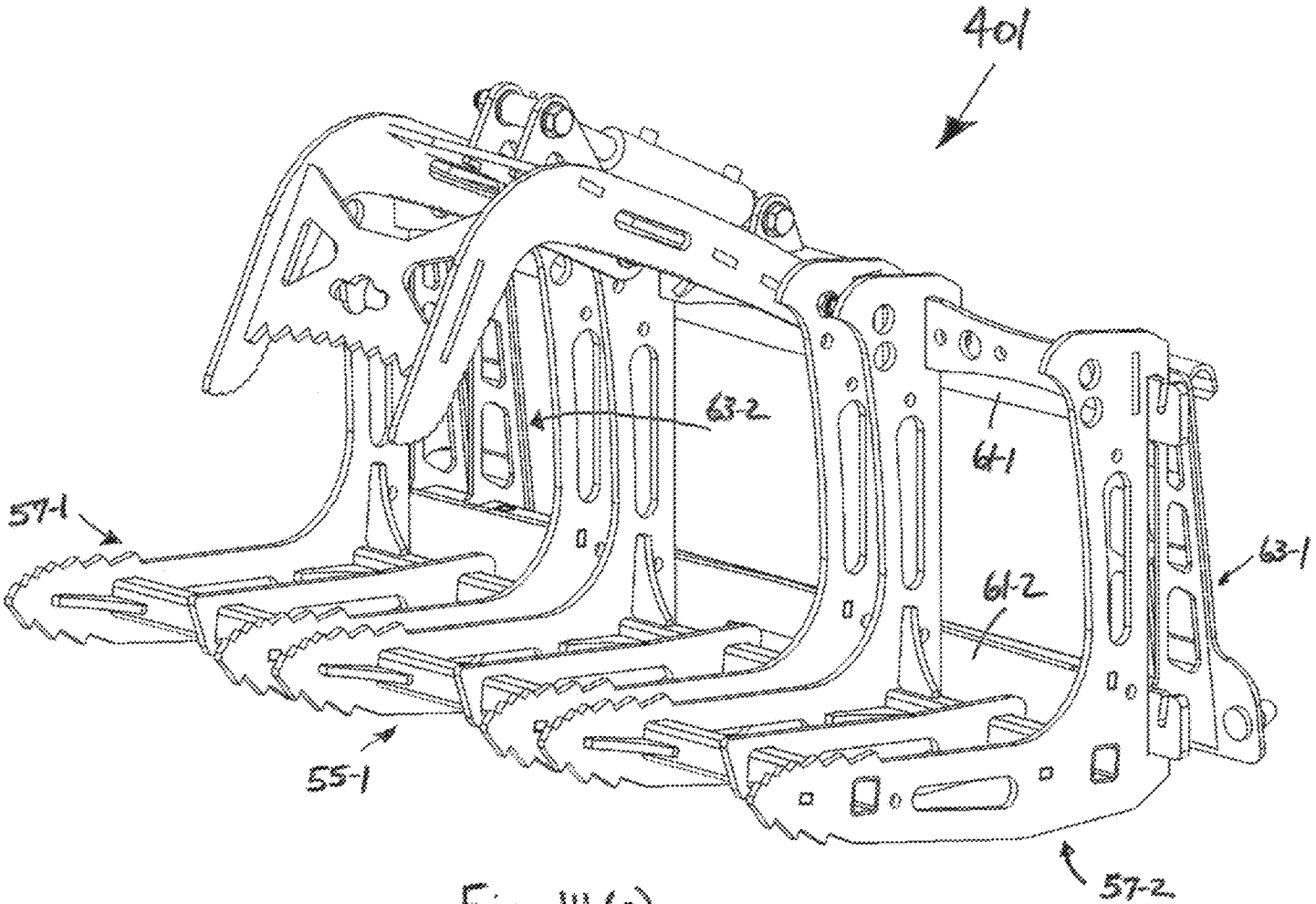
FIGS. 14(*a*) through 14(*e*) are front perspective, rear perspective, right side, partly exploded right side, and front views, respectively, of the tractor attachment of FIGS. 13(*a*) through 13(*f*), with the locking members of the tractor attachment not being shown for the sake of simplicity.
Figure 14D:
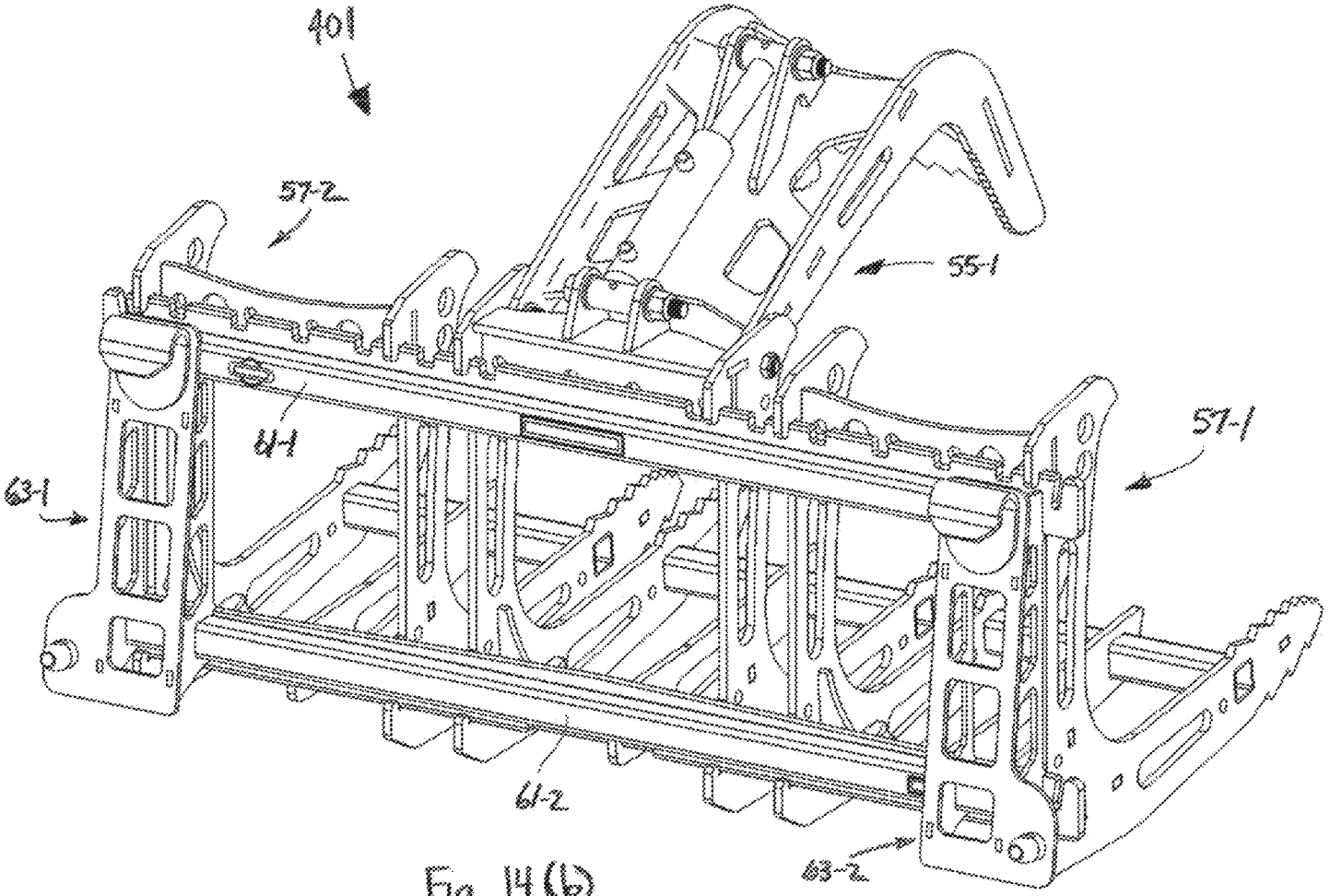
Figure 14A:
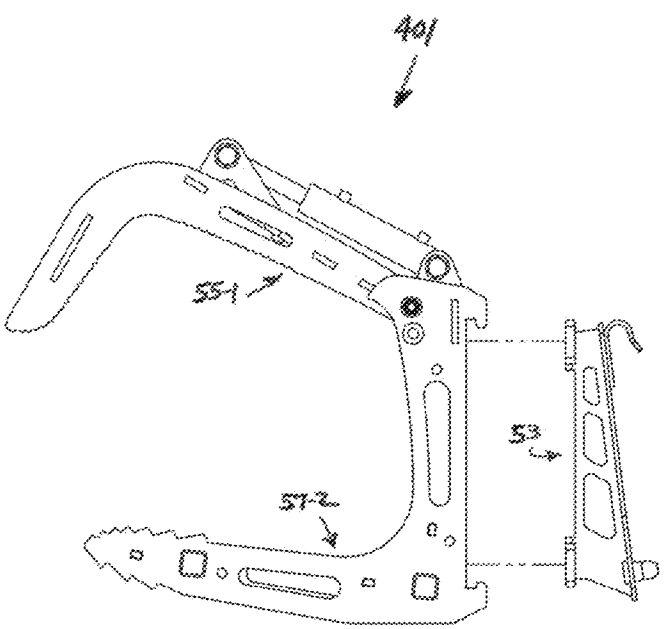
Figure 14C:
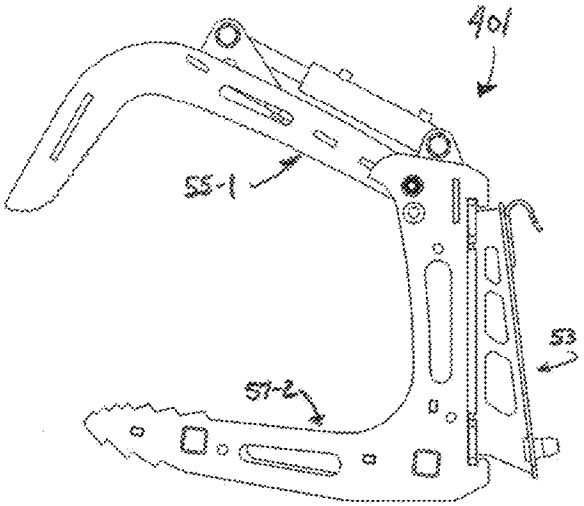
Figure 14E:
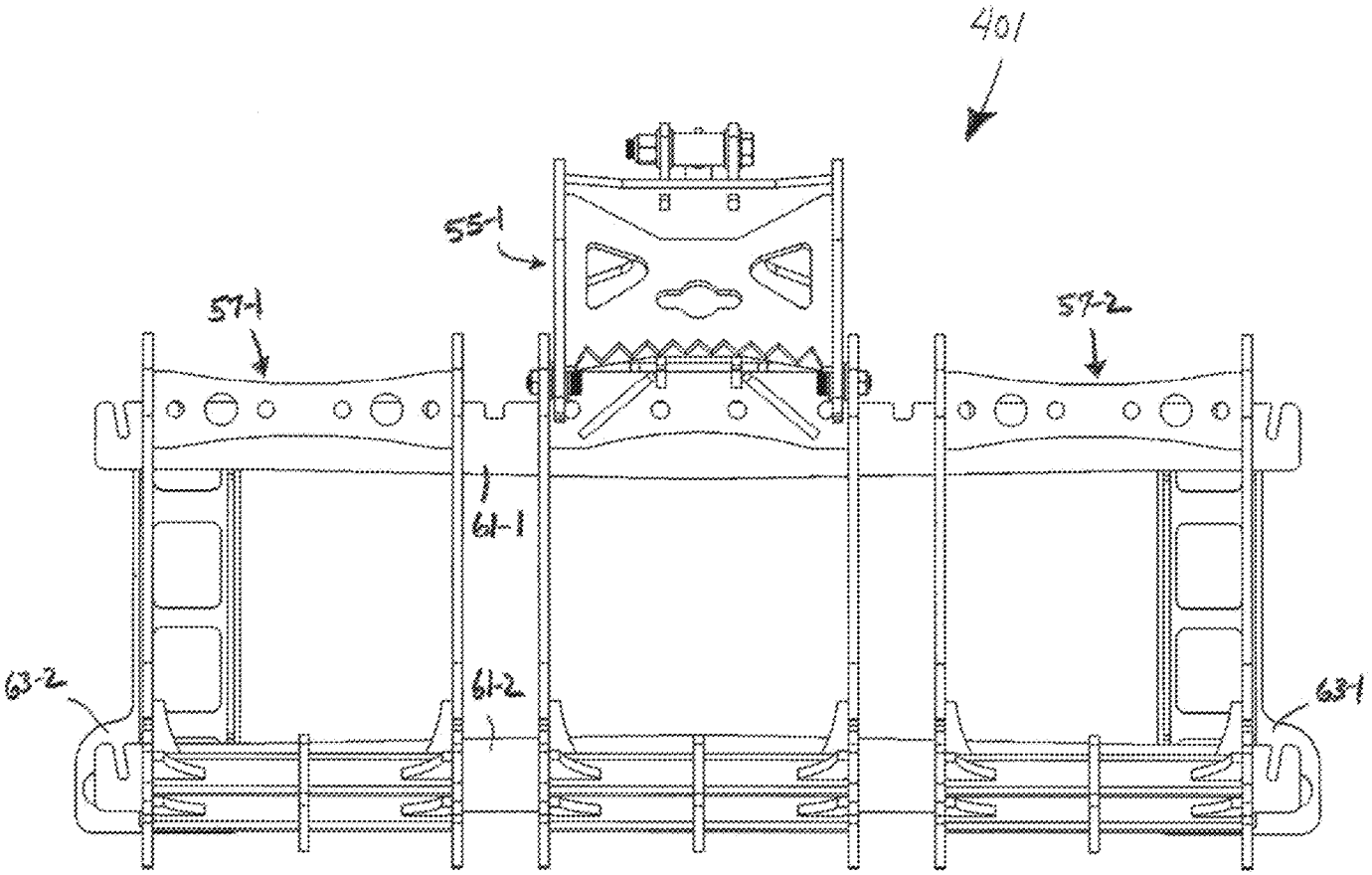
Figure 15A:
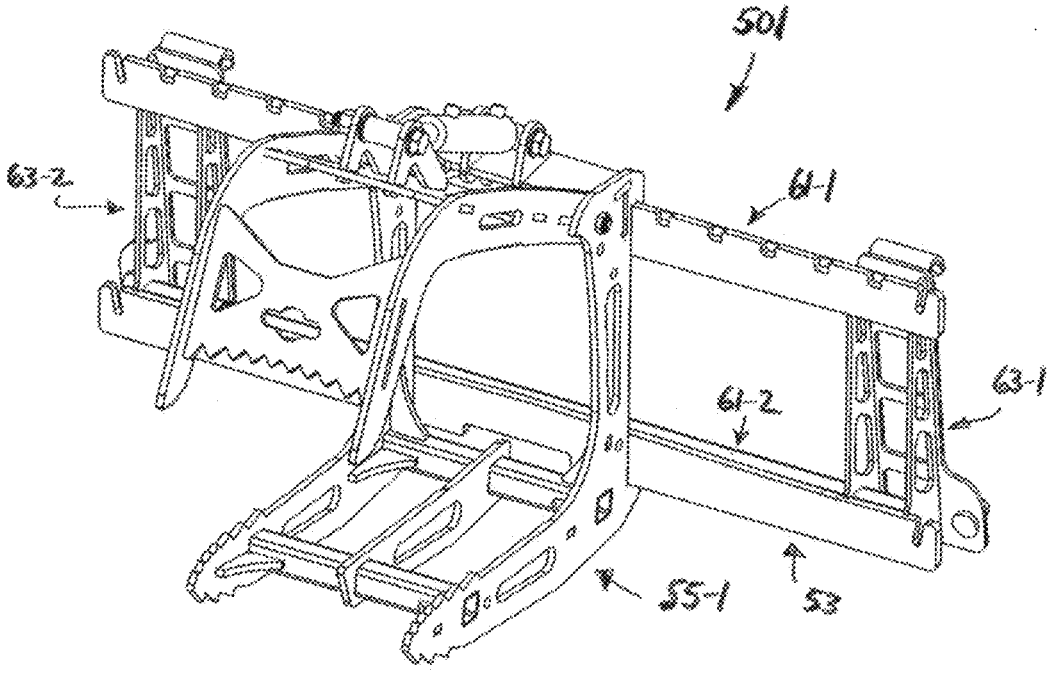
FIGS. 15(*a*) through 15(*d*) are front perspective, rear perspective, front, and top views, respectively, of a second example of a tractor attachment that may be assembled using the kit of FIG. 4, with the locking members of the tractor attachment not being shown for the sake of simplicity.
Figure 15B:
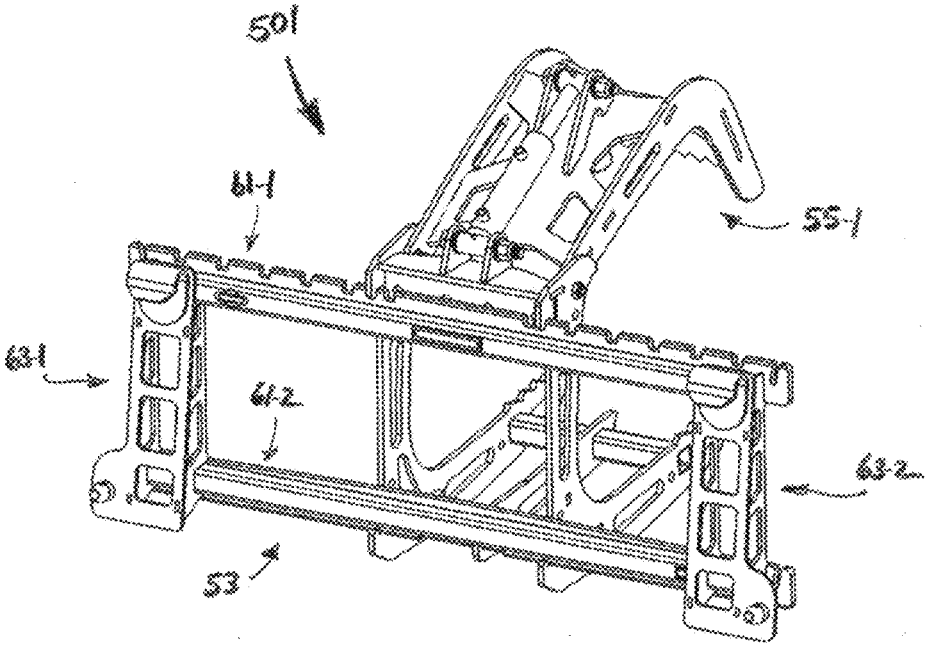
Figure 15C:
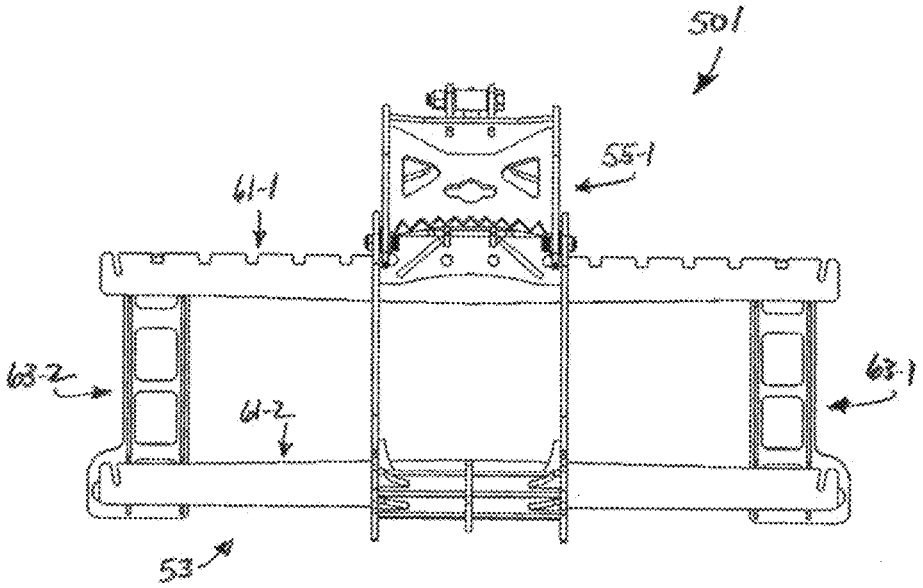
Figure 15D:
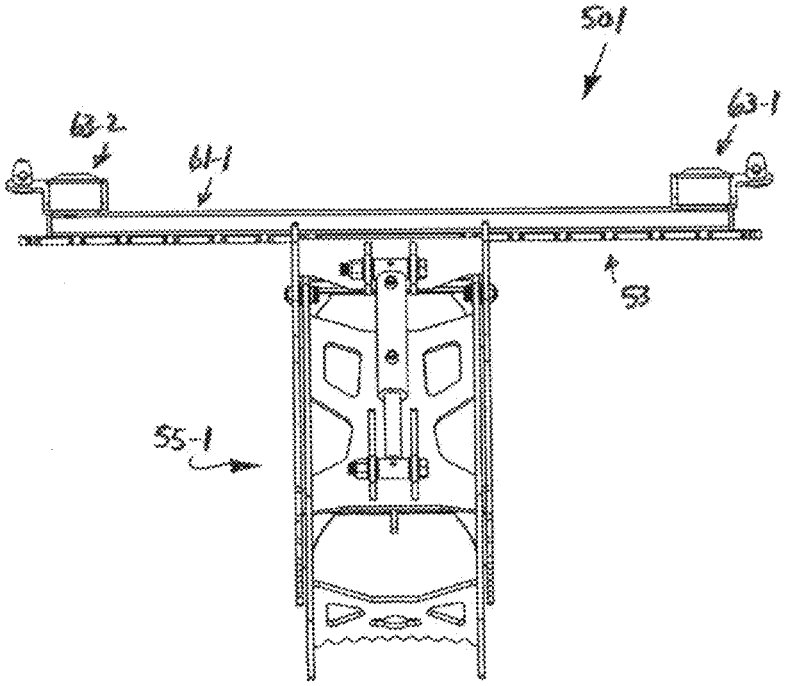
Figure 16A:
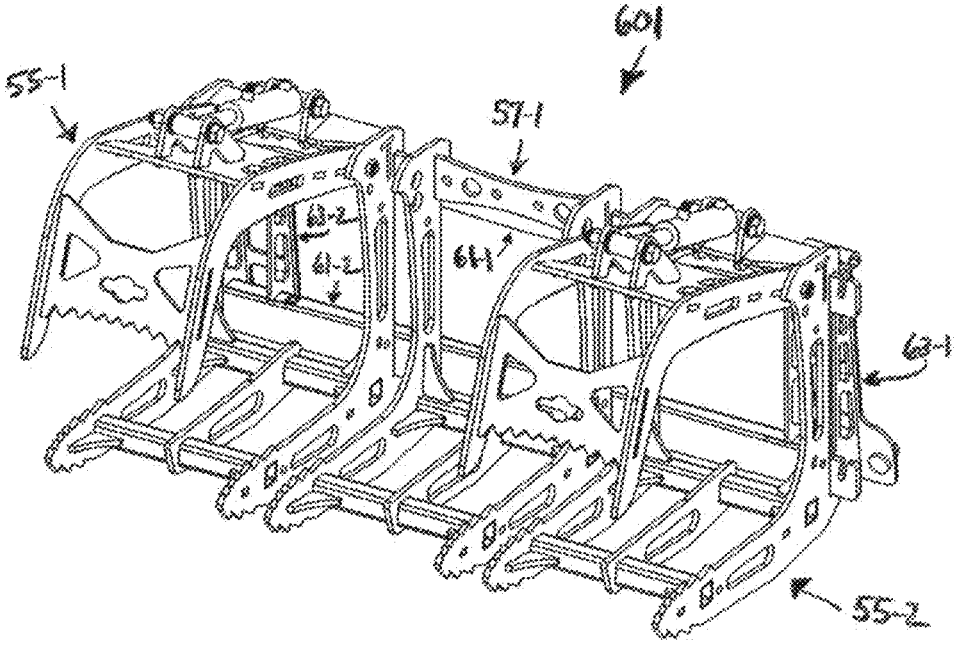
FIGS. 16(*a*) through 16(*d*) are front perspective, rear perspective, front, and top views, respectively, of a third example of a tractor attachment that may be assembled using the kit of FIG. 4, with the locking members of the tractor attachment not being shown for the sake of simplicity.
Figure 16B:
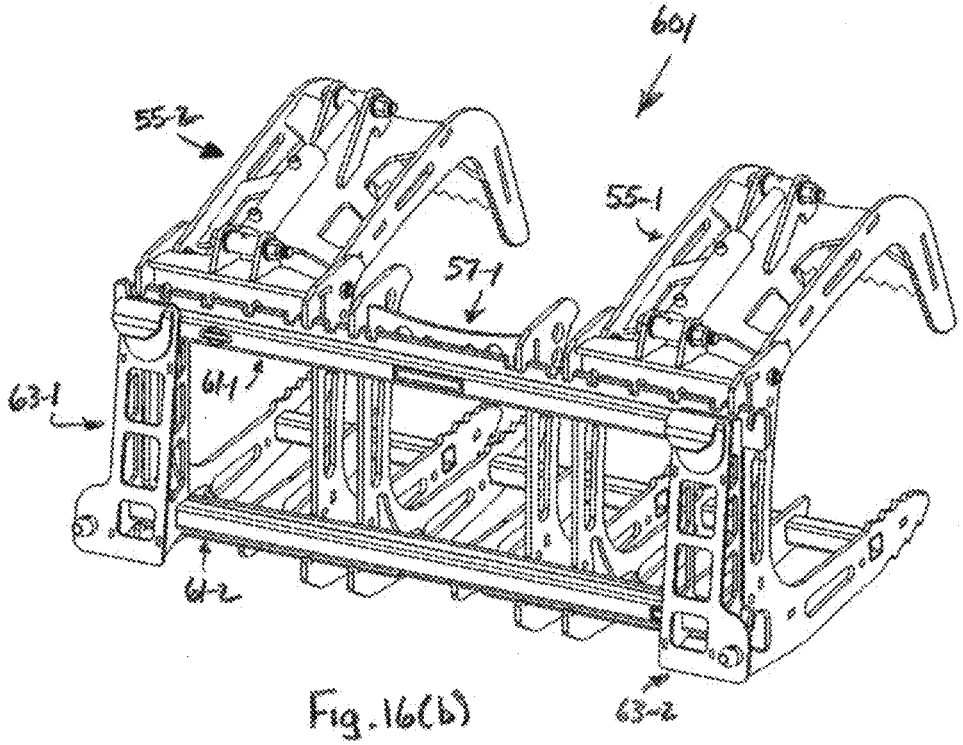
Figure 16C:
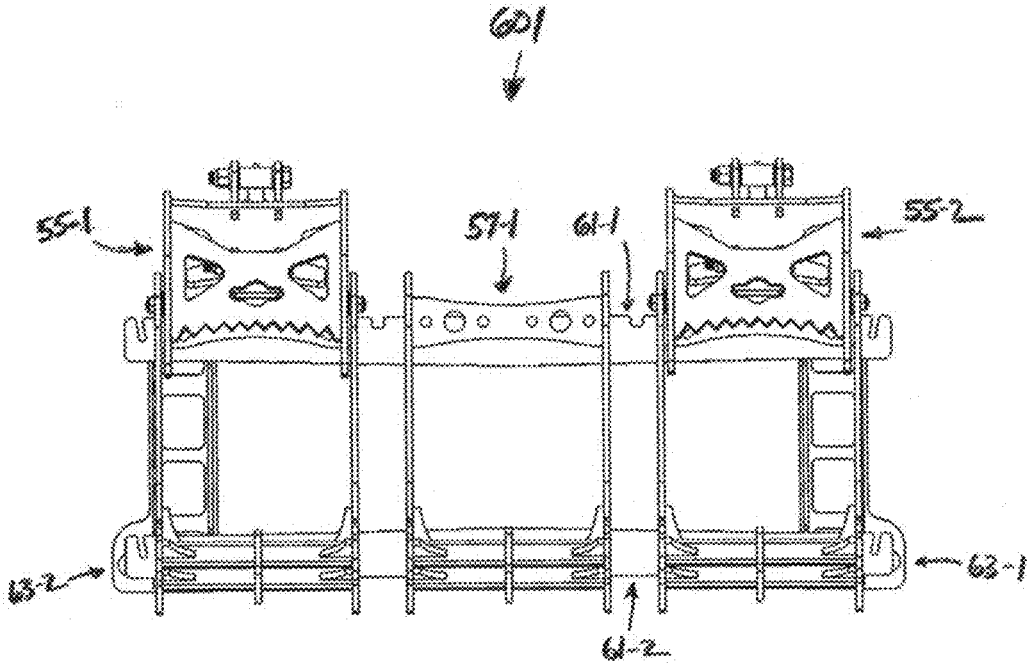
Figure 16D:
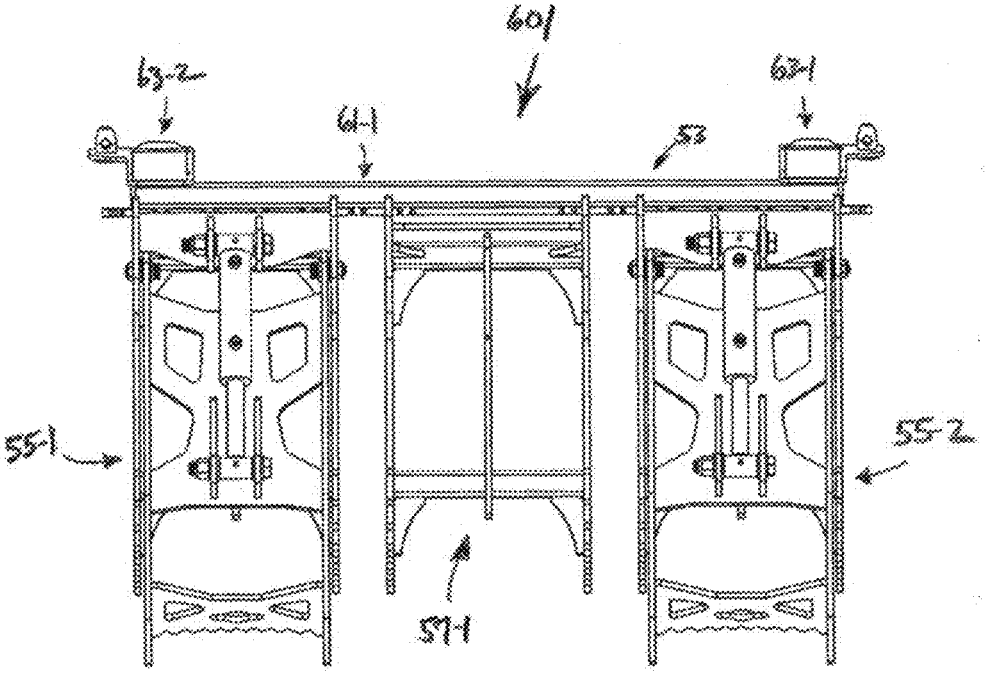
Figure 17A:
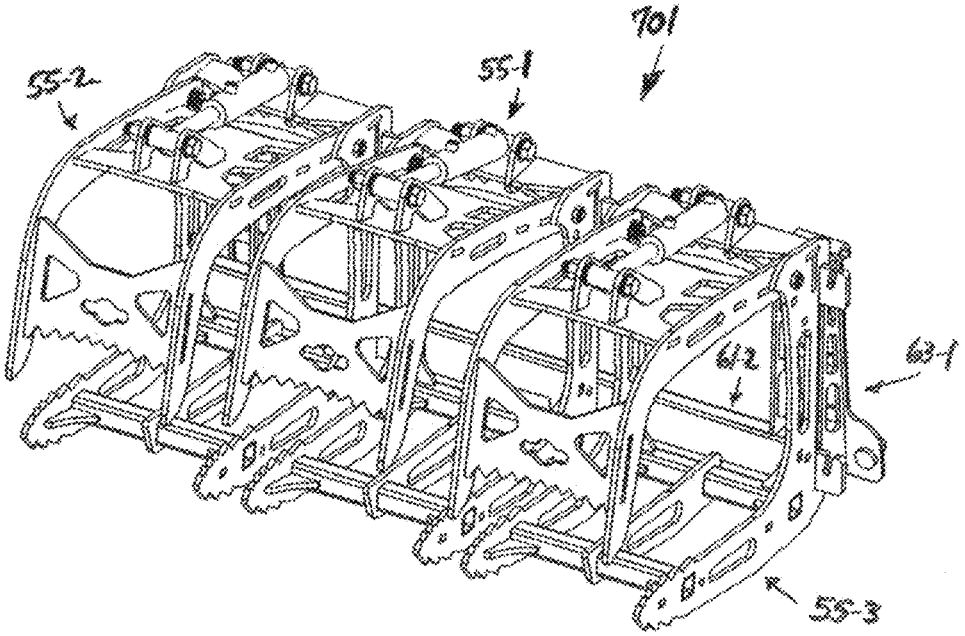
FIGS. 17(*a*) through 17(*d*) are front perspective, rear perspective, front, and top views, respectively, of a fourth example of a tractor attachment that may be assembled using the kit of FIG. 4, with the locking members of the tractor attachment not being shown for the sake of simplicity.
Figure 17B:
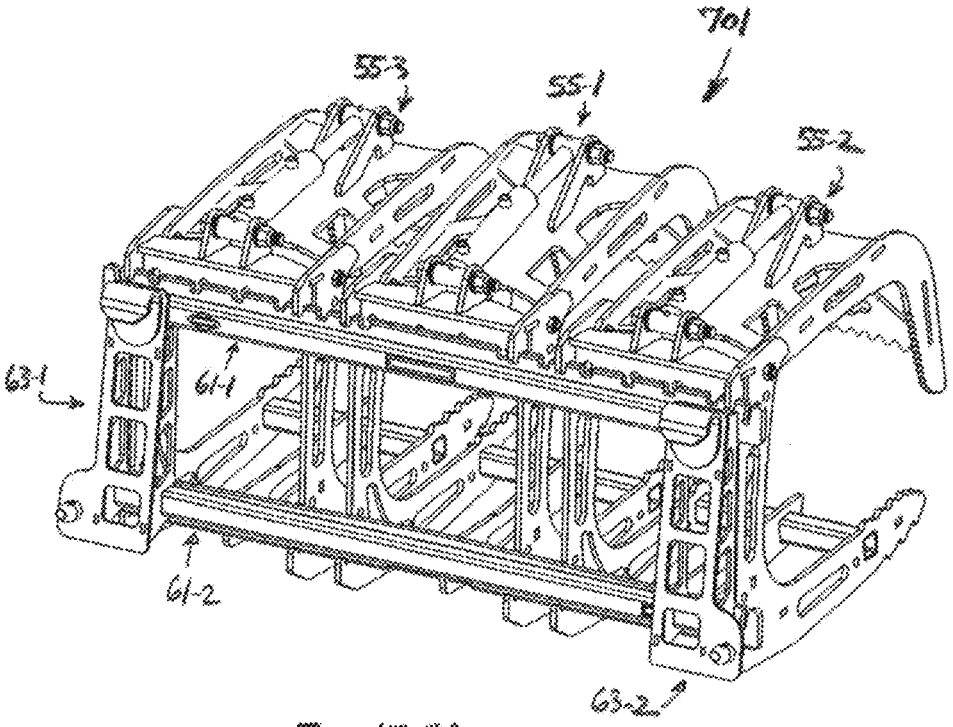
Figure 17C:
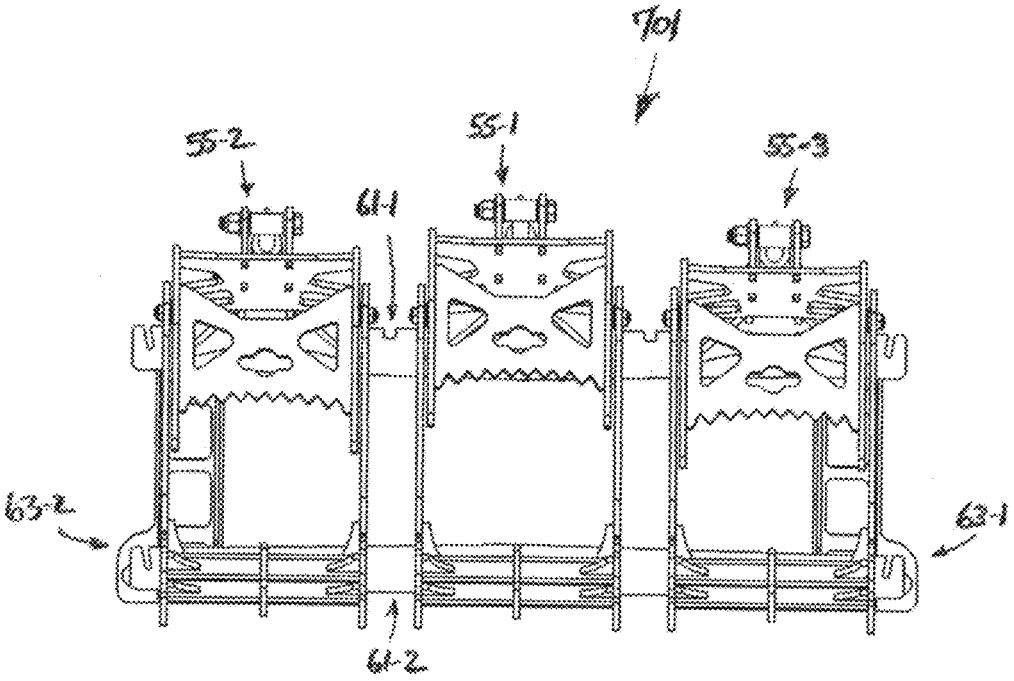
Figure 17D:
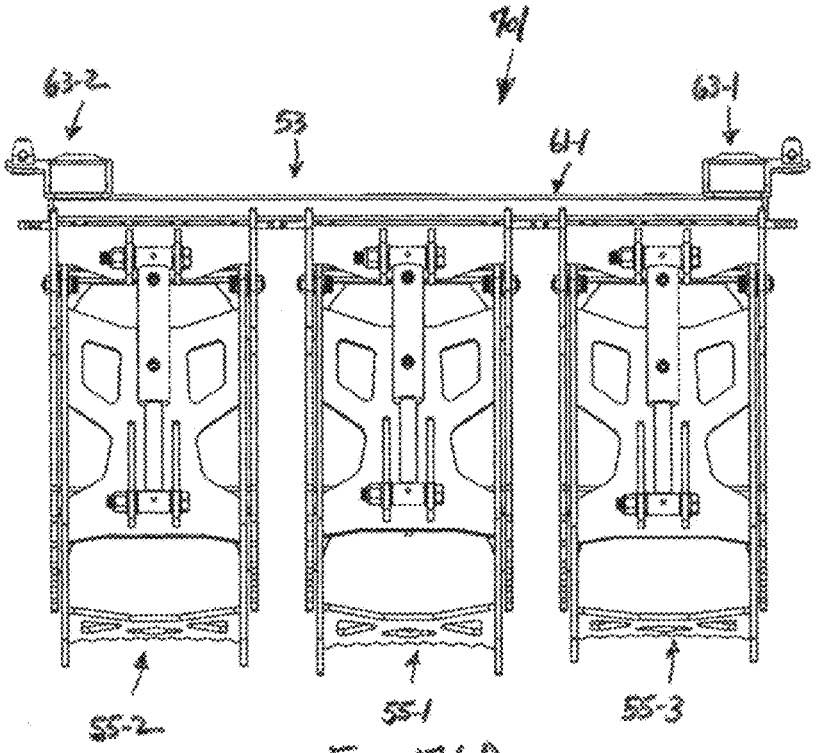
Figure 18A:
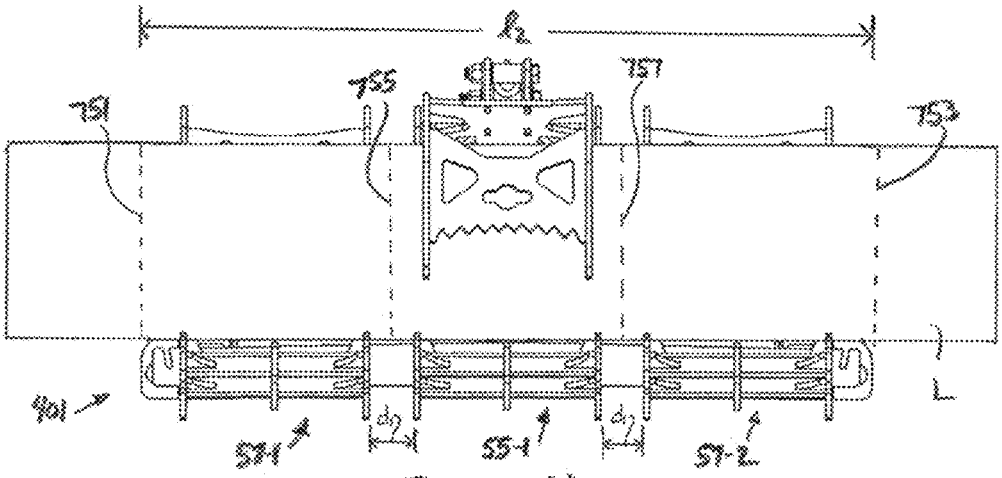
FIGS. 18(*a*) through 18(*d*) are front, front perspective, rear perspective, and right side views, respectively, of the tractor attachment of FIGS. 13(*a*) through 13(*f*) being used to hold a log so that the log may be cut into smaller pieces using a chainsaw or the like, the locking members of the tractor attachment not being shown for the sake of simplicity.
Figure 18B:
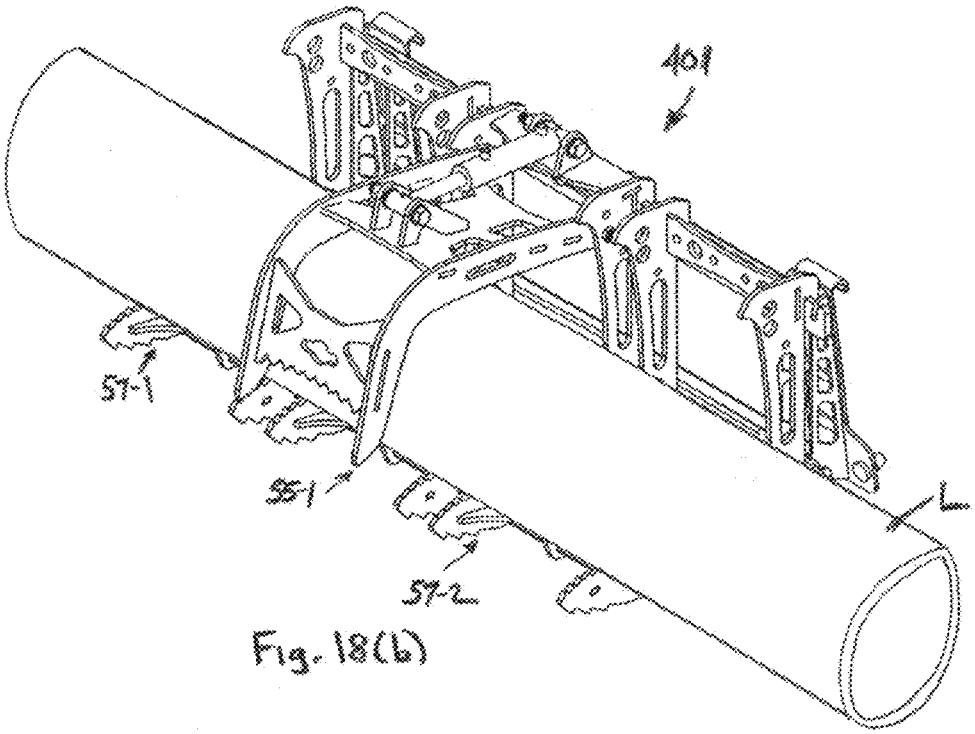
Figure 18C:
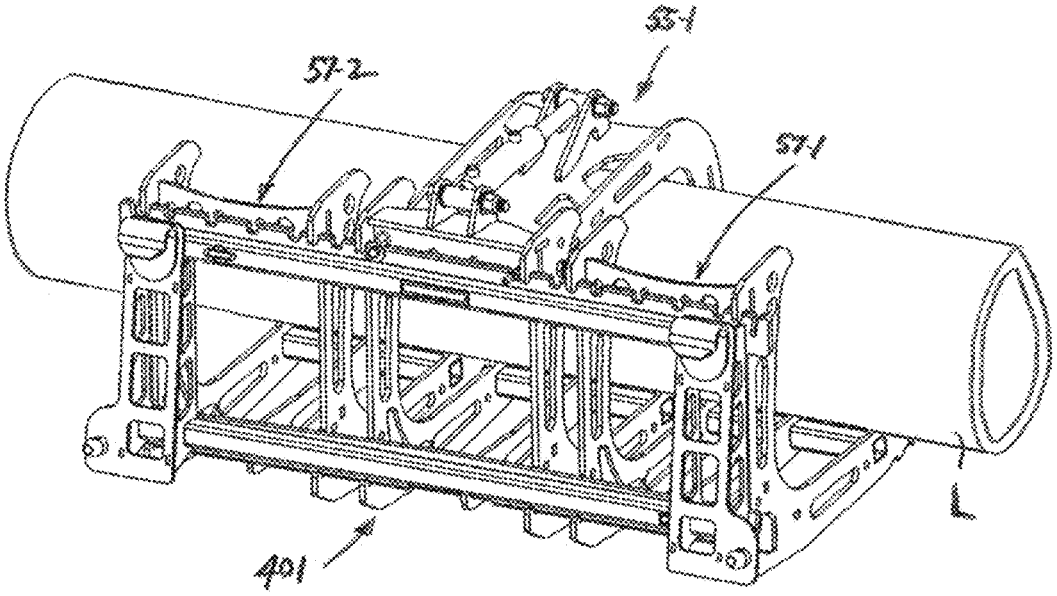
Figure 18D:
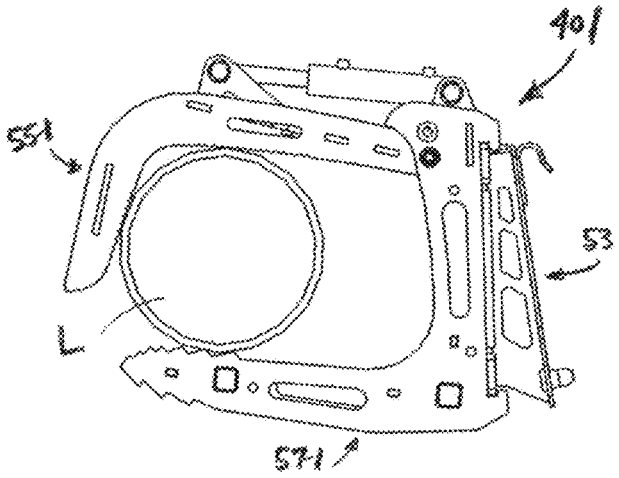

Support unit 57-1, which is also shown separately in FIGS. 11(*a*) and 11(*b*), may be similar in size, shape and construction to lower jaw 121 of clamping unit 55-1, some of the more significant differences between the two structures being that support unit 57-1 may not include the following structures of lower jaw 121: plate 157, mounting members 177 and 179, and gussets 183-7 and 183-8. In addition, whereas side members 131-1 and 131-2 of lower jaw 121 may include a T-shaped opening 149, support unit 57-1 may include side members 321-1 and 321-2 that may include a rectangular opening 323. Additionally, side members 321-1 and 321-2 of support unit 57-1 may differ from lower jaw 121 of clamping unit 55-1 in that, instead of having an upper hole 145 and a lower hole 147, each of side members 321-1 and 321-2 may have an upper hole 325 and a lower hole 327. Upper hole 325 and lower hole 327 may be centered in analogous locations to upper hole 145 and lower hole 147, respectively, but may have an increased diameter, as compared to upper hole 145 and lower hole 147, so that each of holes 325 and 327 is large enough to receive nut 269 of pivot assembly 125 of a neighboring clamping unit, thereby enabling the side members of neighboring support and clamping units to be brought into close proximity or contact with one another. Finally, support unit 57-1 may differ from lower jaw 121 of clamping unit 55-1 in that support unit 57-1 may include a plate 331, instead of plate 155. Plate 331 may be shaped to include a plurality of transverse openings 333, one or more of which may be used to receive an end of a locking member 59 for use in securing support unit 57-1 to mounting assembly 53.

Like lower jaw 121 of clamping unit 55-1, support unit 57-1 may be made of a high strength steel or similarly suitable material.

Referring back now to FIG. 4, locking members 59-1 through 59-6 may be identical in size, shape and construction to one another. Therefore, it is to be understood that the discussion below of the construction of locking member 59-1 may be equally applicable to each of locking members 59-2 through 59-6.

Locking member 59-1, which is also shown separately in FIGS. 12(*a*) through 12(*d*), may comprise a first member 351 and a second member 353. First member 351, which may be made of a high strength steel or other similarly suitable material, may be generally rectangular in shape and may comprise a front portion 355, an intermediate portion 357, and a rear portion 359. As will be discussed further below, first member 351 may be appropriately dimensioned so that intermediate portion 357 may be received within a notch 69 of mounting assembly 53, with front portion 355 extending forwardly so that it may extend either through a transverse opening 171 in a clamping unit 55 or through a transverse opening 333 in a support unit 57 and with rear portion 359 extending rearwardly from notch 69. Rear portion 359 may have a width $w_1$ that may be less than the width $w_2$ of intermediate portion 357, and front portion 355 may have a width $w_3$ that may be intermediate to that of intermediate portion 357 and rear portion 359. (Alternatively, in another embodiment (not shown), the width $w_3$ of front portion 355 may be the same as or greater than the width $w_2$ of intermediate portion 357.) Rear portion 359 may have a length $l_1$ that may permit locking member 59-1 to be grasped and manipulated via rear portion 359.

Second member 353, which may also be made of a high strength steel or similarly suitable material, may be generally rectangular in profile and may comprise a first end 361 and a second end 363. First end 361 of second member 353 may be received within an opening 365 in first member 351, and, with first end 361 thus received within opening 365, second member 353 may be fixed to first member 351 by welding or other suitable means. First member 351 and second member 353 may be oriented generally perpendicularly to one another, and second member 353 may be positioned along the length of first member 351 so that, when intermediate portion 357 of first member 351 is positioned within a notch 69 of mounting assembly 53, second member 353 may be positioned between mounting assembly 53 and whichever of clamping unit 55 or support unit 57 is secured to mounting assembly 53.

It is to be understood that, although locking member 59-1 is shown in the present embodiment as being made from two separate pieces that are joined to one another, namely, first member 351 and second member 353, locking member 59-1 could be fabricated as a unitary structure.

A void 371 may be provided in locking member 59-1 for use in fastening to the attachment.

Referring now to FIGS. 13(*a*) through 13(*f*), there are shown various views of one example of a tractor attachment constructed using grapple assembly kit 51, the exemplary tractor attachment illustrating how a locking member 59 may be used in securing a clamping unit 55 or a support unit 57 to mounting assembly 53.

The tractor attachment shown in FIGS. 13(*a*) through 13(*f*) is represented generally by reference numeral 401 and may comprise mounting assembly 53, a single clamping unit (the clamping unit being represented in the present embodiment by clamping unit 55-1), and a pair of support units, one on each side of the clamping unit (the support units being represented in the present embodiment by support units 57-1 and 57-2). Clamping unit 55-1 may be mounted on mounting assembly 53 by positioning hooks 139 of clamping unit 55-1 around the top of front portion 67 of rail 61-1 of mounting assembly 53 and by positioning hooks 141 of clamping unit 55-1 around the bottom of front portion 75 of rail 61-2 of mounting assembly 53. In like fashion, each of support units 57-1 and 57-2 may be mounted on mounting assembly 53 by positioning hooks 139 of support units 57-1 and 57-2 around the top of front portion 67 of rail 61-1 of mounting assembly 53 and by positioning hooks 141 of support units 57-1 and 57-2 around the bottom of front portion 75 of rail 61-2 of mounting assembly 53. Then, to secure the thus-mounted clamping unit 55-1 or support units 57-1 and 57-2 to mounting assembly 53, one or more locking members 59 may be used in the manner hereinafter described. More specifically, each mounting member 59 may be held by its rear portion 359 in the hand of a user and may be oriented so that its second member 353 is directed generally upwardly. Then, front portion 355 of mounting member 59 may be manually inserted first through a notch 69 in front portion 67 of rail 61-1 and then, depending on the type of unit being secured to mounting assembly 53, either through a transverse opening 171 in a clamping unit 55 that is aligned with the notch 69 or through a transverse opening 333 in a support unit 57 that is aligned with the notch 69. Such insertion of front portion 355 may proceed until further insertion is not possible. Rear portion 359 may then be manually rotated approximately 180 degrees until second member 353 extends downwardly between rail 61-1 and the clamping unit or support unit. With locking member 59 thus positioned, the clamping unit 55 or support unit 57 cannot be removed from mounting assembly. The above-described process is illustrated, at least in part, by FIGS. 13(*a*) through 13(*f*), in which locking member 59-1 is shown in its fully installed state to secure support unit 57-1 to rail 61-1, locking member 59-2 is shown in the process of being rotated after having been inserted through notch 69 and opening 333, and locking member 59-3 is shown in its fully installed state to secure clamping unit 55-1 to rail 61-1.

As can be appreciated, to remove a thus-locked clamping unit 55 or support unit 57, one may simply rotate locking member 59 approximately 180 degrees and then withdraw locking member 59 from the clamping unit 55 or support unit 57 and then from notch 69. With locking member 59 thus removed, a clamping unit 55 or a support unit 57 that had previously been mounted on mounting assembly 53 may thereafter be removed therefrom, thereby facilitating the transport and/or storage of the components of kit 51.

It is to be understood that the number of locking members 59 used per clamping unit 55 or support unit 57 may vary. For example, in the present embodiment, two locking members 59-1 and 59-2 are shown being used with support unit 57-1, and one locking member 59-3 is shown being used with clamping unit 55-1. (Also, although no locking members 59 are shown being used with support unit 57-2, the use of at least one such locking member 59 is preferred.) In general, it is preferred that at least two locking members 59 be used per clamping unit 55 or support unit 57. In addition, it is to be understood that the selection of which notch 69 or which opening 171 or 333 may be used for use with a locking member 59 may vary.

Because of the modular nature of clamping units 55 and support unit 57, various combinations of clamping units 55 and support units 57 may be mounted on mounting assembly 53 to create a variety of different grapple-type tractor attachments. For example, FIGS. 14(*a*) through 14(*e*) are various additional views of tractor attachment 401, with locking members 59 not being shown for the sake of simplicity. By contrast, FIGS. 15(*a*) through 15(*d*) are various views of a second example of a grapple-type tractor attachment that may be constructed using kit 51, the grapple-type tractor attachment of FIGS. 15(*a*) through 15(*d*) being represented generally by reference numeral 501. Tractor attachment 501 may differ principally from tractor attachment 401 in that tractor attachment 501 may not include support units 57-1 and 57-2. (Due to the presence of support units 57-1 and 57-2 in tractor attachment 401, tractor attachment 401 may possess increased support for more load capacity than may be the case with tractor attachment 501.) FIGS. 16(*a*) through 16(*d*) are various views of a third example of a grapple-type tractor attachment that may be constructed using kit 51, the grapple-type tractor attachment of FIGS. 16(*a*) through 16(*d*) being represented generally by reference numeral 601. Tractor attachment 601 may differ from tractor attachment 401 in that grapple unit 55-1 of tractor attachment 401 may be replaced with support unit 57-1 in tractor attachment 601 and in that support units 57-1 and 57-2 of tractor attachment 401 may be replaced with grapple units 55-1 and 55-2, respectively, in tractor attachment 601. As compared to tractor attachments 401 and 501, tractor attachment 601 may provide greater clamping power, and, as compared to tractor attachment 501, tractor attachment 601 may provide a wider holding area. FIGS. 17(*a*) through 17(*d*) are various views of a fourth example of a grapple-type tractor attachment that may be constructed using kit 51, the grapple-type tractor attachment of FIGS. 17(*a*) through 17(*d*) being represented generally by reference numeral 701. Tractor attachment 701 may differ from tractor attachment 401 in that support units 57-1 and 57-2 of attachment 401 may be replaced with clamping units 55-2 and 55-3, respectively. As compared to tractor attachments 401, 501, and 601, tractor attachment 701 may provide greater clamping power, and, as compared to tractor attachment 501, tractor attachment 701 may provide a wider holding area.

It is to be understood that other combinations of the components of kit 51 are possible and that all such combinations come within the scope of the present invention.

Referring now to FIGS. 18(*a*) through 18(*d*), there are shown various views of one possible use to which tractor attachment 401 may be put, namely, to hold a wooden log L securely in such a manner as to permit the log L to be cut into smaller pieces using, for example, a chainsaw of the like. As can be seen best in FIG. 18(*a*), tractor attachment 401 may have an overall length $l_2$ that may be, for example, approximately 48 inches, and clamping unit 55-1 may be spaced apart from each of support units 57-1 and 57-2 by a distance $d_1$ that may be, for example, approximately 3 inches. Consequently, by cutting the log L at opposite ends of tractor attachment 401, for example, along imaginary lines 751 and 753 shown in FIG. 18(*a*), one may obtain a log of approximately 48 inches, which may be a suitable length if the log is to be used as firewood for a typical outdoor wood boiler. Moreover, by additionally cutting the thus-cut log approximately midway between clamping unit 55-1 and support unit 57-1, for example, along imaginary line 755 shown in FIG. 18(*a*), and approximately midway between clamping unit 55-1 and support unit 57-2, for example, along imaginary line 757 shown in FIG. 18(*a*), one may obtain three logs of approximately 16 inches each, which may be a suitable length if the logs are to be used as firewood for a typical interior wood stove.

Figure 19A:
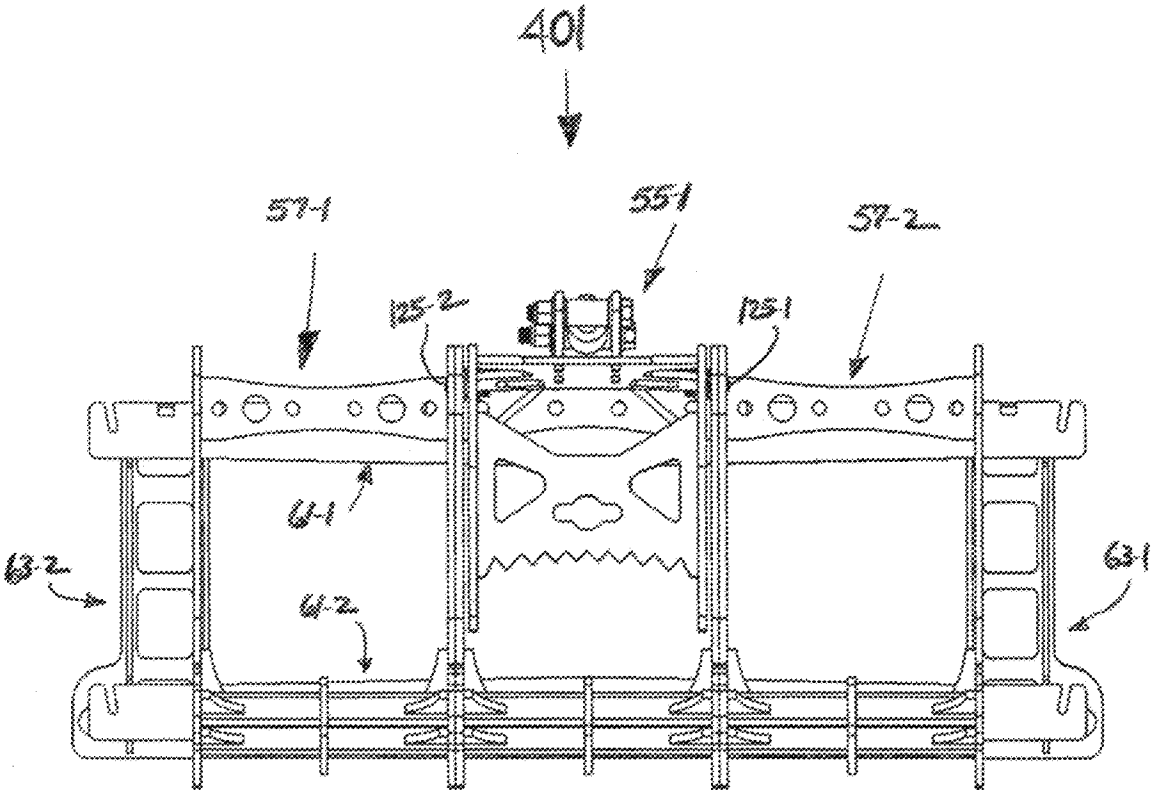
FIGS. 19(*a*) through 19(*c*) are front, front perspective, and rear perspective views, respectively, of the tractor attachment of FIGS. 13(*a*) through 13(*f*), the tractor attachment being shown with its support units positioned flush against its clamping unit, the locking members of the tractor attachment not being shown for the sake of simplicity.
Figure 19B:
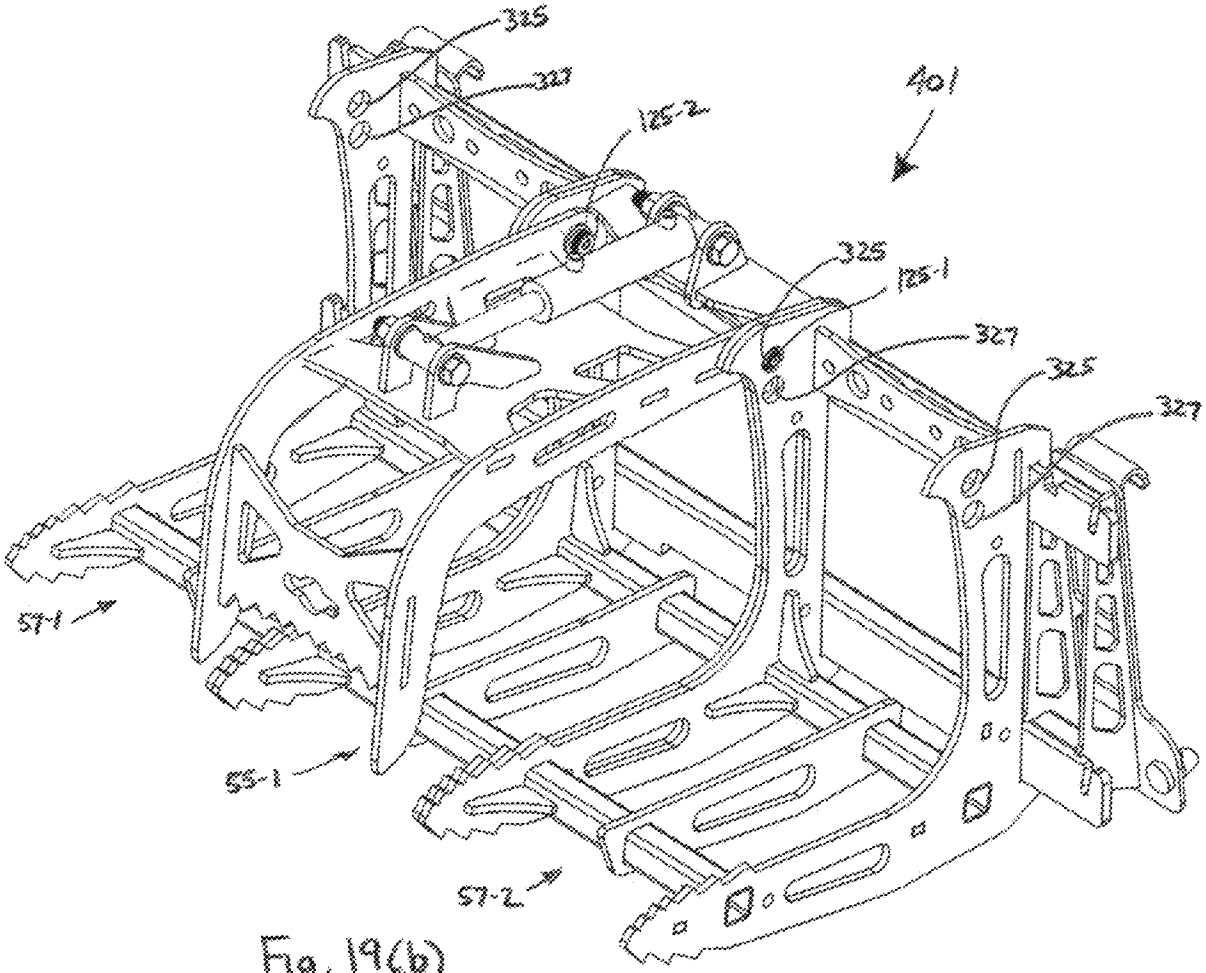
Figure 19C:
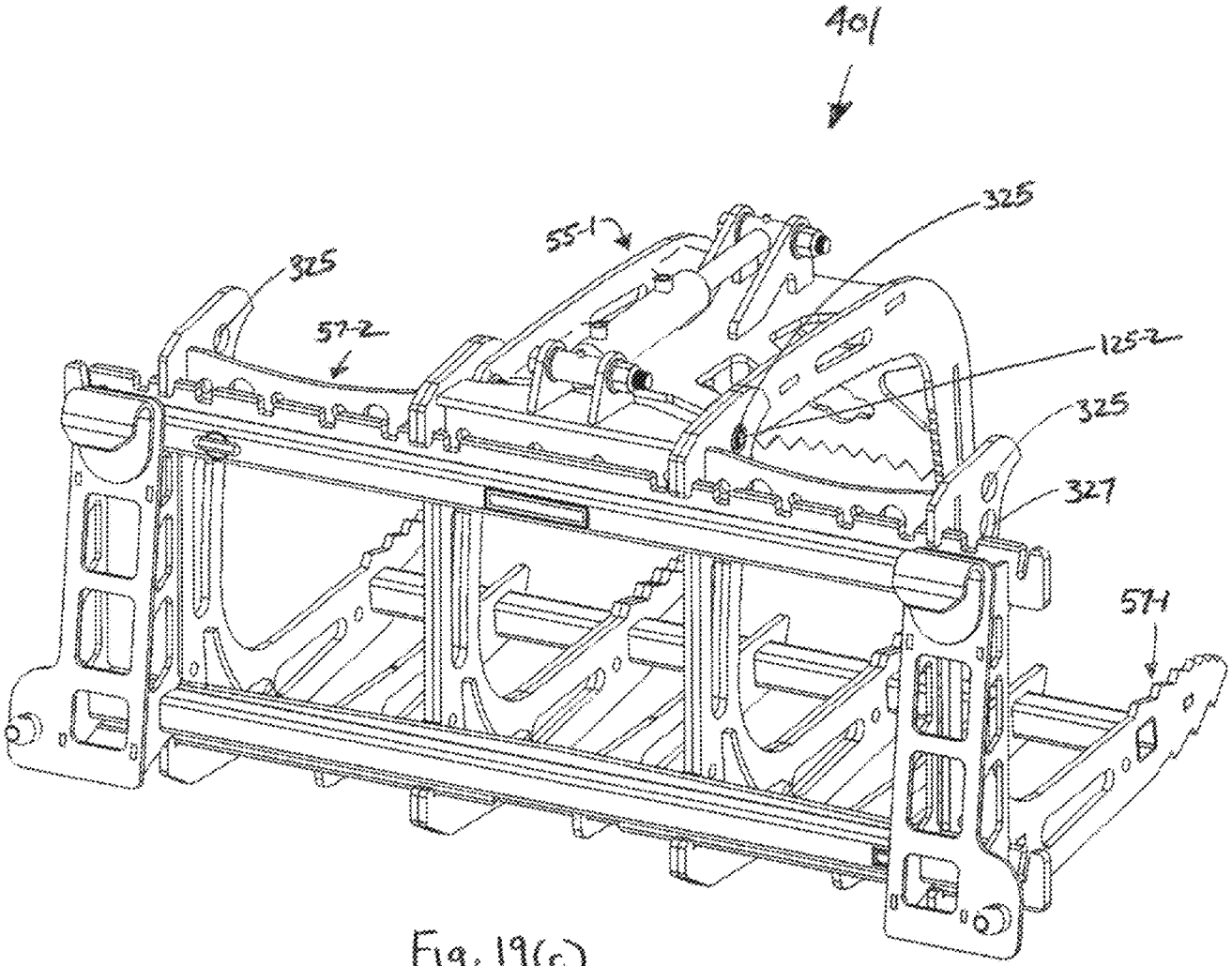

As noted above, the spacing between neighboring clamping unit(s) 55 and/or support unit(s) 57 on mounting assembly 53 may be varied simply by positioning the neighboring clamping unit(s) 55 and/or support unit(s) 57 at desired locations along rails 61-1 and 61-2 and preferably then securing the clamping unit(s) 55 and/or support unit(s) 57 in place using locking members 59. Referring now to FIGS. 19(*a*) through 19(*c*), tractor attachment 401 is shown with the side members of support units 57-1 and 57-2 positioned flush against the side members of clamping unit 55-1. As noted above, the capability to position the side members of support units 57-1 and 57-2 flush against the side members of clamping unit 55-1 may be attributable, at least in part, to the fact that holes 325 and 327 of support units 57-1 and 57-2 may be appropriately dimensioned to permit the outside ends of pivot assemblies 125-1 and 125-2 to pass therethrough. If desired, bolts or other fasteners (not shown) may be used to couple support units 57-1 and 57-2 to clamping unit 55-1 to increase the rigidity of the structure.

Figure 20A:
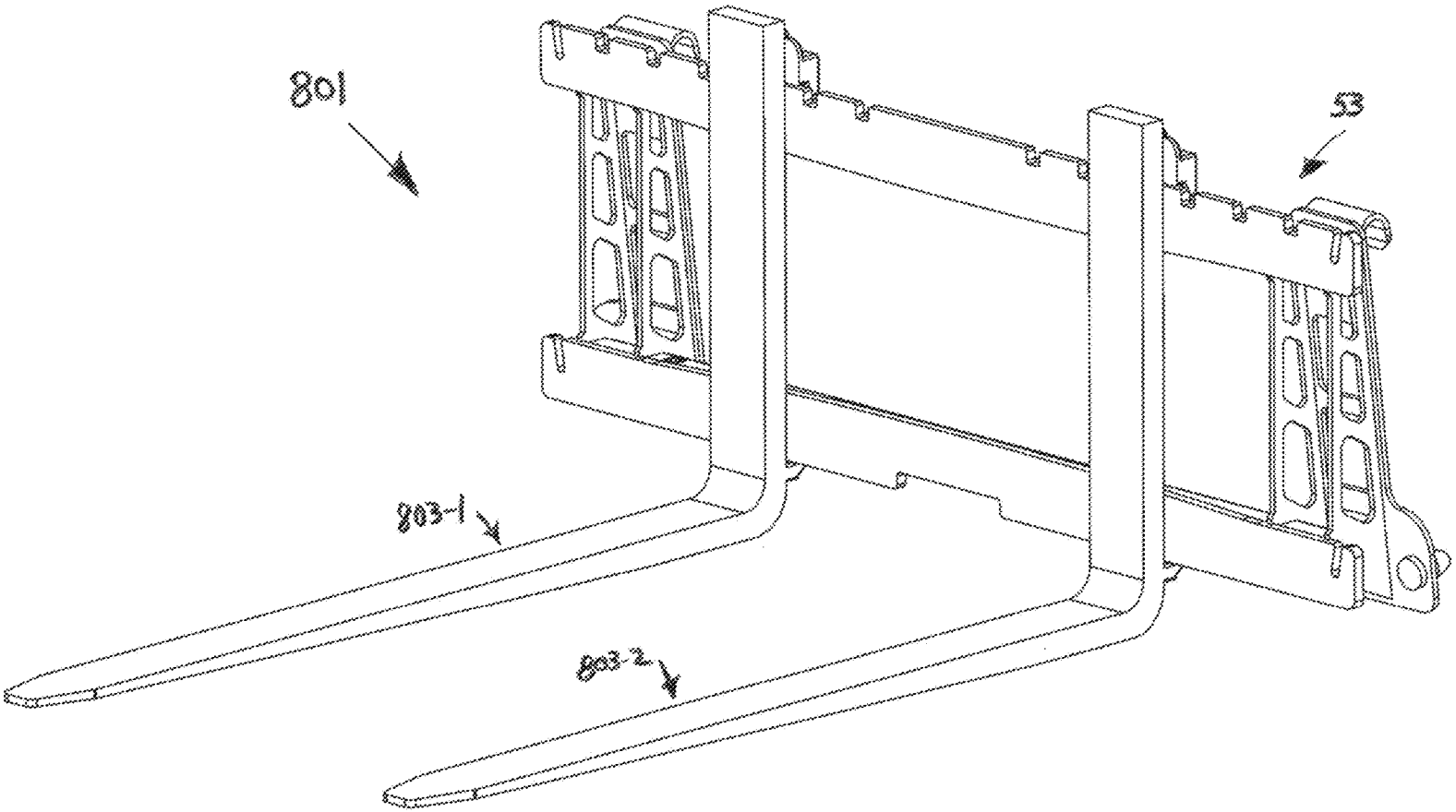
FIGS. 20(*a*) through 20(*c*) are front perspective, rear perspective, and right side views, respectively, of a forklift attachment that may be constructed according to the teachings of the present invention.
Figure 20B:
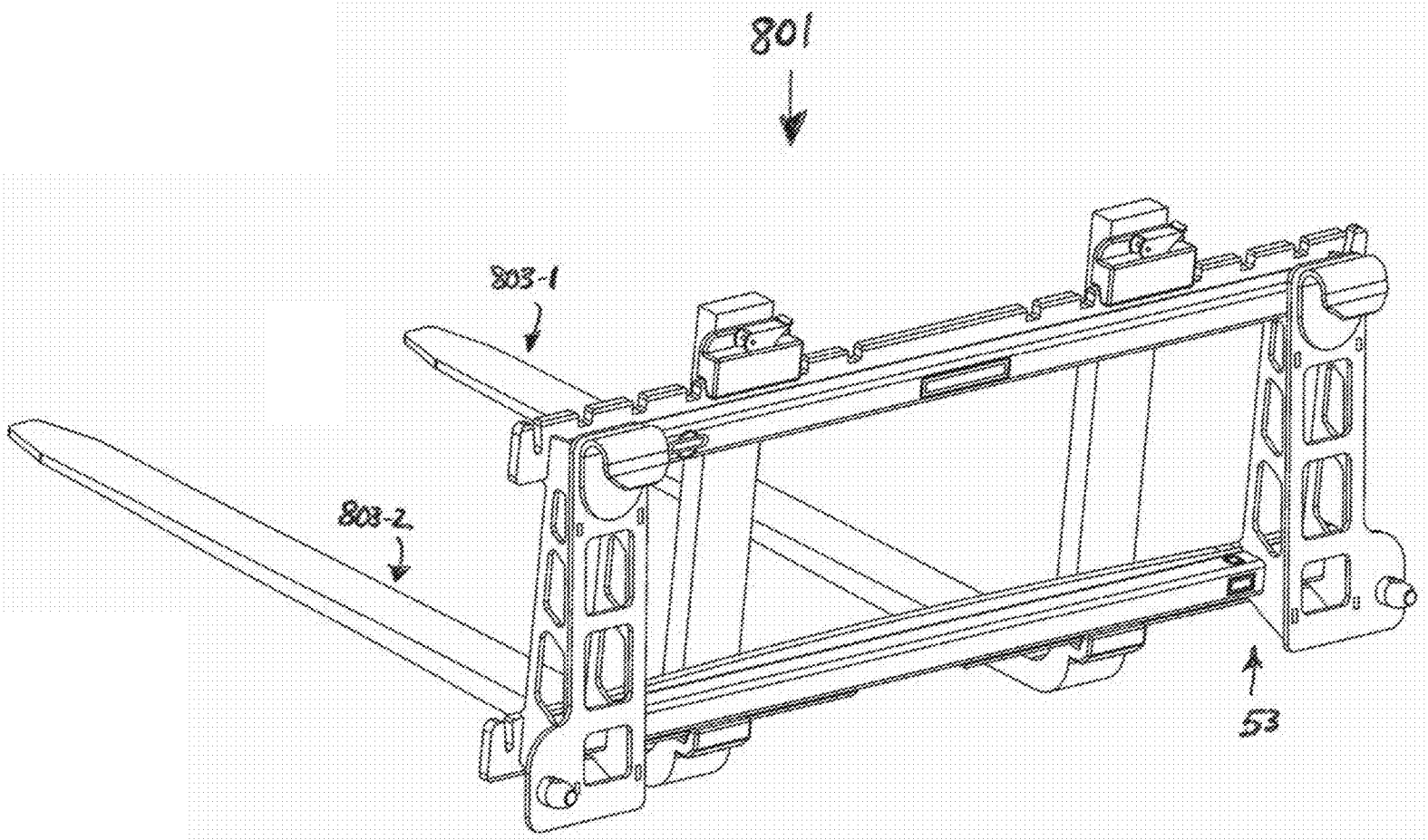
Figure 20C:
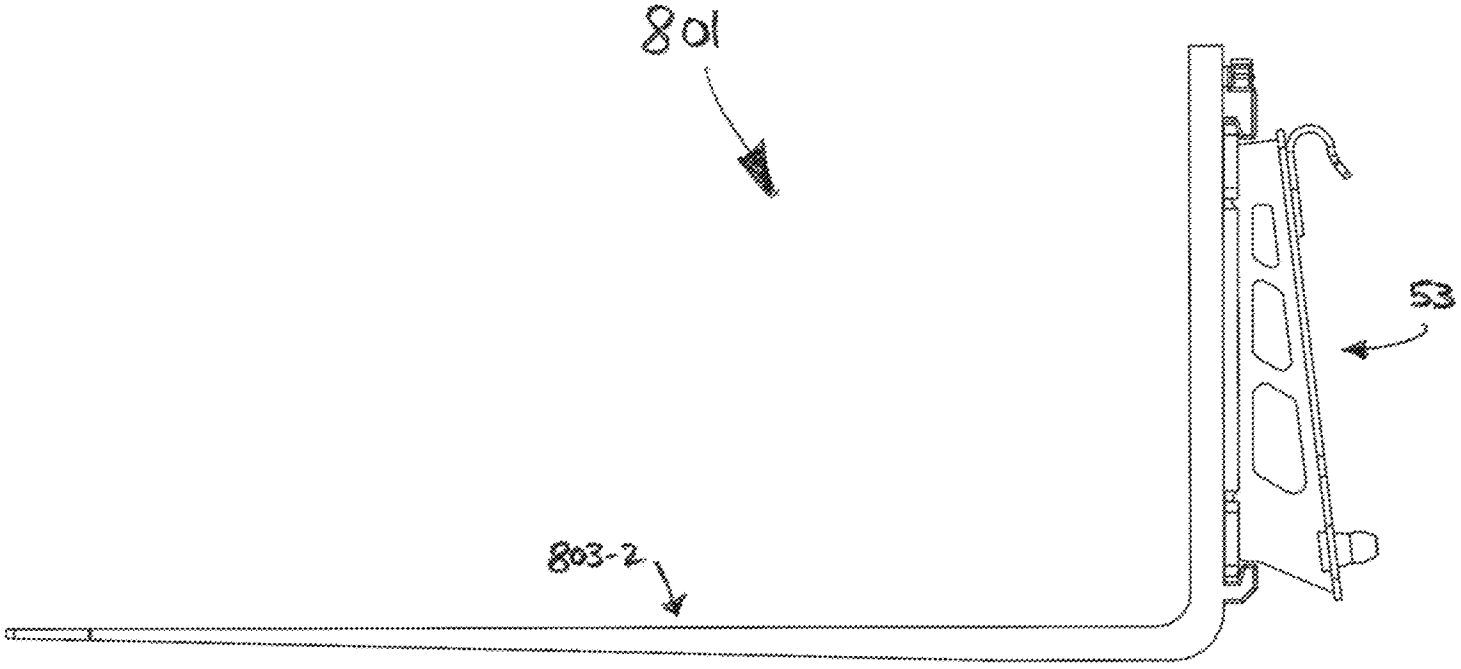
Figure 21A:
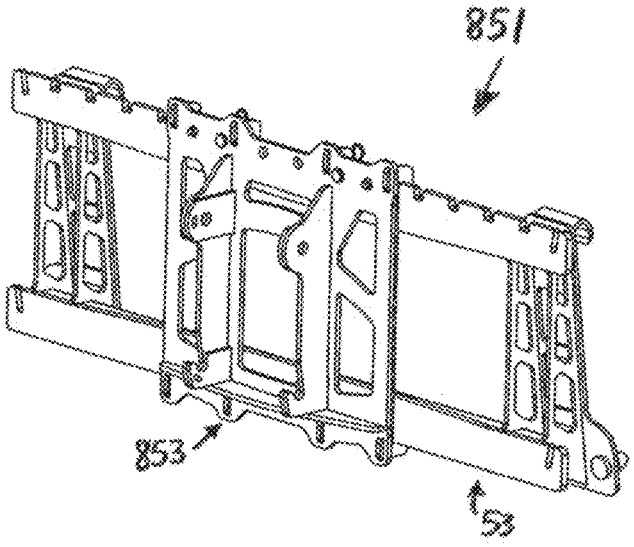
FIGS. 21(*a*) through 21(*d*) are front perspective, rear perspective, partly exploded front perspective, and right side views, respectively, of a snow plow adapter attachment that may be constructed according to the present invention.
Figure 21B:
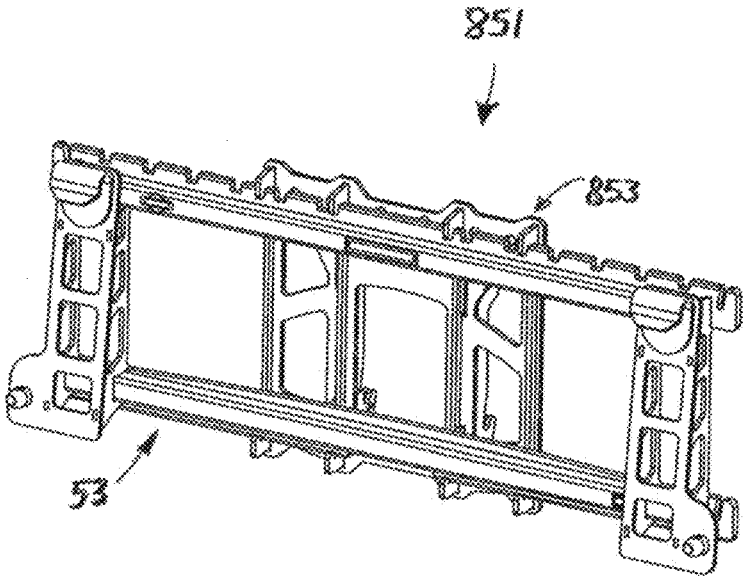
Figure 21C:
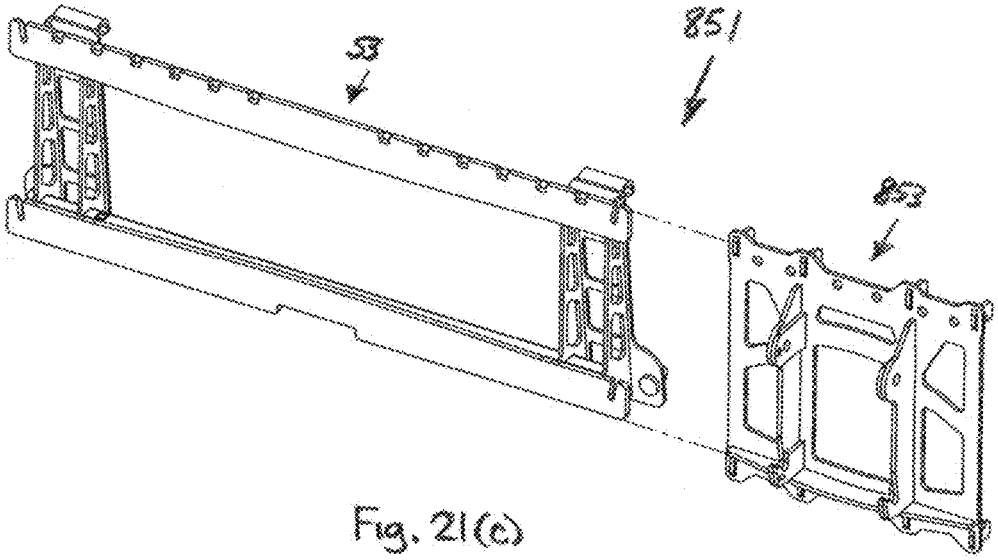
Figure 21D:
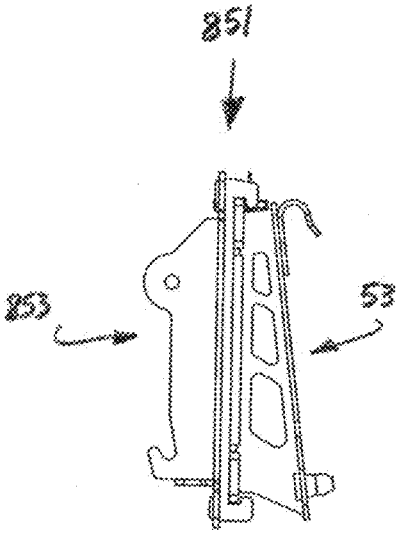
Figure 22A:
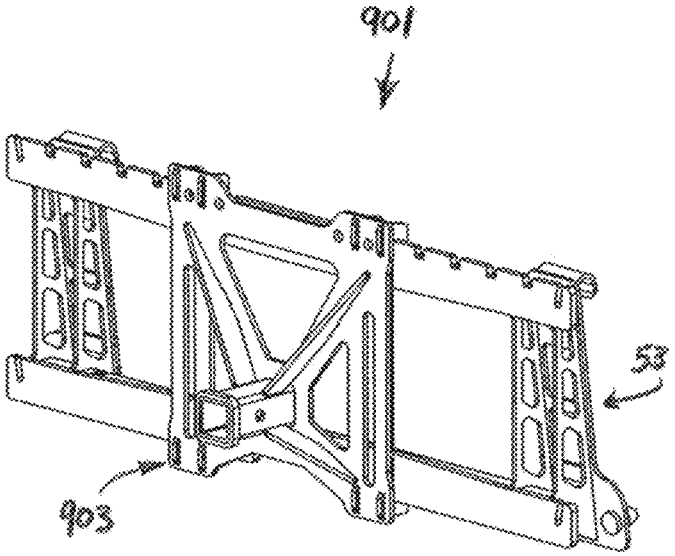
FIGS. 22(*a*) through 22(*d*) are front perspective, rear perspective, partly exploded front perspective, and right side views, respectively, of a ball mount adapter attachment that may be constructed according to the present invention.
Figure 22B:
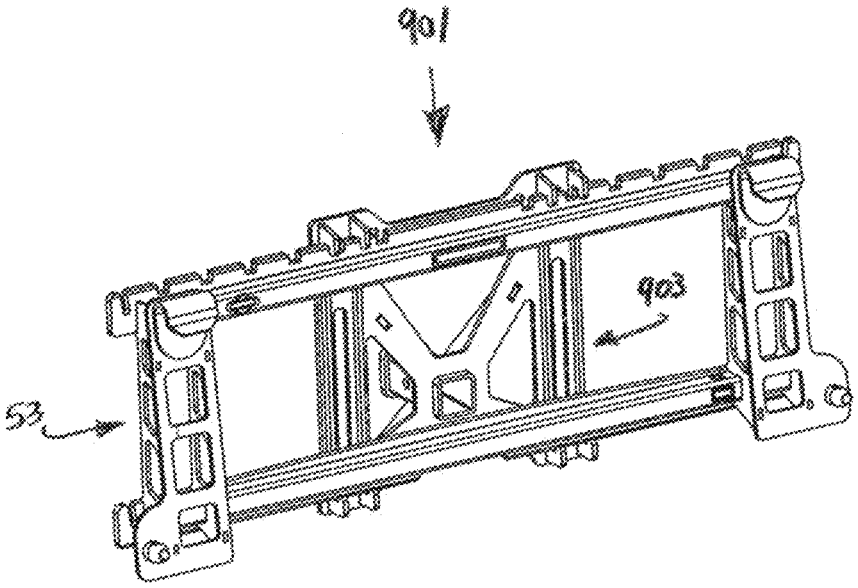
Figure 22C:
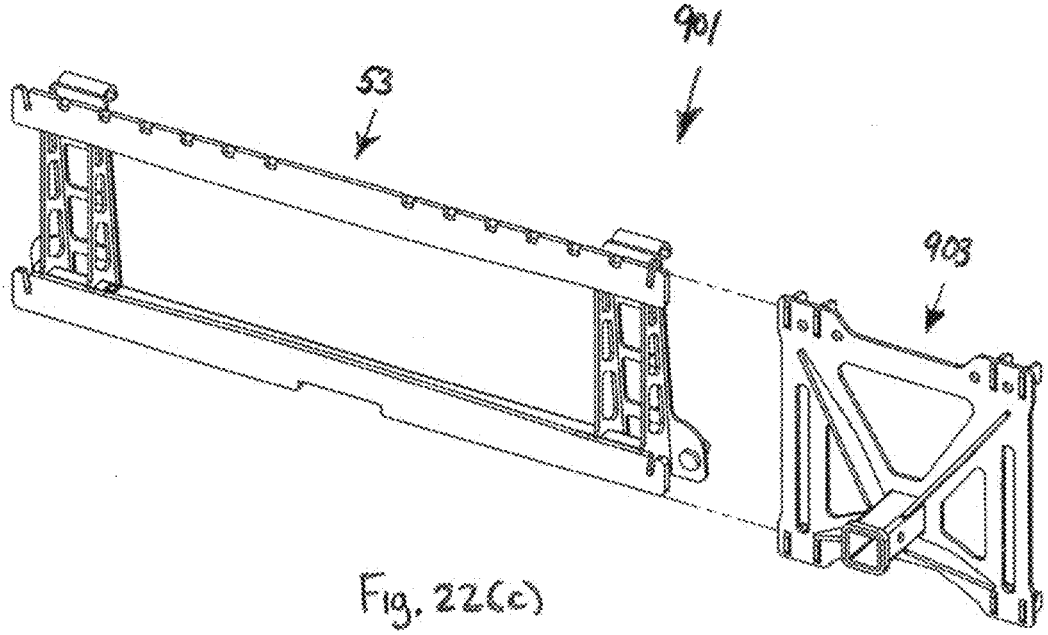
Figure 22D:
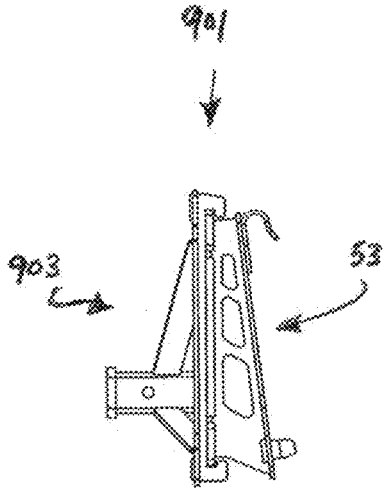
Figure 23A:
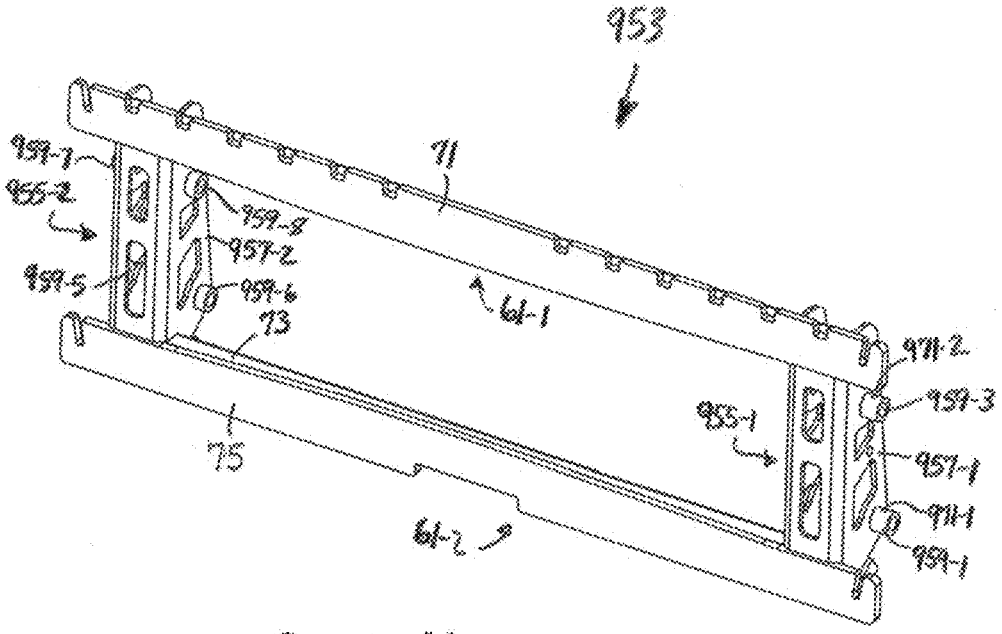
FIGS. 23(*a*) through 23(*f*) are front perspective, rear perspective, front, top, right side, and exploded perspective views, respectively, of a first alternative mounting assembly to the mounting assembly shown in FIGS. 4, 5(*a*), 5(*b*), 5(*c*), 5(*d*), 5(*e*), 5(*f*) and 5(*g*)
Figure 23B:
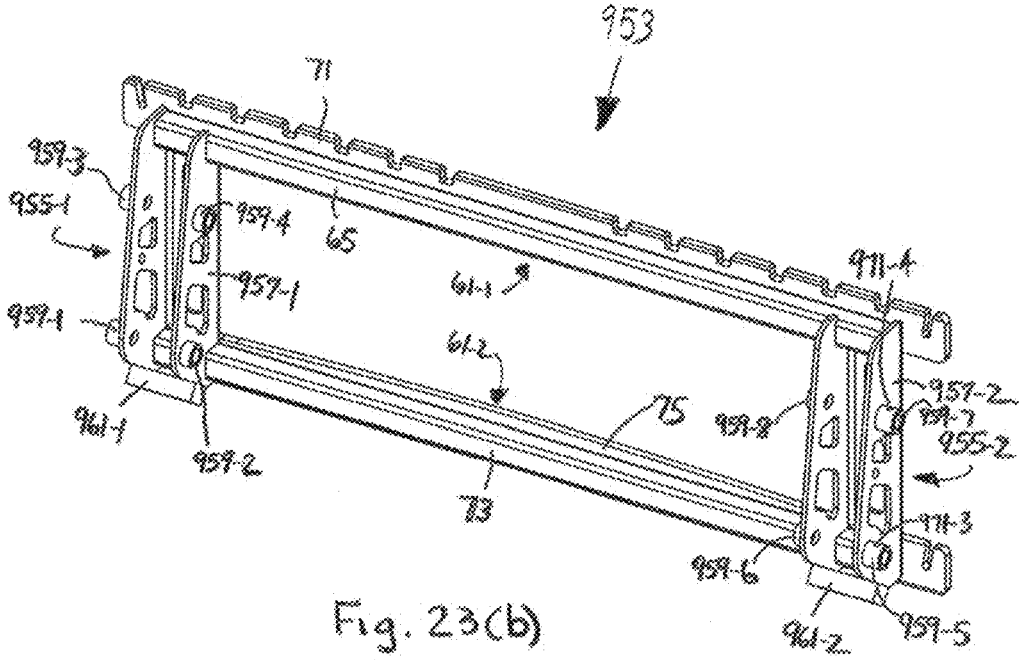
Figure 23C:
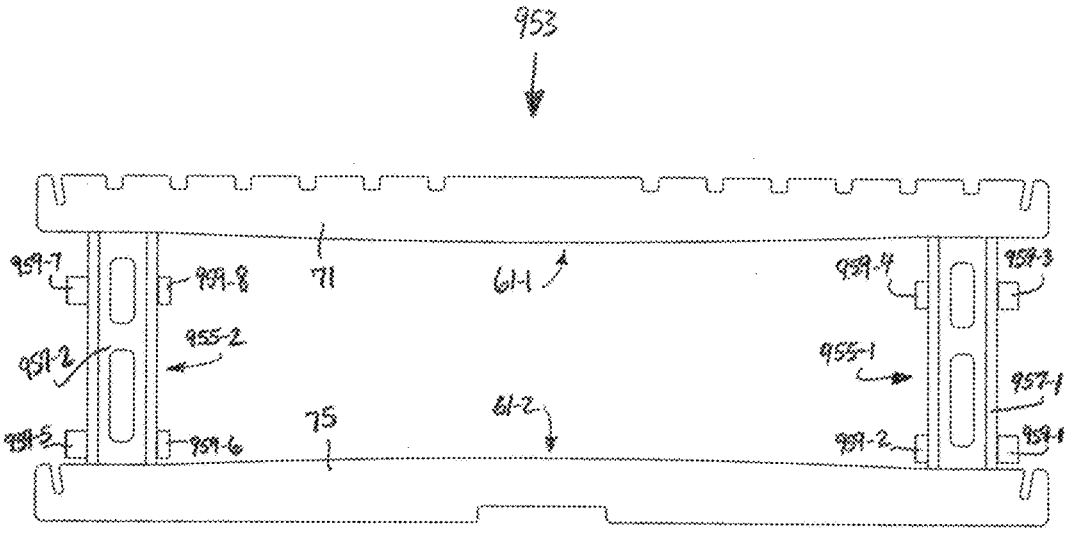
Figure 23D:
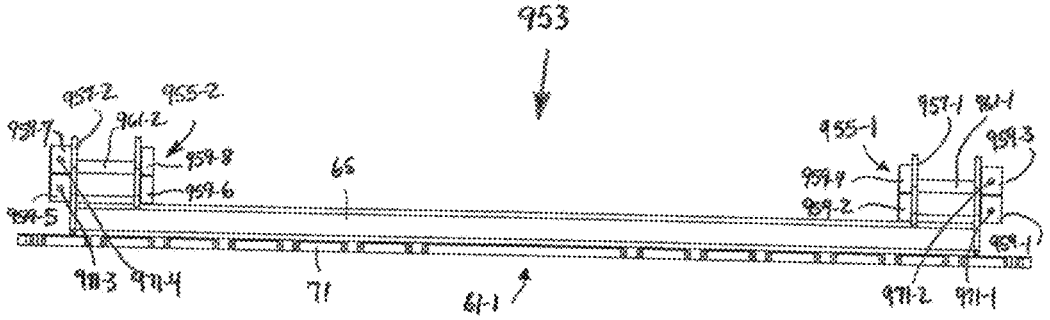
Figure 23E:
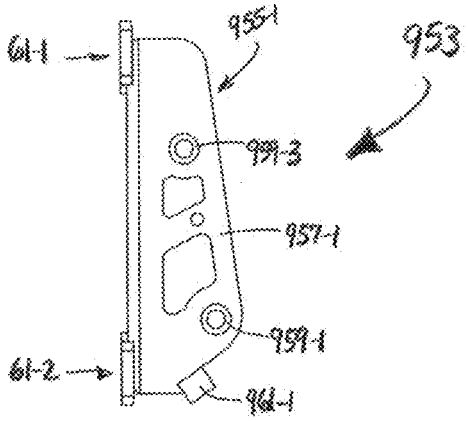
Figure 23F:
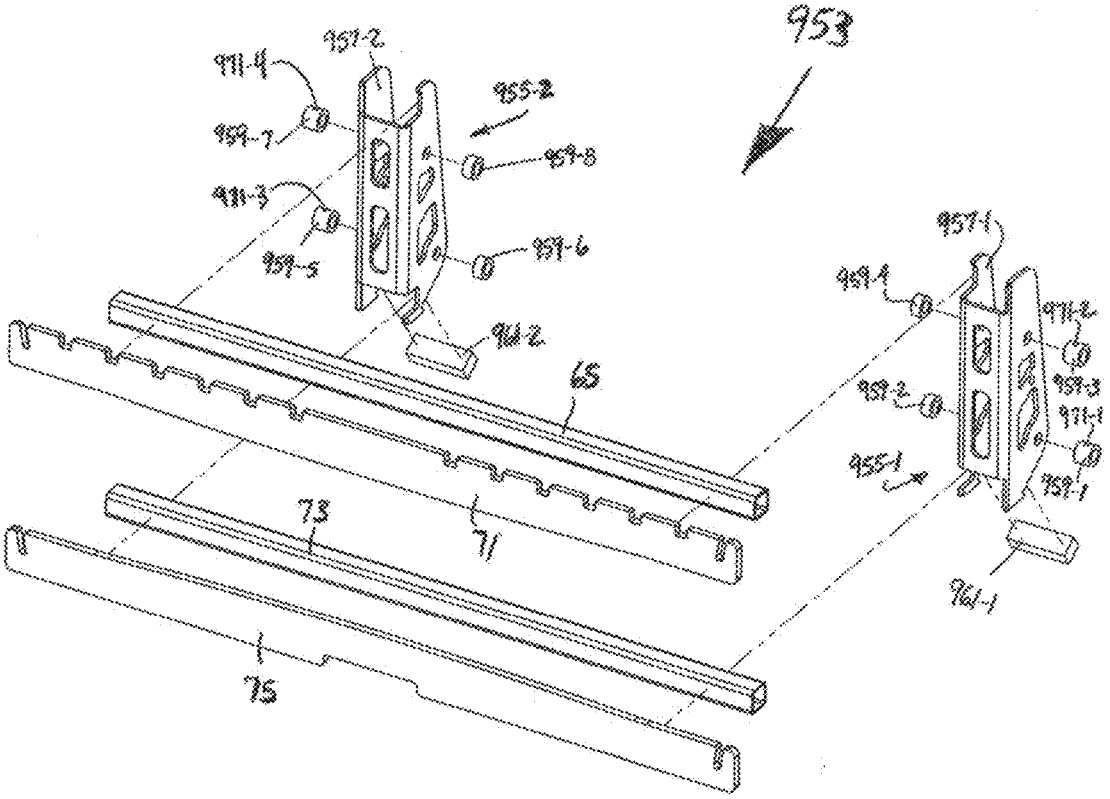

Kit 51 may further comprise additional components that may be used in conjunction with mounting assembly 53 to provide alternative tractor attachments that are not of a grapple variety. For example, FIGS. 20(*a*) through 20(*c*) are various views of a forklift-type tractor attachment 801. Attachment 801 may comprise a pair of forklift tines 803-1 and 803-2 that may be removably mounted on mounting assembly 53. FIGS. 21(*a*) through 21(*d*) are various views of a snow plow adapter attachment 851. Attachment 851 may comprise an adapter 853 that may be removably mounted on mounting assembly 53. FIGS. 22(*a*) through 22(*d*) are various views of a ball mount adapter attachment 901. Attachment 901 may comprise an adapter 903 that may be removably mounted on mounting assembly 53. Accordingly, kit 51 may include one or more of forklift tines 803-1 and 803-2, adapter 853 and adapter 903.

The various tractor attachments described above are designed to be used in connection with a loader boom on which mounting assembly 53 can be mounted, an example of such a loader boom being loader boom 17. However, as can readily be appreciated, one may replace mounting assembly 53 with an alternative mounting assembly to permit the tractor attachment to be attached to other types of loader booms. All such alternative mounting assemblies for use with alternative loader booms are intended to come within the scope of the present invention.

Figure 1:
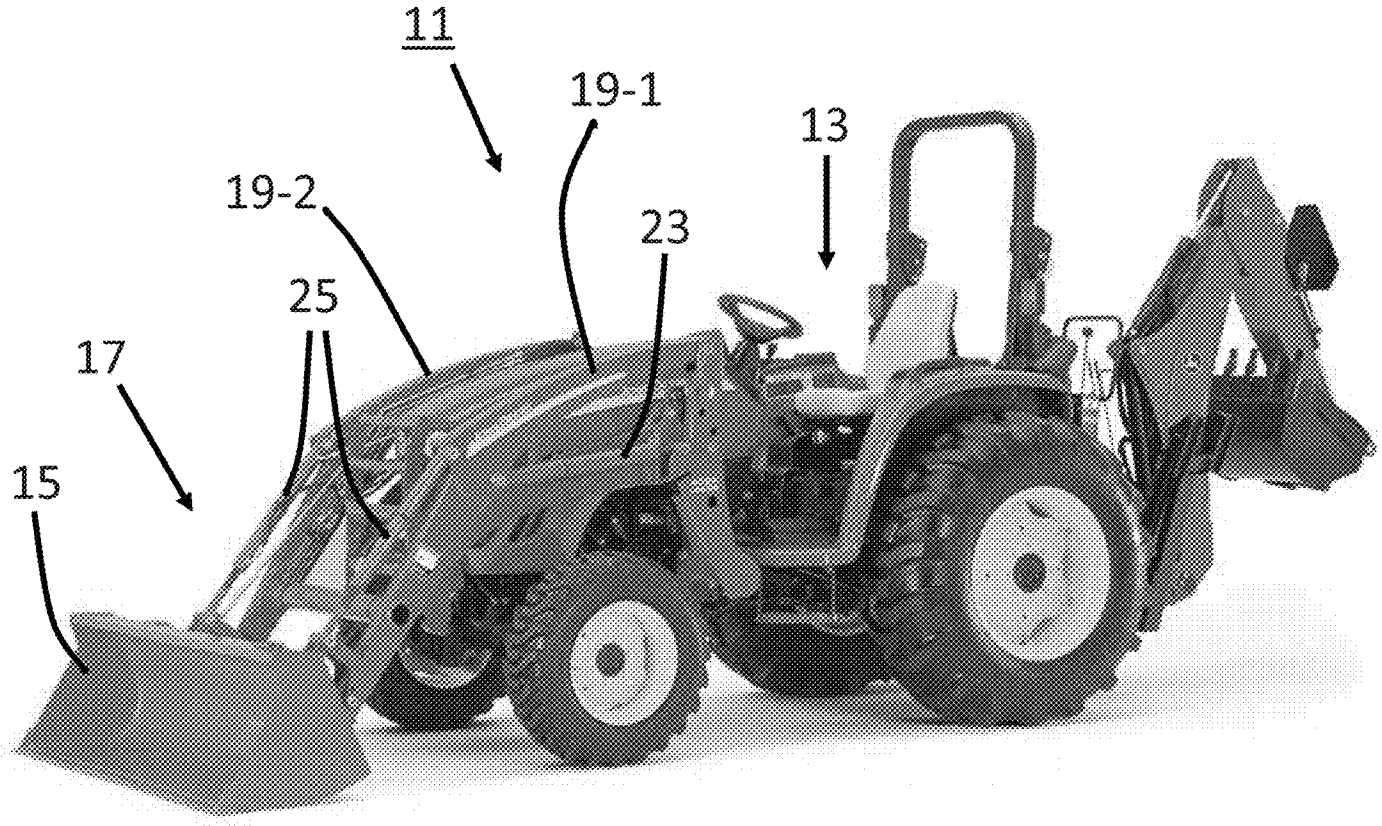
Prior Art Fig. 1
FIG. 1 is a front, perspective view of a conventional tractor assembly.
Figure 2:
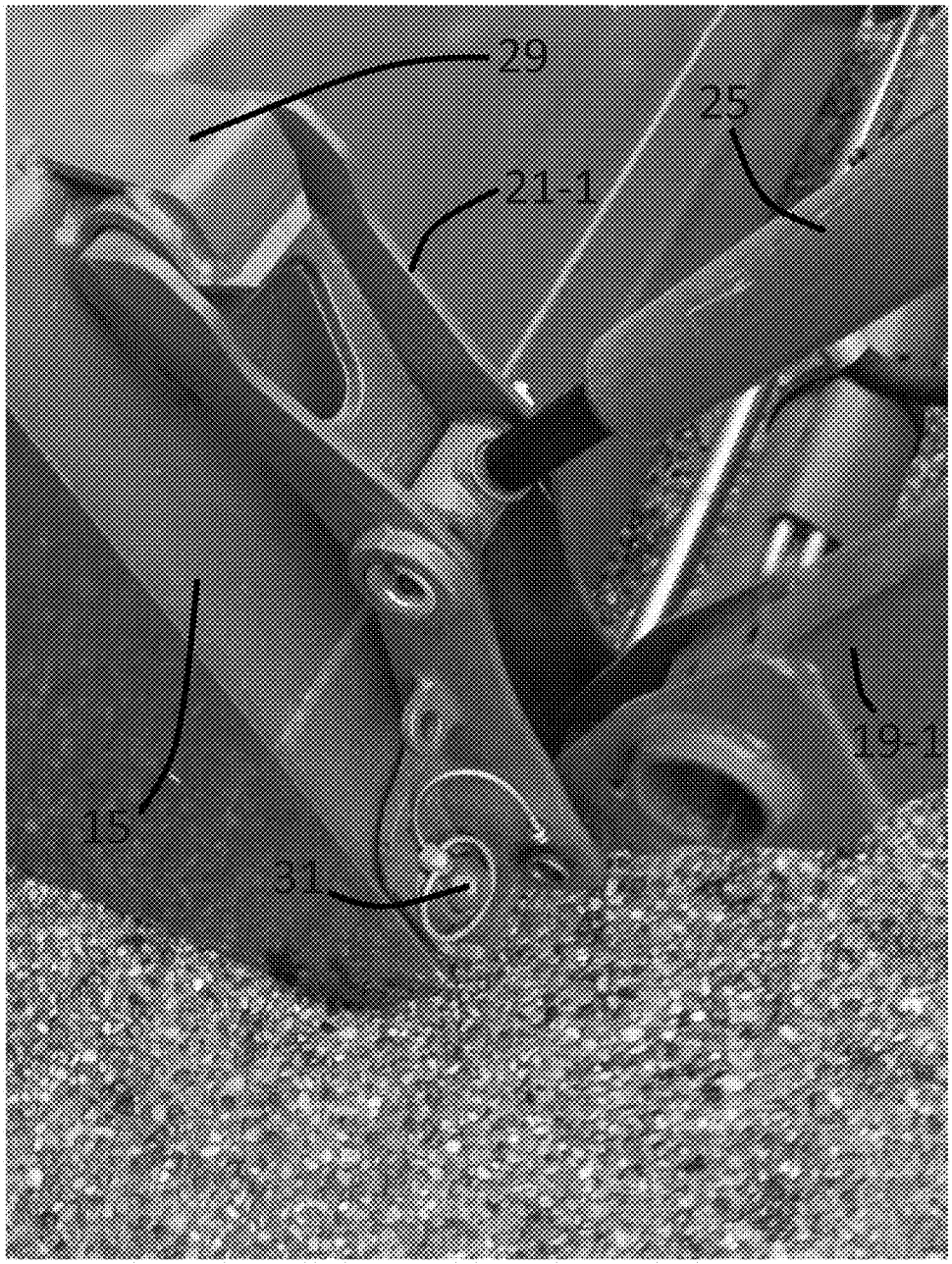
Prior Art Fig. 2
FIG. 2 is an enlarged, fragmentary, rear, perspective view of the conventional tractor assembly of FIG. 1.
Figure 3A:
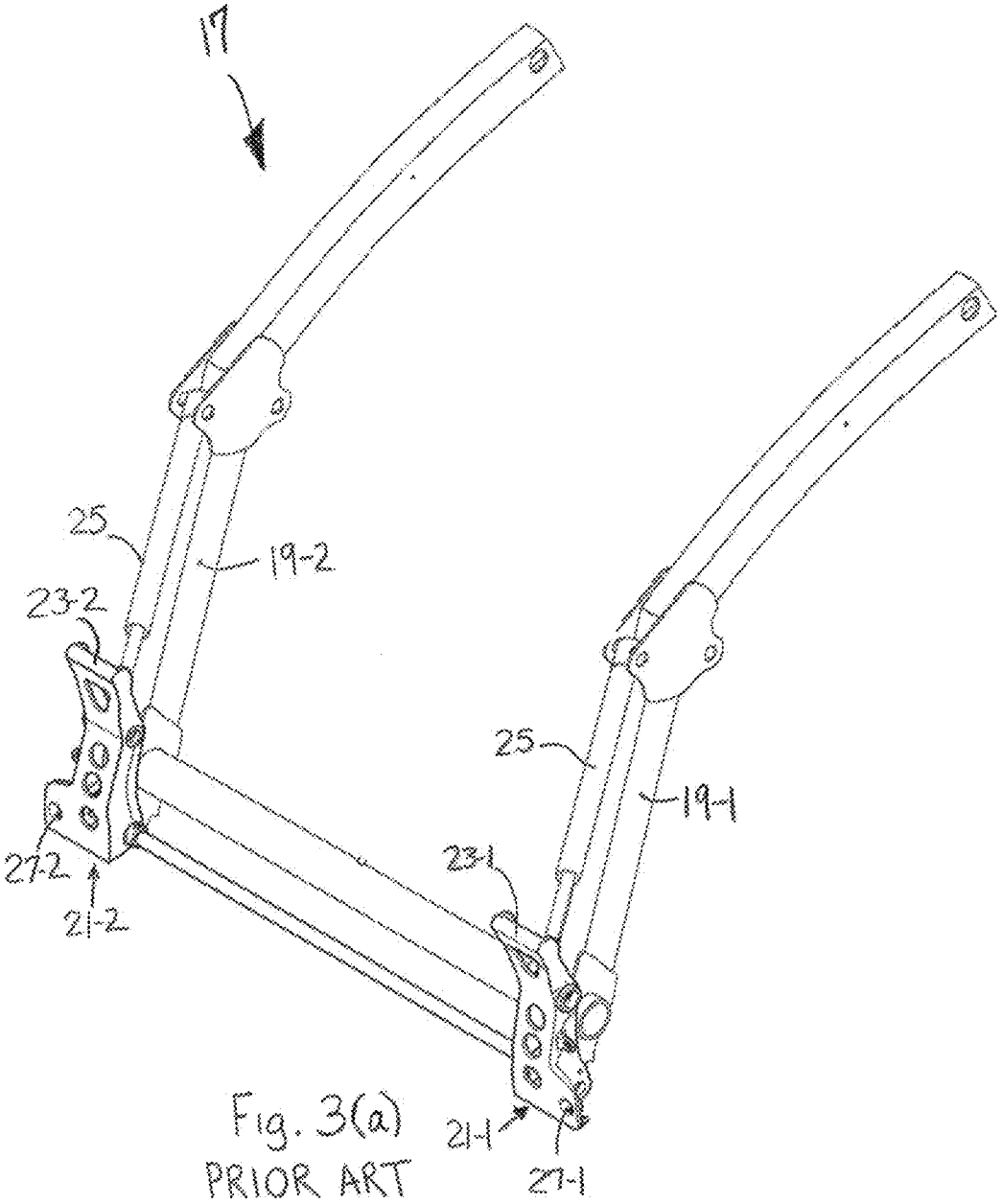
Fig. 3(a) PRIOR ART
FIG. 3(*a*) is an enlarged, front, perspective view of the loader boom shown in FIG. 1, with certain components not being shown for the sake of clarity.
Figure 3B:
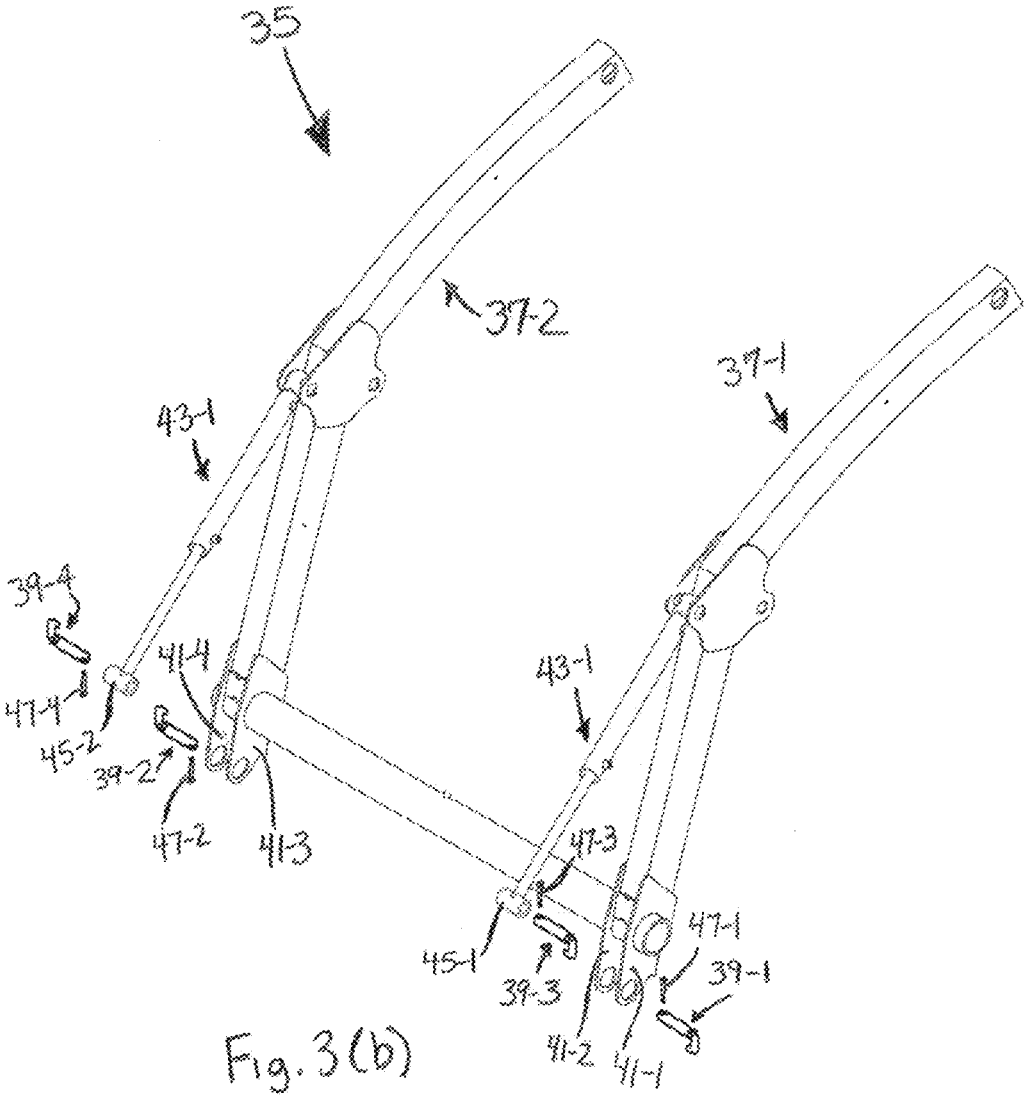
Fig. 3(b) PRIOR ART

For example, referring now to FIGS. 23(*a*) through 23(*f*), there are shown various views of one such alternative mounting assembly to mounting assembly 53, the alternative mounting assembly being represented generally by reference number 953. Mounting assembly 953, which may be used with, for example, loader boom 35 (as seen in FIG. 3(*b*)), may be similar in many respects to mounting assembly 953. For example, mounting assembly 953, like mounting assembly 53, may comprise rails 61-1 and 61-2. On the other hand, mounting assembly 953 may differ from mounting assembly 53 in that, whereas mounting assembly 53 may comprise mounting brackets 63-1 and 63-2, mounting assembly 953 may instead comprise mounting brackets 955-1 and 955-2. Brackets 955-1 and 955-2, which are preferably made of a high strength steel or other similarly suitable material, may be arranged generally parallel to one another and generally perpendicularly relative to each of rails 61-1 and 61-2. Bracket 955-1 may be shaped to include a support 957-1, a plurality of tubular guides 959-1 through 959-4, and a block 961-1. In a similar fashion, bracket 955-2 may be shaped to include a support 957-2, a plurality of tubular guides 959-5 through 959-8, and a block 961-2. Brackets 955-1 and 955-2 may be adapted to receive the front ends of loader boom 35 (loader boom 35 being shown in FIG. 3(*b*)). Pin 39-1 of loader boom 35 may be inserted through guide 959-1 of mounting assembly 953, through plates 41-1 and 41-2 of loader boom 35, and through guide 959-2 of mounting assembly 953. Pin 39-2 of loader boom 35 may be inserted through guide 959-5 of mounting assembly 953, through plates 41-3 and 41-4 of loader boom 35, and through guide 959-6 of mounting assembly 953. Pin 39-3 of loader boom 35 may be inserted through guide 959-3 of mounting assembly 953, through end 45-1 of loader boom 35, and through guide 959-4 of mounting assembly 953. Pin 39-4 of loader boom 35 may be inserted through guide 959-7 of mounting assembly 953, through end 45-2 of loader boom 35, and through guide 959-8 of mounting assembly 953. Guides 959-1, 959-3, 959-5 and 959-7 may be provided with transverse openings 971-1 through 971-4, respectively, for use in receiving fasteners 47-1, 47-3, 47-2, and 47-4, respectively, of loader boom 35.

Figure 24A:
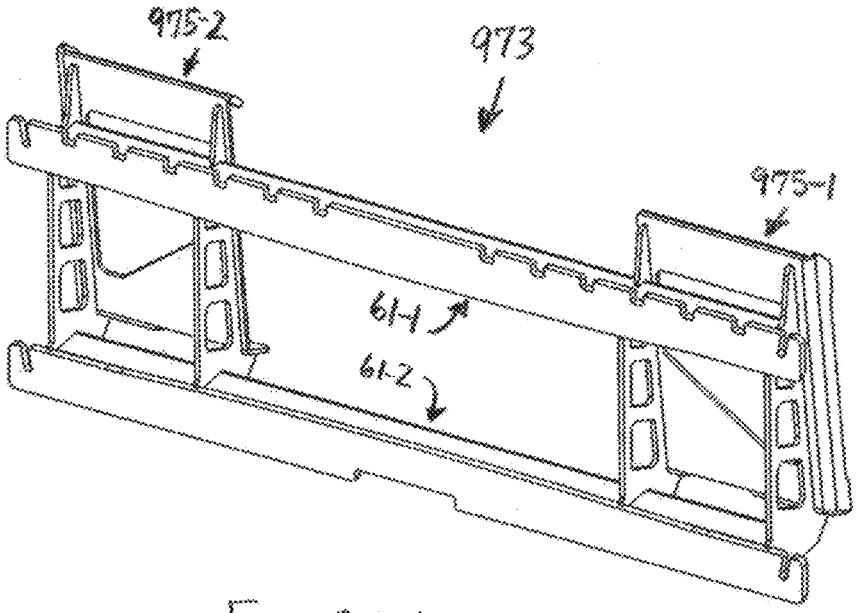
FIGS. 24(*a*) through 24(*c*) are front perspective, rear perspective, and exploded perspective views, respectively, of a second alternative mounting assembly to the mounting assembly shown in FIGS. 4, 5(*a*), 5(*b*), 5(*c*), 5(*d*), 5(*e*), 5(*f*) and 5(*g*).
Figure 24B:
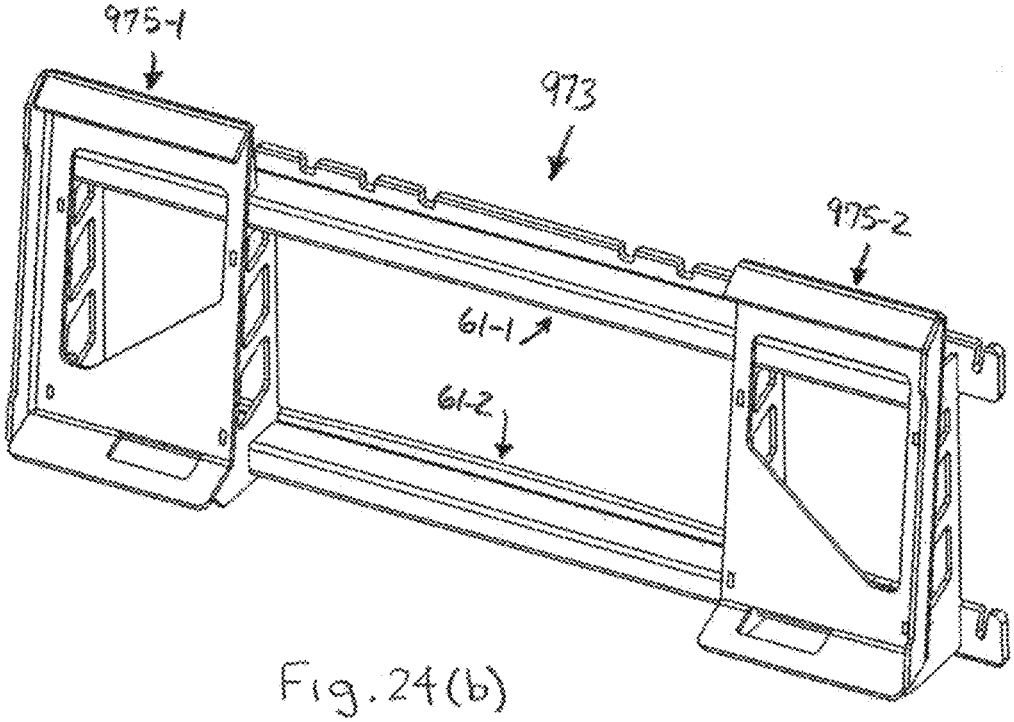
Figure 24C:
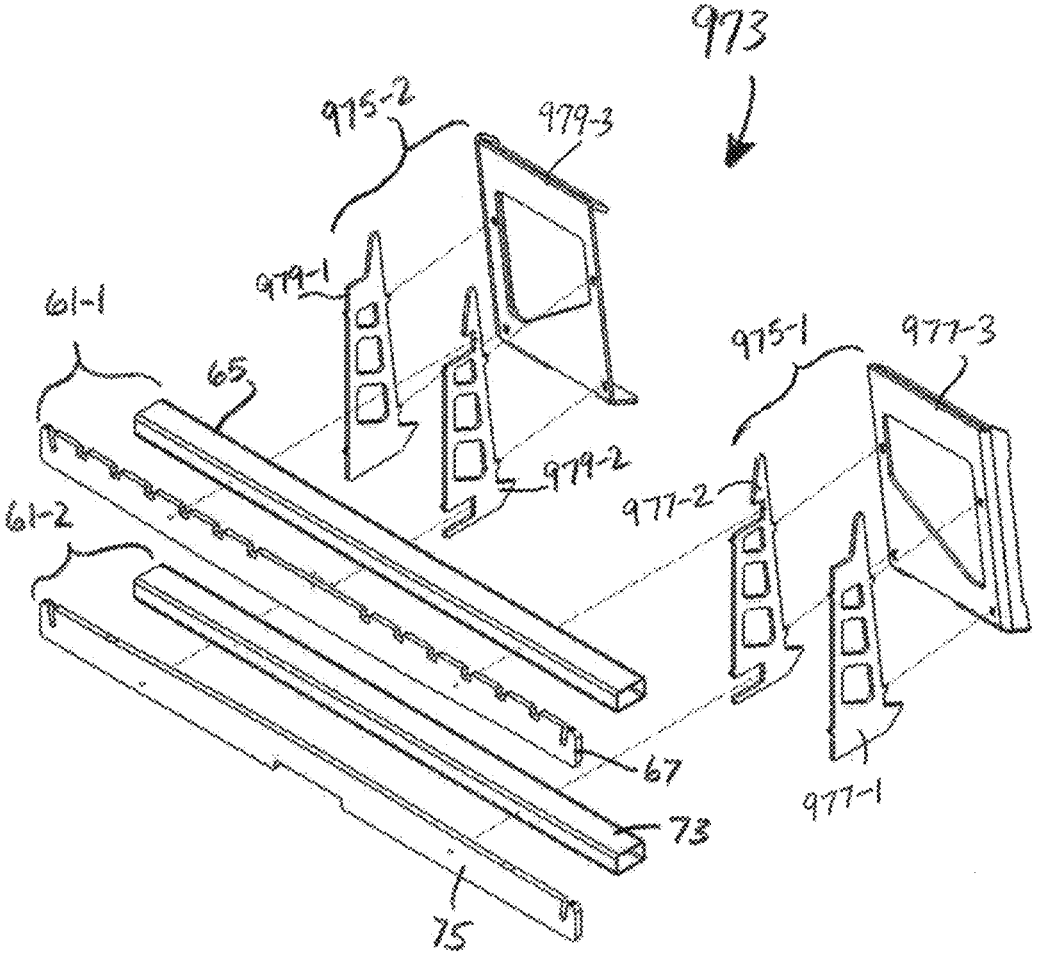

For example, referring now to FIGS. 24(*a*) through 24(*c*), there are shown various views of a second alternative mounting assembly to mounting assembly 53, the second alternative mounting assembly being represented generally by reference number 973. Mounting assembly 973, which may be used with, for example, another conventional loader boom (not shown), may be similar in many respects to mounting assemblies 53 and 953. For example, mounting assembly 973, like mounting assemblies 53 and 953, may comprise a rail 61-1 comprising a rear portion 65 and a front portion 67 and a rail 61-2 comprising a rear portion 73 and a front portion 75. On the other hand, mounting assembly 973 may differ from mounting assemblies 53 and 953 in that, whereas mounting assembly 53 may comprise mounting brackets 63-1 and 63-2 and whereas mounting assembly 953 may comprise mounting brackets 955-1 and 955-2, mounting assembly 973 may comprise mounting brackets 975-1 and 975-2. Brackets 975-1 and 975-2 are preferably made of a high strength steel or other similarly suitable material. Bracket 975-1 may comprise an outside side member 977-1, an inside side member 977-2, and a rear member 977-3. Bracket 975-2, which may be a mirror image of bracket 975-1, may comprise an outside side member 979-1, an inside side member 979-2, and a rear member 979-3. Brackets 975-1 and 975-2 are adapted to be mounted on the front ends of a corresponding loader boom (not shown).

As can be appreciated, while the various different types of tractor attachments described above have been discussed in the context of a common kit, such as kit 51, from which any of these tractor attachments may be derived, it is to be understood that such tractor attachments need not be derived from a kit capable of making more than one type of tractor attachment and, instead, could be made from a starter kit consisting of, for example, a mounting assembly 53 (or a mounting assembly 953) and a single clamping unit 55 or 56 (and, optionally, one or more locking members 59). As can be appreciated, the design of the present tractor attachment kit permits clamping unit 55 (or clamping unit 56) and support units 57 to be arranged in various different combinations and permits the tractor attachment to be assembled and disassembled easily to facilitate transport and storage. In addition, the design of the present tractor kit permits an owner to purchase, relatively inexpensively, a starter kit with a minimal number of components and to add components as budget allows.

In view of the above, one of the desirable features of the present invention is its modular design. Existing grapples are built as one solid continuous unit that weighs several hundred pounds and consumes a large storage space. By contrast, as a result of the design of the present invention, the grapple-type tractor attachment of the present invention can be made as several components that can be stored, transported and used independently of one another. Additionally, because of the modular design of the present invention, these components of the attachment can be combined in different ways, depending on the needs of the user. Moreover, the spacing between neighboring units can be adjusted, if desired, so that, for example, neighboring clamping and support units are either substantially flush with one another or spaced apart by a short distance, such as a few inches.

Another desirable feature of the present invention is that the clamping unit can be used in either of two different modes, a first mode having a greater clamping force but slower closing speed or a second mode having a lesser clamping force but faster closing speed. By contrast, existing grapples have only a single clamping force and closing speed.

Yet another desirable feature of the present invention is the provision of one or more fangs on the upper jaw of the clamping unit, which one or more fangs may be removably mounted.

Still another desirable feature of the present invention is the design of the locking member.

A further desirable feature of the present invention is that the mounting assembly of the grapple-type tractor attachment can also be used with other types of attachment structures, such as forklift tines, a plow adapter, a trailer receiver, and the like, to provide other types of tractor attachment functionalities.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A tractor attachment mountable on a tractor loader boom, the tractor attachment comprising:

(a) a mounting assembly, the mounting assembly being removably mountable on the tractor loader boom; and (b) a clamping unit, the clamping unit being removably mounted on the mounting assembly, the clamping unit comprising an upper jaw and a lower jaw, the upper jaw being pivotally mounted on the lower jaw at a pivot point located at a proximal end of the upper jaw, the clamping unit further comprising a mechanism for moving the upper jaw relative to the lower jaw, wherein the mechanism attaches to the upper jaw at an actuation point, the actuation point being distal to the pivot point along the upper jaw.

2. The tractor attachment as claimed in claim 1 wherein the upper jaw is pivotally mounted on the lower jaw at one of a plurality of alternative pivot points.

3. The tractor attachment as claimed in claim 2, wherein the plurality of alternative pivot points comprises a first pivot point and a second pivot point, the first pivot point producing a faster closing speed of the upper jaw, the second pivot point producing a greater clamping force between the upper jaw and the lower jaw.

4. The tractor attachment as claimed in claim 1 wherein the clamping unit further comprises at least one fang, the at least one fang being removably mounted on the upper jaw.

5. The tractor attachment as claimed in claim 1 wherein the mounting assembly comprises a frame, the frame comprising first and second rails and first and second brackets, the first and second brackets interconnecting the first and second rails and having structure complementary to the tractor loader boom, the clamping unit being removably mounted on the first and second rails.

6. The tractor attachment as claimed in claim 1 further comprising a lock for removably securing the clamping unit on the mounting assembly.

7. The tractor attachment as claimed in claim 6 wherein the mounting assembly comprises a rail, the rail having a notch, wherein the clamping unit comprises an opening, the opening being aligned with the notch, and wherein the lock comprises a first member and a second member, the first member and the second member being generally perpendicular to one another, the first member extending through the notch and through the opening, the second member extending downwardly between the rail and the clamping unit.

8. The tractor attachment of claim 1, wherein the lower jaw comprises a horizontal portion and a vertical portion forming an L-shape, and the upper jaw is pivotally mounted on the vertical portion of the lower jaw at an upper vertical end of the vertical portion.

9. The tractor attachment of claim 1, wherein the mechanism for moving the upper jaw relative to the lower jaw comprises a hydraulic cylinder.

10. A tractor attachment kit for use in assembling a tractor attachment mountable on a tractor loader boom, the tractor attachment kit comprising:

(a) a mounting assembly, the mounting assembly being removably mountable on the tractor loader boom; and (b) a first clamping unit, the first clamping unit being removably mountable on the mounting assembly, the first clamping unit comprising an upper jaw and a lower jaw, the upper jaw being pivotally mounted on the lower jaw at a pivot point located at a proximal end of the upper jaw, the first clamping unit further comprising a mechanism for moving the upper jaw relative to the lower jaw, wherein the mechanism attaches to the upper jaw at an actuation point, the actuation point being distal to the pivot point along the upper jaw.

11. The tractor attachment kit as claimed in claim 10, further comprising a second clamping unit, the second clamping unit being removably mountable on the mounting assembly, the second clamping unit comprising a second upper jaw and a second lower jaw, the second upper jaw being pivotally mounted on the second lower jaw, the second clamping unit further comprising a second mechanism for moving the second upper jaw relative to the second lower jaw of the second clamping unit.

12. The tractor attachment kit as claimed in claim 11, wherein the mounting assembly is sized to permit the first clamping unit and the second clamping unit to be concurrently mounted thereon.

13. The tractor attachment kit of claim 11, wherein the second mechanism for moving the second upper jaw relative to the second lower jaw of the second clamping unit comprises a second hydraulic cylinder.

14. The tractor attachment kit as claimed in claim 10, further comprising a first support unit, the first support unit being removably mountable on the mounting assembly.

15. The tractor attachment kit as claimed in claim 14, wherein the mounting assembly is sized to permit the first clamping unit and the first support unit to be concurrently mounted thereon.

16. The tractor attachment kit as claimed in claim 10, further comprising a second clamping unit and a third clamping unit, the second clamping unit and third clamping unit being identical in structure to the first clamping unit, and further comprising a first support unit and a second support unit, the first support unit and second support unit being identical in structure to one another, each of the first support unit and the second support unit being removably mountable on the mounting assembly.

17. The tractor attachment kit as claimed in claim 10, further comprising a pair of forklift tines removably mounted on the mounting assembly.

18. The tractor attachment kit of claim 10, wherein the mechanism for moving the upper jaw relative to the lower jaw comprises a hydraulic cylinder.

19. The tractor attachment kit of claim 10, further comprising at least two of a second clamping unit, a third clamping unit, a first support unit, or a second support unit;

wherein the mounting assembly is sized to permit mounting of the first clamping unit and at least two of the second clamping unit, the third clamping unit, the first support unit, or the second support unit; and wherein the second clamping unit and the third clamping unit are identical in structure to the first clamping unit, and the first support unit and the second support unit are identical in structure to one another, each of the first support unit and the second support unit being removably mountable on the mounting assembly.

20. A tractor attachment mountable on a tractor loader boom, the tractor attachment comprising:

(a) a mounting assembly, the mounting assembly being removably mountable on the tractor loader boom;

(b) a first clamping unit, the first clamping unit being removably mounted on the mounting assembly, the first clamping unit comprising an upper jaw and a lower jaw, the upper jaw being pivotally mounted on the lower jaw at a pivot point located at a proximal end of the upper jaw, the first clamping unit further comprising a mechanism for moving the upper jaw relative to the lower jaw, wherein the mechanism attaches to the upper jaw at an actuation point, the actuation point being distal to the pivot point along the upper jaw; and (c) one of a second clamping unit removably mounted on the mounting assembly or a first support unit removably mounted on the mounting assembly.

21. The tractor attachment as claimed in claim 20, wherein the second clamping unit is removably mounted on the mounting assembly, and the second clamping unit comprises a second upper jaw and a second lower jaw, the second upper jaw being pivotally mounted on the second lower jaw, the second clamping unit further comprising a second mechanism for moving the second upper jaw relative to the second lower jaw of the second clamping unit.

22. The tractor attachment as claimed in claim 21, further comprising a third clamping unit removably mounted on the mounting assembly, the third clamping unit comprising a third upper jaw and a third lower jaw, the third upper jaw being pivotally mounted on the third lower jaw, the third clamping unit further comprising a third mechanism for moving the third upper jaw relative to the third lower jaw of the third clamping unit.

23. The tractor attachment of claim 22, wherein the third mechanism for moving the third upper jaw relative to the third lower jaw of the third clamping unit comprises a third hydraulic cylinder.

24. The tractor attachment of claim 21, wherein the second mechanism for moving the second upper jaw relative to the second lower jaw of the second clamping unit comprises a second hydraulic cylinder.

25. The tractor attachment as claimed in claim 20, wherein the first support unit is removable mounted on the mounting assembly, the tractor attachment further comprising a second support unit removably mounted on the mounting assembly.

26. The tractor attachment of claim 20, wherein the mechanism for moving the upper jaw relative to the lower jaw comprises a hydraulic cylinder.

* * * * *